US012473731B2

(12) United States Patent
Blackburn et al.

(10) Patent No.: US 12,473,731 B2
(45) **Date of Patent: *Nov. 18, 2025**

(54) TILT-UP AND PRECAST CONSTRUCTION PANELS

(71) Applicants: Kim D. Blackburn, Kaysville, UT (US); Marcus Blackburn, Bountiful, UT (US)

(72) Inventors: Kim D. Blackburn, Kaysville, UT (US); Marcus Blackburn, Bountiful, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/528,688

(22) Filed: Dec. 4, 2023

(65) Prior Publication Data

US 2024/0254763 A1 Aug. 1, 2024

Related U.S. Application Data

(63) Continuation of application No. 17/827,967, filed on May 30, 2022, now Pat. No. 11,834,825, which is a (Continued)

(51) Int. Cl.
*E04B 2/84* (2006.01)
*E04B 1/04* (2006.01)
(Continued)

(52) U.S. Cl.
CPC ..... *E04B 2/84* (2013.01); *E04B 1/04* (2013.01); *E04B 1/14* (2013.01); *E04B 1/355* (2013.01);
(Continued)

(58) Field of Classification Search
CPC ..... E04G 11/483; E04G 11/50; E04G 11/38; E04G 9/02; E04G 11/48; E04G 11/08;
(Continued)

(56) References Cited

U.S. PATENT DOCUMENTS 8,312,683 B2 11/2012 Tadros et al.
2002/0043045 A1 4/2002 Del Din
(Continued)

FOREIGN PATENT DOCUMENTS

WO 2014045244 A2 3/2014

OTHER PUBLICATIONS

Extended European Search Report for related EP application No. 20850916.6, dated Aug. 29, 2023.

*Primary Examiner* — Gisele D Ford
(74) *Attorney, Agent, or Firm* — Bryant J. Keller; John Oldroyd; Kirton McConkie

(57) ABSTRACT

Improved tilt-up and precast construction panels and improved methods for creating the same address deficiencies in the current tilt-up and precast construction panels. Improved tilt-up and precast construction panels use less concrete and less steel reinforcement and weigh less than current tilt-up and precast construction panels. Additionally, improved tilt-up and precast construction panels have greater insulative properties (both heat and sound) than do current tilt-up and precast construction panels. Improved tilt-up and precast construction panels require less labor on the construction site, thereby increasing efficiency and profitability of construction crews. Additional advantages of implementations of the invention will become apparent through the following description and by practice of implementations of the invention.

20 Claims, 36 Drawing Sheets

Related U.S. Application Data continuation of application No. 17/538,974, filed on Nov. 30, 2021, now Pat. No. 11,346,100, which is a continuation of application No. PCT/US2020/045520, filed on Aug. 7, 2020.

(60) Provisional application No. 62/883,620, filed on Aug. 6, 2019.

(51) Int. Cl.

| | |
|---|---|
| ***E04B 1/14*** | (2006.01) |
| ***E04B 1/16*** | (2006.01) |
| ***E04B 1/35*** | (2006.01) |
| ***E04B 2/00*** | (2006.01) |
| ***E04C 2/288*** | (2006.01) |
| ***E04C 5/04*** | (2006.01) |
| ***E04G 11/08*** | (2006.01) |
| ***E04G 21/14*** | (2006.01) |

(52) U.S. Cl.

CPC ..... *E04C 2/2885* (2013.01); *E04C 2/46* (2013.01); *E04C 5/04* (2013.01); *E04G 11/08* (2013.01); *E04G 21/142* (2013.01); *E04B 1/16* (2013.01); *E04B 2103/02* (2013.01)

(58) Field of Classification Search

CPC ..... E04G 21/142; E04B 1/355; E04B 1/14; E04B 2103/02; E04C 2/2885; E04C 2/46; E04C 5/04

See application file for complete search history.

(56) References Cited

U.S. PATENT DOCUMENTS

| | | | |
|---|---|---|---|
| 2007/0095006 | A1 | 5/2007 | Konersmann |
| 2011/0061329 | A1 | 3/2011 | Tadros et al. |

TILT-UP AND PRECAST CONSTRUCTION PANELS

CROSS-REFERENCE TO RELATED APPLICATIONS

This application is a continuation application of U.S. patent application Ser. No. 17/827,967, now U.S. Pat. No. 11,834,825), filed May 30, 2022, entitled "Tilt-Up and Precast Construction Panels" which is a continuation of U.S. patent application Ser. No. 17/538,974, now U.S. Pat. No. 11,346,100), filed Nov. 30, 2021, entitled "Tilt-Up and Precast Construction Panels" which is a continuation of PCT Application PCT/US2020/045520, entitled "Improved Tilt-Up and Precast Construction Panels" filed Aug. 7, 2020, which claims the benefit of U.S. Provisional Application No. 62/883,620, filed Aug. 6, 2019 (the "Priority Application"), entitled "Tilt-Up Construction Panels" each of which is incorporated herein by reference in its entirety.

BACKGROUND OF THE INVENTION

1. Field of the Invention

The present invention relates to construction methods, and more particularly to improved tilt-up and precast construction panels and methods for use in tilt-up and precast construction.

2. Background and Related Art

Tilt-up and precast construction are construction methods that combine advantages of precision and efficiency of design-build methodology with the strength and durability of reinforced concrete. New buildings can be constructed quickly and economically. Tilt-up construction features a series of reinforced concrete panels that are created in a horizontal position at the work site using forms, rebar, and concrete. Precast construction is similar, but usually occurs at a factory location with the panels being shipped to a final location. In either construction method, the forms are shaped and the rebar cut to match the final designs, then concrete is poured into the forms over the rebar and finished and allowed to set.

When the concrete is sufficiently cured and the panels are ready, the forms are removed. In tilt-up construction, or after shipping of precast panels to the worksite, the panels are lifted up into a vertical position, typically by a large crane. Then the panels are lifted into place on foundational footings to form the external structure (walls sections) of the building. Each panel is temporarily braced in place until a roof or other structural element ties the structure together. Exterior and/or interior surfaces of the walls can then be insulated and finished with finishings of choice.

Tilt-up and precast construction have been used since the early 1900s, and have benefitted from advances in computer-aided design and project estimation. Tilt-up and precast construction are alternatives to wood frame construction, steel beam construction, prefabricated steel frame construction, and masonry construction. Tilt-up and precast construction benefit, in many instances, from being adapted to use local labor without requiring specialized technical skills and allowing buildings to be quickly dried in. In most instances, for tilt-up construction using panels poured onsite, the necessary concrete and rebar are readily available locally, as are form materials like lumber.

However, tilt-up and precast construction as currently used involve certain limitations. While tilt-up and precast construction allow for local labor, the process of creating forms, placing and securing rebar properly in the forms, and then pouring and finishing concrete is a labor-intensive process that, while faster and less labor-intensive than some other construction processes, still demand significant effort. Tilt-up and precast panels are generally quite heavy, limiting the size of the tilt-up and precast panels or demanding the use of more-costly, heavier-duty cranes and equipment, as well as the use of more-costly and heavier-duty pick points, supports, and other panel hardware. The weight of precast panels is a significant factor in the distance to which they may be practically shipped and the number of panels that may be shipped in a single shipment, thereby greatly reducing the distances for which shipping is practical or greatly increasing the shipping costs.

Tilt-up and precast construction also are limited in their ability to provide adequate insulation for today's most-demanding energy-efficiency requirements. For example, it can be difficult to achieve desirable certifications such as LEED (Leadership in Energy and Environmental Design) certification without applying significant additional insulation to walls constructed using tilt-up and precast construction, which requires additional building steps, costs, and delays.

While concrete construction, such as is used in traditional tilt-up and precast panels, has certain significant benefits over other types of construction, it is not without environmental costs. Indeed, the environmental and other costs of concrete construction have been increasingly recognized in recent years. The cement industry is one of the primary producers of carbon dioxide, a greenhouse gas that is viewed as a significant contributor to climate change, and cement is one of the primary components of the concrete used in tilt-up and precast construction. Accordingly, it would be a significant improvement to reduce the amount of concrete used in the panels used in tilt-up and precast construction.

For these reasons, there are significant limits to the current tilt-up and precast construction industry and to current tilt-up and precast construction panels. These limits remain unaddressed and limit the manners in which tilt-up and precast construction can be used in the industry.

BRIEF SUMMARY OF THE INVENTION

Implementation of the invention provides improved tilt-up and precast construction panels and improved methods for creating the same that address deficiencies in the current tilt-up and precast construction panels. Improved tilt-up and precast construction panels use less concrete and less rebar while weighing less than current tilt-up and precast construction panels. Additionally, improved tilt-up and precast construction panels have greater insulative properties (both heat and sound) than do current tilt-up and precast construction panels. Improved tilt-up and precast construction panels require less labor on the construction site, thereby increasing efficiency and profitability of construction crews. Improved precast construction panels also require less labor at the precast panel factory, thereby increasing efficiency and profitability of the precast panel industry. Additional advantages of implementations of the invention will become apparent through the following description and by practice of implementations of the invention.

According to certain implementations of the invention, a tilt-up construction panel core body is adapted to be set in concrete in a tilt-up construction panel form and to have concrete poured over the core body thereafter to form a tilt-up construction panel. The tilt-up construction panel core body includes a plurality of core body segments. Each core body segment includes a welded grid body. The welded grid body includes two parallel plane grid mats of longitudinal and transverse wires crossing one another and welded together at the points of cross, the plane grid mats spaced apart from each other by a gap, straight spacer wires cut to length and welded at each end to one wire of a respective one of the grid mats, and a slab of heat-insulating material disposed within the gap between the parallel plane grid mats. The tilt-up construction panel core body also includes a plurality of plane splice mats of longitudinal and transverse wires crossing one another and welded together at the points of cross, the plane splice mats being adapted to be affixed bridging the plane grid mats of adjacent core body segments to link the adjacent core body segments into a unitary construct.

According to some implementations, each core body segment further includes two end cap grid mats each formed of a first plane grid mat of longitudinal and transverse wires, the first plane grid mat being formed into a U shape and affixed to the two parallel plane grid mats so as to encompass one of two opposite transverse ends of the slab of heat-insulating material within grid mat wires. According to some implementations, each of two of the plurality of core body segments includes a side cap grid mat formed of a second plane grid mat of longitudinal and transverse wires, the second plane grid mat being formed into a U shape and affixed to the two parallel plane grid mats so as to encompass one longitudinal end of the slab of heat-insulating material within grid mat wires.

According to some implementations, the tilt-up construction panel core body further includes a plurality of rebar segments inserted between the parallel plane grid mats proximate to and affixed to one or the other of the parallel plane grid mats. According to some implementations, the straight spacer wires extend between the parallel plane grid mats at an oblique angle.

According to some implementations, one or more of the core body segments includes an embedded item to facilitate a structural connection to the tilt-up construction panel either during construction or in service. In some implementations, the embedded item is located at a location on the core body segment where a portion of one of the plane grid mats is absent and a void is present in a portion of the slab of heat-insulating material underlying the absent portion of the plane grid mat to form a concrete-receiving cavity. The embedded item is secured to one or more segments of rebar extending between and secured to the plane grid mat on opposite sides of the absent portion of the plane grid mat. According to some implementations, the embedded item is an item such as a pick point, an insert for lifting and setting the tilt-up construction panel, an insert adapted for connection of temporary bracing to temporarily secure the tilt-up construction panel in place until roof and floor connections are made, a beam pocket, a support angle, or a plate for attachment of a structural component.

According to some implementations, a tilt-up construction panel includes the tilt-up construction panel core body as previously described and a layer of concrete completely surrounding the parallel plane grid mats of the tilt-up construction panel core body. According to some implementations, a tilt-up construction panel includes the tilt-up construction panel core body as previously described and one or more layers of concrete surrounding the parallel plane grid mats of the tilt-up construction panel core body, while leaving one or more ends of the tilt-up construction panel core body free of concrete to provide insulation extending to an edge of the tilt-up construction panel. According to some implementations, a tilt-up construction panel includes the tilt-up construction panel core body as previously described and one or more layers of concrete surrounding the parallel plane grid mats of the tilt-up construction panel core body, while leaving two or more ends of the tilt-up construction panel core body free of concrete to provide insulation extending to two or more edges of the tilt-up construction panel. According to some implementations, the layer or layers of concrete includes concrete between the parallel plane grid mats and the slab of insulation and concrete beyond the parallel plane grid mats.

According to some implementations, a method of using the tilt-up construction panel core body as previously described to form a tilt-up construction panel includes steps of building a form defining the tilt-up construction panel, including outer edges thereof and any openings therein and assembling the plurality of core body segments and the plurality of plane splice mats into the tilt-up construction core body. The method also includes steps of pouring a layer of concrete into the form that has a thickness that is greater than a distance between one of the parallel plane grid mats and the slab of heat-insulating material, laying the tilt-up construction core body into the concrete in the form before the concrete sets, and pressing the tilt-up construction core body into the concrete in the form before the concrete sets until the slab of heat-insulating material rests on the concrete in the form, whereby a lower of the parallel plane grid mats is surrounded by concrete. The method further includes steps of pouring additional concrete over the tilt-up construction core body in the form, whereby concrete surrounds one or more edges of the tilt-up construction core body and completely covers an upper of the parallel plane grid mats a desired thickness, finishing an upper surface of the concrete in the form, and allowing the concrete to cure.

According to some implementations, the step of pouring additional concrete over the tilt-up construction core body in the form is performed before the concrete in the form on which the slab of heat-insulating material rests cures. According to some other implementations, the step of pouring additional concrete over the tilt-up construction core body in the form is performed after the concrete in the form on which the slab of heat-insulating material rests cures or partially cures.

According to some implementations, the method further includes, after the concrete has cured, attaching a lifting device or machine to a lifting attachment point embedded in the tilt-up construction panel to lift the tilt-up construction panel into a vertical position. According to some implementations, the layer of concrete in the form into which the tilt-up construction panel core body is inserted has a thickness of at least approximately twice the distance between one of the parallel plane grid mats and the slab of heat-insulating material, and wherein the concrete that completely covers the upper of the parallel plane grid mats has a thickness at least approximately twice the distance between one of the parallel plane grid mats and the slab of heat-insulating material.

According to additional implementations of the invention, a tilt-up construction panel is provided. The tilt-up construction panel includes a core body. The core body includes a plurality of core body segments, each core body segment including a welded grid body. The welded grid body includes two parallel plane grid mats of longitudinal and transverse wires crossing one another and welded together at the points of cross, the plane grid mats spaced apart from each other by a gap, and straight spacer wires cut to length and welded at each end to one wire of a respective one of the grid mats. The core body segment also includes a slab of heat-insulating material disposed within the gap between the parallel plane grid mats, with a space between the slab of heat-insulating material and each of the two parallel plane grid mats, and two end cap grid mats each including a first plane grid mat of longitudinal and transverse wires, the first plane grid mat being formed into a U shape and affixed to the two parallel plane grid mats so as to encompass one of two opposite transverse ends of the slab of heat-insulating material within grid mat wires. The core body also includes a plurality of plane splice mats of longitudinal and transverse wires crossing one another and welded together at the points of cross, the plane splice mats being adapted to be affixed bridging the plane grid mats of adjacent core body segments to link the adjacent core body segments into a unitary construct. In some implementations, each of two of the plurality of core body segments includes a side cap grid mat having a second plane grid mat of longitudinal and transverse wires, the second plane grid mat being formed into a U shape and affixed to the two parallel plane grid mats so as to encompass one longitudinal end of the slab of heat-insulating material within grid mat wires. The tilt-up construction panel also includes a cured concrete shell surrounding the core body and encompassing the parallel plane grid mats of all of the core body segments.

According to some implementations, a tilt-up construction panel includes the tilt-up construction panel core body as previously described and one or more layers of concrete surrounding the parallel plane grid mats of the tilt-up construction panel core body, while leaving one or more ends of the tilt-up construction panel core body free of concrete to provide insulation extending to an edge of the tilt-up construction panel. According to some implementations, a tilt-up construction panel includes the tilt-up construction panel core body as previously described and one or more layers of concrete surrounding the parallel plane grid mats of the tilt-up construction panel core body, while leaving two or more ends of the tilt-up construction panel core body free of concrete to provide insulation extending to two or more edges of the tilt-up construction panel.

According to some implementations, the cured concrete shell has a thickness of at least approximately twice a distance between one of the parallel plane grid mats and the slab of heat-insulating material. According to some implementations, the straight spacer wires extend between the parallel plane grid mats at an oblique angle. According to some implementations, the tilt-up construction panel further includes a plurality of rebar segments inserted between the parallel plane grid mats proximate to and affixed to one or the other of the parallel plane grid mats.

According to some implementations, one or more of the core body segments includes an embedded item to facilitate a structural connection to the tilt-up construction panel either during construction or in service. According to some implementations, the embedded item is located at a location on the core body segment where a portion of one of the plane grid mats is absent and a void is present in a portion of the slab of heat-insulating material underlying the absent portion of the plane grid mat to form a concrete-receiving cavity. The embedded item is secured to one or more segments of rebar extending between and secured to the plane grid mat on opposite sides of the absent portion of the plane grid mat. According to some implementations, the embedded item is an item such as a pick point, an insert for lifting and setting the tilt-up construction panel, an insert adapted for connection of temporary bracing to temporarily secure the tilt-up construction panel in place until roof and floor connections are made, a beam pocket, a support angle, or a plate for attachment of a structural component.

According to further implementations of the invention, a tilt-up construction panel kit is provided. The tilt-up construction panel kit is adapted to be assembled into a tilt-up construction panel core body that is adapted to be set in concrete in a tilt-up construction panel form and have concrete poured over the core body thereafter to form a tilt-up construction panel. The kit includes a plurality of core body segments, each core body segment including a welded grid body. The welded grid body includes two parallel plane grid mats of longitudinal and transverse wires crossing one another and welded together at the points of cross, the plane grid mats spaced apart from each other by a gap, and straight spacer wires cut to length and welded at each end to one wire of a respective one of the grid mats. The core body segment also includes a slab of heat-insulating material disposed within the gap between the parallel plane grid mats, with a space between the slab of heat-insulating material and each of the two parallel plane grid mats, and two end cap grid mats each including a first plane grid mat of longitudinal and transverse wires, the first plane grid mat being formed into a U shape and affixed to the two parallel plane grid mats so as to encompass one of two opposite transverse ends of the slab of heat-insulating material within grid mat wires. The tilt-up construction panel kit also includes a plurality of plane splice mats of longitudinal and transverse wires crossing one another and welded together at the points of cross, the plane splice mats being adapted to be affixed bridging the plane grid mats of adjacent core body segments to link the adjacent core body segments into a unitary construct. In some implementations, each of two of the plurality of core body segments each includes a side cap grid mat including a second plane grid mat of longitudinal and transverse wires, the second plane grid mat being formed into a U shape and affixed to the two parallel plane grid mats so as to encompass one longitudinal end of the slab of heat-insulating material within grid mat wires.

According to some implementations, a tilt-up construction panel kit is adapted to have one or more layers of concrete surrounding the parallel plane grid mats of the tilt-up construction panel core body, while leaving one or more ends of the tilt-up construction panel core body free of concrete to provide insulation extending to an edge of the tilt-up construction panel. According to some implementations, a tilt-up construction panel kit is adapted to have one or more layers of concrete surrounding the parallel plane grid mats of the tilt-up construction panel core body, while leaving two or more ends of the tilt-up construction panel core body free of concrete to provide insulation extending to two or more edges of the tilt-up construction panel.

According to further implementations of the invention, a method of using a tilt-up construction panel kit to form a tilt-up construction panel core body adapted to be set in concrete in a tilt-up construction panel form and have concrete poured over the core body thereafter to form a tilt-up construction panel is provided. The method includes steps of obtaining a tilt-up construction panel kit, the kit including a plurality of core body segments, each core body segment including a welded grid body. The welded grid body includes two parallel plane grid mats of longitudinal and transverse wires crossing one another and welded together at the points of cross, the plane grid mats spaced apart from each other by a gap, and straight spacer wires cut to length and welded at each end to one wire of a respective one of the grid mats. The core body segments also each include a slab of heat-insulating material disposed within the gap between the parallel plane grid mats, with a space between the slab of heat-insulating material and each of the two parallel plane grid mats, and two end cap grid mats each including a first plane grid mat of longitudinal and transverse wires, the first plane grid mat being formed into a U shape and affixed to the two parallel plane grid mats so as to encompass one of two opposite transverse ends of the slab of heat-insulating material within grid mat wires. The kit also includes a plurality of plane splice mats of longitudinal and transverse wires crossing one another and welded together at the points of cross, the plane splice mats being adapted to be affixed bridging the plane grid mats of adjacent core body segments to link the adjacent core body segments into a unitary construct. Two end core body segments of the plurality of core body segments each includes a side cap grid mat including a second plane grid mat of longitudinal and transverse wires, the second plane grid mat being formed into a U shape and affixed to the two parallel plane grid mats so as to encompass one longitudinal end of the slab of heat-insulating material within grid mat wires.

According to some implementations of the method, the tilt-up construction panel kit is adapted to have one or more layers of concrete surrounding the parallel plane grid mats of the tilt-up construction panel core body, while leaving one or more ends of the tilt-up construction panel core body free of concrete to provide insulation extending to an edge of the tilt-up construction panel. According to some implementations of the method, the tilt-up construction panel kit is adapted to have one or more layers of concrete surrounding the parallel plane grid mats of the tilt-up construction panel core body, while leaving two or more ends of the tilt-up construction panel core body free of concrete to provide insulation extending to two or more edges of the tilt-up construction panel.

The method further includes steps of securing one or more of the plane splice mats along substantially an entire first longitudinal edge of a first parallel plane grid mat of a first of the end core body segments with approximately half the one or more plane splice mats extending past the first longitudinal edge, the first longitudinal edge being an edge opposite the side cap grid mat and placing the first end core body segment on an underlying surface with the one or more plane splice mats lying on the underlying surface. The method also includes repeating steps of securing one or more of the plane splice mats along substantially an entire first longitudinal edge of another core body segment with approximately half the one or more plane splice mats extending past the first longitudinal edge and placing the other core body segment with plane splice mats affixed thereto immediately adjacent a previous core body segment on the underlying surface such that the newly placed core body segment rests with a second longitudinal edge over the one or more plane splice mats of the previous core body segment and with the one or more plane splice mats of the other core body segment lying on the underlying surface. The method further includes, when only a second end core body segment remains, placing the second end core body segment immediately adjacent the previous core body segment on the underlying surface such that a longitudinal edge opposite the side cap grid mat of the second end core body segment is immediately adjacent the previous core body segment and securing a plurality of the plurality of plane splice mats along substantially entire joints between adjacent body segments with approximately half of the one or more plane splice mats extending to each side of its respective joint, whereby the core body segments are secured into a unitary construct.

According to some implementations, the method further includes inverting the unitary construct and securing a second unsecured half of each plane splice mat to its underlying plane grid mat. According to some implementations, plane splice mats are secured to plane grid mats by clips. According to some implementations, the method further includes steps of inserting one or more pieces of rebar between the slab of insulating material and one of the parallel plane grid mats and securing the rebar to the parallel plane grid mat. According to some implementations, rebar is placed and secured on both sides of the slab of insulating material.

According to some implementations, the method further includes inserting an embedded item into at least one of the core body segments to facilitate a structural connection to the tilt-up construction panel either during construction or in service. According to some implementations, inserting the embedded item includes steps of removing a segment of a plane grid mat, creating a void in a portion of the slab of heat-insulating material underlying the absent portion of the plane grid mat to form a concrete-receiving cavity, and securing the embedded item to one or more segments of rebar extending between and secured to the plane grid mat on opposite sides of the absent portion of the plane grid mat. According to some implementations, the embedded item is an item such as a pick point, an insert for lifting and setting the tilt-up construction panel, an insert adapted for connection of temporary bracing to temporarily secure the tilt-up construction panel in place until roof and floor connections are made, a beam pocket, a support angle, or a plate for attachment of a structural component.

According to some implementations, the method further includes using the unitary construct to build a tilt-up panel, including steps of building a form defining the tilt-up construction panel, including outer edges thereof and any openings therein and pouring a layer of concrete into the form that has a thickness that is greater than a distance between one of the parallel plane grid mats and the slab of heat-insulating material. The method also includes steps of laying the unitary construct into the concrete in the form before the concrete sets and pressing the unitary construct into the concrete in the form before the concrete sets until the slab of heat-insulating material rests on the concrete in the form, whereby a lower of the parallel plane grid mats is surrounded by concrete. The method further includes steps of pouring additional concrete over the unitary construct in the form, whereby concrete surrounds one or more edges of the unitary construct and completely covers an upper of the parallel plane grid mats a desired thickness, finishing an upper surface of the concrete in the form, and allowing the concrete to cure.

According to some implementations, the step of pouring additional concrete over the tilt-up construction core body in the form is performed before the concrete in the form on which the slab of heat-insulating material rests cures. According to some other implementations, the step of pouring additional concrete over the tilt-up construction core body in the form is performed after the concrete in the form on which the slab of heat-insulating material rests cures or partially cures.

According to some implementations, the method further includes, after the concrete has cured, attaching a lifting device or machine to a lifting attachment point embedded in the tilt-up construction panel to lift the tilt-up construction panel into a vertical position. According to some implementations, the layer of concrete in the form into which the unitary construct is inserted has a thickness of at least approximately twice the distance between one of the parallel plane grid mats and the slab of heat-insulating material, and wherein the concrete that completely covers the upper of the parallel plane grid mats has a thickness at least approximately twice the distance between one of the parallel plane grid mats and the slab of heat-insulating material.

According to certain implementations of the invention, a tilt-up construction panel core body is adapted to be set in concrete in a tilt-up construction panel form and have concrete poured over the core body thereafter to form a tilt-up construction panel. The tilt-up construction panel core body includes a plurality of core body segments. Each core body segment includes a welded grid body. The welded grid body includes two parallel plane grid mats of longitudinal and transverse wires crossing one another and welded together at the points of cross, the plane grid mats spaced apart from each other by a gap, straight spacer wires cut to length and welded at each end to one wire of a respective one of the grid mats, and a slab of heat-insulating material disposed within the gap between the parallel plane grid mats. The two parallel plane grid mats each have a width that is greater than a width of the slab of heat-insulating material, and the two parallel plane grid mats are positioned relative to the slab of heat-insulating material so as to extend beyond opposite longitudinal edges of the slab of heat-insulating material to form splicing extensions adapted to be affixed bridging the plane grid mats of adjacent core body segments to link the adjacent core body segments into a unitary construct.

According to certain implementations of the invention, a precast construction panel core body is adapted to be set in concrete in a precast construction panel form and have concrete poured over the core body thereafter to form a precast construction panel. The precast construction panel core body includes a plurality of core body segments. Each core body segment includes a welded grid body. The welded grid body includes two parallel plane grid mats of longitudinal and transverse wires crossing one another and welded together at the points of cross, the plane grid mats spaced apart from each other by a gap, straight spacer wires cut to length and welded at each end to one wire of a respective one of the grid mats, and a slab of heat-insulating material disposed within the gap between the parallel plane grid mats. The precast construction panel core body also includes a plurality of plane splice mats of longitudinal and transverse wires crossing one another and welded together at the points of cross, the plane splice mats being adapted to be affixed bridging the plane grid mats of adjacent core body segments to link the adjacent core body segments into a unitary construct.

According to some implementations, each core body segment further includes two end cap grid mats each formed of a first plane grid mat of longitudinal and transverse wires, the first plane grid mat being formed into a U shape and affixed to the two parallel plane grid mats so as to encompass one of two opposite transverse ends of the slab of heat-insulating material within grid mat wires. According to some implementations, each of two of the plurality of core body segments includes a side cap grid mat formed of a second plane grid mat of longitudinal and transverse wires, the second plane grid mat being formed into a U shape and affixed to the two parallel plane grid mats so as to encompass one longitudinal end of the slab of heat-insulating material within grid mat wires.

According to some implementations, the precast construction panel core body further includes a plurality of rebar segments inserted between the parallel plane grid mats proximate to and affixed to one or the other of the parallel plane grid mats. According to some implementations, the straight spacer wires extend between the parallel plane grid mats at an oblique angle.

According to some implementations, one or more of the core body segments includes an embedded item to facilitate a structural connection to the precast construction panel either during construction or in service. In some implementations, the embedded item is located at a location on the core body segment where a portion of one of the plane grid mats is absent and a void is present in a portion of the slab of heat-insulating material underlying the absent portion of the plane grid mat to form a concrete-receiving cavity. The embedded item is secured to one or more segments of rebar extending between and secured to the plane grid mat on opposite sides of the absent portion of the plane grid mat. According to some implementations, the embedded item is an item such as a pick point, an insert for lifting and setting the precast construction panel, an insert adapted for connection of temporary bracing to temporarily secure the precast construction panel in place until roof and floor connections are made, a beam pocket, a support angle, or a plate for attachment of a structural component.

According to some implementations, a precast construction panel includes the precast construction panel core body as previously described and a layer of concrete completely surrounding the parallel plane grid mats of the precast construction panel core body. According to some implementations, a precast construction panel includes the precast construction panel core body as previously described and one or more layers of concrete surrounding the parallel plane grid mats of the precast construction panel core body, while leaving one or more ends of the precast construction panel core body free of concrete to provide insulation extending to an edge of the precast construction panel. According to some implementations, a precast construction panel includes the precast construction panel core body as previously described and one or more layers of concrete surrounding the parallel plane grid mats of the precast construction panel core body, while leaving two or more ends of the precast construction panel core body free of concrete to provide insulation extending to two or more edges of the precast construction panel. According to some implementations, the layer of concrete includes concrete between the parallel plane grid mats and the slab of insulation and concrete beyond the parallel plane grid mats.

According to some implementations, a method of using the precast construction panel core body as previously described to form a precast construction panel includes steps of building a form defining the precast construction panel, including outer edges thereof and any openings therein and assembling the plurality of core body segments and the plurality of plane splice mats into the precast construction core body. The method also includes steps of pouring a layer of concrete into the form that has a thickness that is greater than a distance between one of the parallel plane grid mats and the slab of heat-insulating material, laying the precast construction core body into the concrete in the form before the concrete sets, and pressing the precast construction core body into the concrete in the form before the concrete sets until the slab of heat-insulating material rests on the concrete in the form, whereby a lower of the parallel plane grid mats is surrounded by concrete. The method further includes steps of pouring additional concrete over the precast construction core body in the form, whereby concrete surrounds one or more edges of the precast construction core body and completely covers an upper of the parallel plane grid mats a desired thickness, finishing an upper surface of the concrete in the form, and allowing the concrete to cure.

According to some implementations, the step of pouring additional concrete over the precast construction core body in the form is performed before the concrete in the form on which the slab of heat-insulating material rests cures. According to some other implementations, the step of pouring additional concrete over the precast construction core body in the form is performed after the concrete in the form on which the slab of heat-insulating material rests cures or partially cures.

According to some implementations, the method further includes, after the concrete has cured, attaching a lifting device or machine to a lifting attachment point embedded in the precast construction panel to lift the precast construction panel into a vertical position. According to some implementations, the layer of concrete in the form into which the precast construction panel core body is inserted has a thickness of at least approximately twice the distance between one of the parallel plane grid mats and the slab of heat-insulating material, and wherein the concrete that completely covers the upper of the parallel plane grid mats has a thickness at least approximately twice the distance between one of the parallel plane grid mats and the slab of heat-insulating material.

According to additional implementations of the invention, a precast construction panel is provided. The precast construction panel includes a core body. The core body includes a plurality of core body segments, each core body segment including a welded grid body. The welded grid body includes two parallel plane grid mats of longitudinal and transverse wires crossing one another and welded together at the points of cross, the plane grid mats spaced apart from each other by a gap, and straight spacer wires cut to length and welded at each end to one wire of a respective one of the grid mats. The core body segment also includes a slab of heat-insulating material disposed within the gap between the parallel plane grid mats, with a space between the slab of heat-insulating material and each of the two parallel plane grid mats, and two end cap grid mats each including a first plane grid mat of longitudinal and transverse wires, the first plane grid mat being formed into a U shape and affixed to the two parallel plane grid mats so as to encompass one of two opposite transverse ends of the slab of heat-insulating material within grid mat wires. The core body also includes a plurality of plane splice mats of longitudinal and transverse wires crossing one another and welded together at the points of cross, the plane splice mats being adapted to be affixed bridging the plane grid mats of adjacent core body segments to link the adjacent core body segments into a unitary construct. In some implementations, each of two of the plurality of core body segments includes a side cap grid mat having a second plane grid mat of longitudinal and transverse wires, the second plane grid mat being formed into a U shape and affixed to the two parallel plane grid mats so as to encompass one longitudinal end of the slab of heat-insulating material within grid mat wires. The precast construction panel also includes a cured concrete shell surrounding the core body and encompassing the parallel plane grid mats of all of the core body segments.

According to some implementations, a precast construction panel includes the precast construction panel core body as previously described and one or more layers of concrete surrounding the parallel plane grid mats of the precast construction panel core body, while leaving one or more ends of the precast construction panel core body free of concrete to provide insulation extending to an edge of the precast construction panel. According to some implementations, a precast construction panel includes the precast construction panel core body as previously described and one or more layers of concrete surrounding the parallel plane grid mats of the precast construction panel core body, while leaving two or more ends of the precast construction panel core body free of concrete to provide insulation extending to two or more edges of the precast construction panel.

According to some implementations, the cured concrete shell has a thickness of at least approximately twice a distance between one of the parallel plane grid mats and the slab of heat-insulating material. According to some implementations, the straight spacer wires extend between the parallel plane grid mats at an oblique angle. According to some implementations, the precast construction panel further includes a plurality of rebar segments inserted between the parallel plane grid mats proximate to and affixed to one or the other of the parallel plane grid mats.

According to some implementations, one or more of the core body segments includes an embedded item to facilitate a structural connection to the precast construction panel either during construction or in service. According to some implementations, the embedded item is located at a location on the core body segment where a portion of one of the plane grid mats is absent and a void is present in a portion of the slab of heat-insulating material underlying the absent portion of the plane grid mat to form a concrete-receiving cavity. The embedded item is secured to one or more segments of rebar extending between and secured to the plane grid mat on opposite sides of the absent portion of the plane grid mat. According to some implementations, the embedded item is an item such as a pick point, an insert for lifting and setting the precast construction panel, an insert adapted for connection of temporary bracing to temporarily secure the precast construction panel in place until roof and floor connections are made, a beam pocket, a support angle, or a plate for attachment of a structural component.

According to further implementations of the invention, a precast construction panel kit is provided. The precast construction panel kit is adapted to be assembled into a precast construction panel core body that is adapted to be set in concrete in a precast construction panel form and have concrete poured over the core body thereafter to form a precast construction panel. The kit includes a plurality of core body segments, each core body segment including a welded grid body. The welded grid body includes two parallel plane grid mats of longitudinal and transverse wires crossing one another and welded together at the points of cross, the plane grid mats spaced apart from each other by a gap, and straight spacer wires cut to length and welded at each end to one wire of a respective one of the grid mats. The core body segment also includes a slab of heat-insulating material disposed within the gap between the parallel plane grid mats, with a space between the slab of heat-insulating material and each of the two parallel plane grid mats, and two end cap grid mats each including a first plane grid mat of longitudinal and transverse wires, the first plane grid mat being formed into a U shape and affixed to the two parallel plane grid mats so as to encompass one of two opposite transverse ends of the slab of heat-insulating material within grid mat wires. The precast construction panel kit also includes a plurality of plane splice mats of longitudinal and transverse wires crossing one another and welded together at the points of cross, the plane splice mats being adapted to be affixed bridging the plane grid mats of adjacent core body segments to link the adjacent core body segments into a unitary construct. In some implementations, each of two of the plurality of core body segments includes a side cap grid mat including a second plane grid mat of longitudinal and transverse wires, the second plane grid mat being formed into a U shape and affixed to the two parallel plane grid mats so as to encompass one longitudinal end of the slab of heat-insulating material within grid mat wires.

According to some implementations, a precast construction panel kit is adapted to have one or more layers of concrete surrounding the parallel plane grid mats of the precast construction panel core body, while leaving one or more ends of the precast construction panel core body free of concrete to provide insulation extending to an edge of the precast construction panel. According to some implementations, a precast construction panel kit is adapted to have one or more layers of concrete surrounding the parallel plane grid mats of the precast construction panel core body, while leaving two or more ends of the precast construction panel core body free of concrete to provide insulation extending to two or more edges of the precast construction panel.

According to further implementations of the invention, a method of using a precast construction panel kit to form a precast construction panel core body adapted to be set in concrete in a precast construction panel form and have concrete poured over the core body thereafter to form a precast construction panel is provided. The method includes steps of obtaining a precast construction panel kit, the kit including a plurality of core body segments, each core body segment including a welded grid body. The welded grid body includes two parallel plane grid mats of longitudinal and transverse wires crossing one another and welded together at the points of cross, the plane grid mats spaced apart from each other by a gap, and straight spacer wires cut to length and welded at each end to one wire of a respective one of the grid mats. The core body segments also each include a slab of heat-insulating material disposed within the gap between the parallel plane grid mats, with a space between the slab of heat-insulating material and each of the two parallel plane grid mats, and two end cap grid mats each including a first plane grid mat of longitudinal and transverse wires, the first plane grid mat being formed into a U shape and affixed to the two parallel plane grid mats so as to encompass one of two opposite transverse ends of the slab of heat-insulating material within grid mat wires. The kit also includes a plurality of plane splice mats of longitudinal and transverse wires crossing one another and welded together at the points of cross, the plane splice mats being adapted to be affixed bridging the plane grid mats of adjacent core body segments to link the adjacent core body segments into a unitary construct. Two end core body segments of the plurality of core body segments each includes a side cap grid mat including a second plane grid mat of longitudinal and transverse wires, the second plane grid mat being formed into a U shape and affixed to the two parallel plane grid mats so as to encompass one longitudinal end of the slab of heat-insulating material within grid mat wires.

According to some implementations, a precast construction panel kit is adapted to have one or more layers of concrete surrounding the parallel plane grid mats of the precast construction panel core body, while leaving one or more ends of the precast construction panel core body free of concrete to provide insulation extending to an edge of the precast construction panel. According to some implementations, a precast construction panel kit is adapted to have one or more layers of concrete surrounding the parallel plane grid mats of the precast construction panel core body, while leaving two or more ends of the precast construction panel core body free of concrete to provide insulation extending to two or more edges of the precast construction panel.

The method further includes steps of securing one or more of the plane splice mats along substantially an entire first longitudinal edge of a first parallel plane grid mat of a first of the end core body segments with approximately half the one or more plane splice mats extending past the first longitudinal edge, the first longitudinal edge being an edge opposite the side cap grid mat and placing the first end core body segment on an underlying surface with the one or more plane splice mats lying on the underlying surface. The method also includes repeating steps of securing one or more of the plane splice mats along substantially an entire first longitudinal edge of another core body segment with approximately half the one or more plane splice mats extending past the first longitudinal edge and placing the other core body segment with plane splice mats affixed thereto immediately adjacent a previous core body segment on the underlying surface such that the newly placed core body segment rests with a second longitudinal edge over the one or more plane splice mats of the previous core body segment and with the one or more plane splice mats of the other core body segment lying on the underlying surface. The method further includes, when only a second end core body segment remains, placing the second end core body segment immediately adjacent the previous core body segment on the underlying surface such that a longitudinal edge opposite the side cap grid mat of the second end core body segment is immediately adjacent the previous core body segment and securing a plurality of the plurality of plane splice mats along substantially entire joints between adjacent body segments with approximately half of the one or more plane splice mats extending to each side of its respective joint, whereby the core body segments are secured into a unitary construct.

According to some implementations, the method further includes inverting the unitary construct and securing a second unsecured half of each plane splice mat to its underlying plane grid mat. According to some implementations, plane splice mats are secured to plane grid mats by clips. According to some implementations, the method further includes steps of inserting one or more pieces of rebar between the slab of insulating material and one of the parallel plane grid mats and securing the rebar to the parallel plane grid mat. According to some implementations, rebar is placed and secured on both sides of the slab of insulating material.

According to some implementations, the method further includes inserting an embedded item into at least one of the core body segments to facilitate a structural connection to the precast construction panel either during construction or in service. According to some implementations, inserting the embedded item includes steps of removing a segment of a plane grid mat, creating a void in a portion of the slab of heat-insulating material underlying the absent portion of the plane grid mat to form a concrete-receiving cavity, and securing the embedded item to one or more segments of rebar extending between and secured to the plane grid mat on opposite sides of the absent portion of the plane grid mat. According to some implementations, the embedded item is an item such as a pick point, an insert for lifting and setting the precast construction panel, an insert adapted for connection of temporary bracing to temporarily secure the precast construction panel in place until roof and floor connections are made, a beam pocket, a support angle, or a plate for attachment of a structural component.

According to some implementations, the method further includes using the unitary construct to build a precast panel, including steps of building a form defining the precast construction panel, including outer edges thereof and any openings therein and pouring a layer of concrete into the form that has a thickness that is greater than a distance between one of the parallel plane grid mats and the slab of heat-insulating material. The method also includes steps of laying the unitary construct into the concrete in the form before the concrete sets and pressing the unitary construct into the concrete in the form before the concrete sets until the slab of heat-insulating material rests on the concrete in the form, whereby a lower of the parallel plane grid mats is surrounded by concrete. The method further includes steps of pouring additional concrete over the unitary construct in the form, whereby concrete surrounds one or more edges of the unitary construct and completely covers an upper of the parallel plane grid mats a desired thickness, finishing an upper surface of the concrete in the form, and allowing the concrete to cure.

According to some implementations, the step of pouring additional concrete over the precast construction core body in the form is performed before the concrete in the form on which the slab of heat-insulating material rests cures. According to some other implementations, the step of pouring additional concrete over the precast construction core body in the form is performed after the concrete in the form on which the slab of heat-insulating material rests cures or partially cures.

According to some implementations, the method further includes, after the concrete has cured, attaching a lifting device or machine to a lifting attachment point embedded in the precast construction panel to lift the precast construction panel into a vertical position. According to some implementations, the layer of concrete in the form into which the unitary construct is inserted has a thickness of at least approximately twice the distance between one of the parallel plane grid mats and the slab of heat-insulating material, and wherein the concrete that completely covers the upper of the parallel plane grid mats has a thickness at least approximately twice the distance between one of the parallel plane grid mats and the slab of heat-insulating material.

According to certain implementations of the invention, a precast construction panel core body is adapted to be set in concrete in a precast construction panel form and have concrete poured over the core body thereafter to form a precast construction panel. The precast construction panel core body includes a plurality of core body segments. Each core body segment includes a welded grid body. The welded grid body includes two parallel plane grid mats of longitudinal and transverse wires crossing one another and welded together at the points of cross, the plane grid mats spaced apart from each other by a gap, straight spacer wires cut to length and welded at each end to one wire of a respective one of the grid mats, and a slab of heat-insulating material disposed within the gap between the parallel plane grid mats. The two parallel plane grid mats each have a width that is greater than a width of the slab of heat-insulating material, and the two parallel plane grid mats are positioned relative to the slab of heat-insulating material so as to extend beyond opposite longitudinal edges of the slab of heat-insulating material to form splicing extensions adapted to be affixed bridging the plane grid mats of adjacent core body segments to link the adjacent core body segments into a unitary construct.

BRIEF DESCRIPTION OF THE SEVERAL VIEWS OF THE DRAWINGS

The objects and features of the present invention will become more fully apparent from the following description and appended claims, taken in conjunction with the accompanying drawings.

Understanding that these drawings depict only typical embodiments of the invention and are, therefore, not to be considered limiting of its scope, the invention will be described and explained with additional specificity and detail through the use of the accompanying drawings in which.

DETAILED DESCRIPTION OF THE INVENTION

Figure 1:
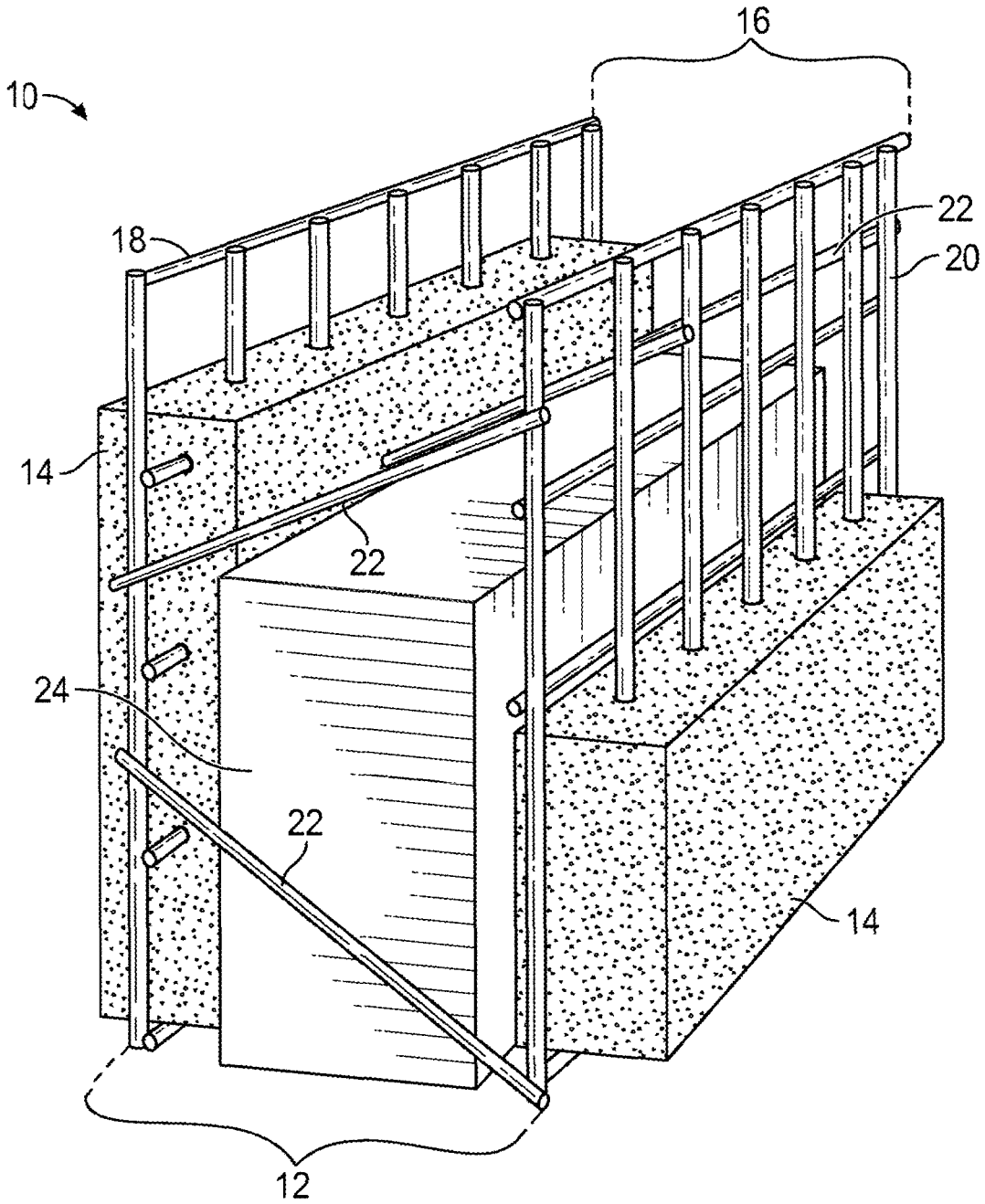
FIG. 1 shows a cutaway view illustrating aspects of a tilt-up or precast wall panel in accordance with embodiments of the invention.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Embodiments of the invention provide improved tilt-up and precast construction panels and improved methods for creating the same that address deficiencies in the current tilt-up and precast construction panels. For purposes of this application, it should be understood that systems and methods described herein are adapted for use in both the tilt-up and precast construction panel industries. In fact, for purposes of this application, the primary difference between a method of forming a tilt-up panel and a method of forming a precast panel or between a tilt-up construction panel and a precast construction panel is the location of creating the respective panel, with a tilt-up panel being formed in comparative geographic proximity to the construction site while precast panels are typically formed at a dedicated facility geographically removed from the construction site where the panel will be used. In the view of some, forming construction panels such as disclosed herein at a dedicated off-site facility promotes factors such as quality control and uniformity, but concerns such as these have relatively minimal impact on the benefits of use of embodiments of the invention as disclosed herein; similar benefits are obtained in both precast and tilt-up contexts and industries, as the terms "precast" and "tilt-up" are understood by their respective industries. Accordingly, unless the use of a particular term is explicitly limited by the context thereof, the terms "tilt-up" and "precast" as used in the detailed description and in the claims are expressly intended to be inclusive, not exclusive, and to encompass both terms, such that a "tilt-up" construction panel embraces both a tilt-up construction panel formed at or in geographic proximity to a construction site where the construction panel will be used as well as a precast construction panel formed at a dedicated facility relatively geographically remote from the construction site where the construction panel will be used. Similarly, a "precast" construction panel embraces both a tilt-up construction panel formed at or in geographic proximity to a construction site where the construction panel will be used as well as a precast construction panel formed at a dedicated facility relatively geographically remote from the construction site where the construction panel will be used.

Improved tilt-up and precast construction panels use less concrete and less tied-in-place rebar or other steel reinforcement (as much as approximately 90% reduction) and weigh less than (for example, approximately 50% less) current traditional steel-and-concrete tilt-up and precast construction panels. Additionally, improved tilt-up and precast construction panels have greater insulative properties (both heat and sound) than do current tilt-up and precast construction panels. Improved tilt-up and precast construction panels require less labor on the construction site, thereby increasing efficiency and profitability of construction crews. Improved precast construction panels also require less labor at the precast panel factory, thereby increasing efficiency and profitability of the precast panel industry. Additional advantages of embodiments of the invention will become apparent through the following description and by practice of embodiments of the invention.

According to certain embodiments of the invention, a tilt-up construction panel core body is adapted to be set in concrete in a tilt-up construction panel form and to have concrete poured over the core body thereafter to form a tilt-up construction panel. The tilt-up construction panel core body includes a plurality of core body segments. Each core body segment includes a welded grid body. The welded grid body includes two parallel plane grid mats of longitudinal and transverse wires crossing one another and welded together at the points of cross, the plane grid mats spaced apart from each other by a gap, straight spacer wires cut to length and welded at each end to one wire of a respective one of the grid mats, and a slab of heat-insulating material disposed within the gap between the parallel plane grid mats. The tilt-up construction panel core body also includes a plurality of plane splice mats of longitudinal and transverse wires crossing one another and welded together at the points of cross, the plane splice mats being adapted to be affixed bridging the plane grid mats of adjacent core body segments to link the adjacent core body segments into a unitary construct.

According to some embodiments, each core body segment further includes two end cap grid mats each formed of a first plane grid mat of longitudinal and transverse wires, the first plane grid mat being formed into a U shape and affixed to the two parallel plane grid mats so as to encompass one of two opposite transverse ends of the slab of heat-insulating material within grid mat wires. According to some embodiments, each of two of the plurality of core body segments includes a side cap grid mat formed of a second plane grid mat of longitudinal and transverse wires, the second plane grid mat being formed into a U shape and affixed to the two parallel plane grid mats so as to encompass one longitudinal end of the slab of heat-insulating material within grid mat wires.

According to some embodiments, the tilt-up construction panel core body further includes a plurality of rebar segments inserted between the parallel plane grid mats proximate to and affixed to one or the other of the parallel plane grid mats. According to some embodiments, the straight spacer wires extend between the parallel plane grid mats at an oblique angle.

According to some embodiments, one or more of the core body segments includes an embedded item to facilitate a structural connection to the tilt-up construction panel either during construction or in service. In some embodiments, the embedded item is located at a location on the core body segment where a portion of one of the plane grid mats is absent and a void is present in a portion of the slab of heat-insulating material underlying the absent portion of the plane grid mat to form a concrete-receiving cavity. The embedded item is secured to one or more segments of rebar extending between and secured to the plane grid mat on opposite sides of the absent portion of the plane grid mat. According to some embodiments, the embedded item is an item such as a pick point, an insert for lifting and setting the tilt-up construction panel, an insert adapted for connection of temporary bracing to temporarily secure the tilt-up construction panel in place until roof and floor connections are made, a beam pocket, a support angle, or a plate for attachment of a structural component.

According to some embodiments, a tilt-up construction panel includes the tilt-up construction panel core body as previously described and a layer of concrete completely surrounding the parallel plane grid mats of the tilt-up construction panel core body. According to some embodiments, a tilt-up construction panel includes the tilt-up construction panel core body as previously described and one or more layers of concrete surrounding the parallel plane grid mats of the tilt-up construction panel core body, while leaving one or more ends of the tilt-up construction panel core body free of concrete to provide insulation extending to an edge of the tilt-up construction panel. According to some embodiments, a tilt-up construction panel includes the tilt-up construction panel core body as previously described and one or more layers of concrete surrounding the parallel plane grid mats of the tilt-up construction panel core body, while leaving two or more ends of the tilt-up construction panel core body free of concrete to provide insulation extending to two or more edges of the tilt-up construction panel. According to some embodiments, the layer of concrete includes concrete between the parallel plane grid mats and the slab of insulation and concrete beyond the parallel plane grid mats.

According to some embodiments, a method of using the tilt-up construction panel core body as previously described to form a tilt-up construction panel includes steps of building a form defining the tilt-up construction panel, including outer edges thereof and any openings therein and assembling the plurality of core body segments and the plurality of plane splice mats into the tilt-up construction core body. The method also includes steps of pouring a layer of concrete into the form that has a thickness that is greater than a distance between one of the parallel plane grid mats and the slab of heat-insulating material, laying the tilt-up construction core body into the concrete in the form before the concrete sets, and pressing the tilt-up construction core body into the concrete in the form before the concrete sets until the slab of heat-insulating material rests on the concrete in the form, whereby a lower of the parallel plane grid mats is surrounded by concrete. The method further includes steps of pouring additional concrete over the tilt-up construction core body in the form, whereby concrete surrounds one or more edges of the tilt-up construction core body and completely covers an upper of the parallel plane grid mats a desired thickness, finishing an upper surface of the concrete in the form, and allowing the concrete to cure.

According to some embodiments, the step of pouring additional concrete over the tilt-up construction core body in the form is performed before the concrete in the form on which the slab of heat-insulating material rests cures. According to some other embodiments, the step of pouring additional concrete over the tilt-up construction core body in the form is performed after the concrete in the form on which the slab of heat-insulating material rests cures or partially cures.

According to some embodiments, the method further includes, after the concrete has cured, attaching a lifting device or machine to a lifting attachment point embedded in the tilt-up construction panel to lift the tilt-up construction panel into a vertical position. According to some embodiments, the layer of concrete in the form into which the tilt-up construction panel core body is inserted has a thickness of at least approximately twice the distance between one of the parallel plane grid mats and the slab of heat-insulating material, and wherein the concrete that completely covers the upper of the parallel plane grid mats has a thickness at least approximately twice the distance between one of the parallel plane grid mats and the slab of heat-insulating material.

According to additional embodiments of the invention, a tilt-up construction panel is provided. The tilt-up construction panel includes a core body. The core body includes a plurality of core body segments, each core body segment including a welded grid body. The welded grid body includes two parallel plane grid mats of longitudinal and transverse wires crossing one another and welded together at the points of cross, the plane grid mats spaced apart from each other by a gap, and straight spacer wires cut to length and welded at each end to one wire of a respective one of the grid mats. The core body segment also includes a slab of heat-insulating material disposed within the gap between the parallel plane grid mats, with a space between the slab of heat-insulating material and each of the two parallel plane grid mats, and two end cap grid mats each including a first plane grid mat of longitudinal and transverse wires, the first plane grid mat being formed into a U shape and affixed to the two parallel plane grid mats so as to encompass one of two opposite transverse ends of the slab of heat-insulating material within grid mat wires. The core body also includes a plurality of plane splice mats of longitudinal and transverse wires crossing one another and welded together at the points of cross, the plane splice mats being adapted to be affixed bridging the plane grid mats of adjacent core body segments to link the adjacent core body segments into a unitary construct. In some embodiments, each of two of the plurality of core body segments includes a side cap grid mat having a second plane grid mat of longitudinal and transverse wires, the second plane grid mat being formed into a U shape and affixed to the two parallel plane grid mats so as to encompass one longitudinal end of the slab of heat-insulating material within grid mat wires. The tilt-up construction panel also includes a cured concrete shell surrounding the core body and encompassing the parallel plane grid mats of all of the core body segments.

According to some embodiments, a tilt-up construction panel includes the tilt-up construction panel core body as previously described and one or more layers of concrete surrounding the parallel plane grid mats of the tilt-up construction panel core body, while leaving one or more ends of the tilt-up construction panel core body free of concrete to provide insulation extending to an edge of the tilt-up construction panel. According to some embodiments, a tilt-up construction panel includes the tilt-up construction panel core body as previously described and one or more layers of concrete surrounding the parallel plane grid mats of the tilt-up construction panel core body, while leaving two or more ends of the tilt-up construction panel core body free of concrete to provide insulation extending to two or more edges of the tilt-up construction panel.

According to some embodiments, the cured concrete shell has a thickness of at least approximately twice a distance between one of the parallel plane grid mats and the slab of heat-insulating material. According to some embodiments, the straight spacer wires extend between the parallel plane grid mats at an oblique angle. According to some embodiments, the tilt-up construction panel further includes a plurality of rebar segments inserted between the parallel plane grid mats proximate to and affixed to one or the other of the parallel plane grid mats.

According to some embodiments, one or more of the core body segments includes an embedded item to facilitate a structural connection to the tilt-up construction panel either during construction or in service. According to some embodiments, the embedded item is located at a location on the core body segment where a portion of one of the plane grid mats is absent and a void is present in a portion of the slab of heat-insulating material underlying the absent portion of the plane grid mat to form a concrete-receiving cavity. The embedded item is secured to one or more segments of rebar extending between and secured to the plane grid mat on opposite sides of the absent portion of the plane grid mat. According to some embodiments, the embedded item is an item such as a pick point, an insert for lifting and setting the tilt-up construction panel, an insert adapted for connection of temporary bracing to temporarily secure the tilt-up construction panel in place until roof and floor connections are made, a beam pocket, a support angle, or a plate for attachment of a structural component.

According to further embodiments of the invention, a tilt-up construction panel kit is provided. The tilt-up construction panel kit is adapted to be assembled into a tilt-up construction panel core body that is adapted to be set in concrete in a tilt-up construction panel form and have concrete poured over the core body thereafter to form a tilt-up construction panel. The kit includes a plurality of core body segments, each core body segment including a welded grid body. The welded grid body includes two parallel plane grid mats of longitudinal and transverse wires crossing one another and welded together at the points of cross, the plane grid mats spaced apart from each other by a gap, and straight spacer wires cut to length and welded at each end to one wire of a respective one of the grid mats. The core body segment also includes a slab of heat-insulating material disposed within the gap between the parallel plane grid mats, with a space between the slab of heat-insulating material and each of the two parallel plane grid mats, and two end cap grid mats each including a first plane grid mat of longitudinal and transverse wires, the first plane grid mat being formed into a U shape and affixed to the two parallel plane grid mats so as to encompass one of two opposite transverse ends of the slab of heat-insulating material within grid mat wires. The tilt-up construction panel kit also includes a plurality of plane splice mats of longitudinal and transverse wires crossing one another and welded together at the points of cross, the plane splice mats being adapted to be affixed bridging the plane grid mats of adjacent core body segments to link the adjacent core body segments into a unitary construct. In some embodiments, each of two of the plurality of core body segments includes a side cap grid mat including a second plane grid mat of longitudinal and transverse wires, the second plane grid mat being formed into a U shape and affixed to the two parallel plane grid mats so as to encompass one longitudinal end of the slab of heat-insulating material within grid mat wires.

According to some embodiments, a tilt-up construction panel kit is adapted to have one or more layers of concrete surrounding the parallel plane grid mats of the tilt-up construction panel core body, while leaving one or more ends of the tilt-up construction panel core body free of concrete to provide insulation extending to an edge of the tilt-up construction panel. According to some embodiments, a tilt-up construction panel kit is adapted to have one or more layers of concrete surrounding the parallel plane grid mats of the tilt-up construction panel core body, while leaving two or more ends of the tilt-up construction panel core body free of concrete to provide insulation extending to two or more edges of the tilt-up construction panel.

According to further embodiments of the invention, a method of using a tilt-up construction panel kit to form a tilt-up construction panel core body adapted to be set in concrete in a tilt-up construction panel form and have concrete poured over the core body thereafter to form a tilt-up construction panel is provided. The method includes steps of obtaining a tilt-up construction panel kit, the kit including a plurality of core body segments, each core body segment including a welded grid body. The welded grid body includes two parallel plane grid mats of longitudinal and transverse wires crossing one another and welded together at the points of cross, the plane grid mats spaced apart from each other by a gap, and straight spacer wires cut to length and welded at each end to one wire of a respective one of the grid mats. The core body segments also each include a slab of heat-insulating material disposed within the gap between the parallel plane grid mats, with a space between the slab of heat-insulating material and each of the two parallel plane grid mats, and two end cap grid mats each including a first plane grid mat of longitudinal and transverse wires, the first plane grid mat being formed into a U shape and affixed to the two parallel plane grid mats so as to encompass one of two opposite transverse ends of the slab of heat-insulating material within grid mat wires. The kit also includes a plurality of plane splice mats of longitudinal and transverse wires crossing one another and welded together at the points of cross, the plane splice mats being adapted to be affixed bridging the plane grid mats of adjacent core body segments to link the adjacent core body segments into a unitary construct. Two end core body segments of the plurality of core body segments each includes a side cap grid mat including a second plane grid mat of longitudinal and transverse wires, the second plane grid mat being formed into a U shape and affixed to the two parallel plane grid mats so as to encompass one longitudinal end of the slab of heat-insulating material within grid mat wires.

According to some embodiments of the method, the tilt-up construction panel kit is adapted to have one or more layers of concrete surrounding the parallel plane grid mats of the tilt-up construction panel core body, while leaving one or more ends of the tilt-up construction panel core body free of concrete to provide insulation extending to an edge of the tilt-up construction panel. According to some embodiments of the method, the tilt-up construction panel kit is adapted to have one or more layers of concrete surrounding the parallel plane grid mats of the tilt-up construction panel core body, while leaving two or more ends of the tilt-up construction panel core body free of concrete to provide insulation extending to two or more edges of the tilt-up construction panel.

The method further includes steps of securing one or more of the plane splice mats along substantially an entire first longitudinal edge of a first parallel plane grid mat of a first of the end core body segments with approximately half the one or more plane splice mats extending past the first longitudinal edge, the first longitudinal edge being an edge opposite the side cap grid mat and placing the first end core body segment on an underlying surface with the one or more plane splice mats lying on the underlying surface. The method also includes repeating steps of securing one or more of the plane splice mats along substantially an entire first longitudinal edge of another core body segment with approximately half the one or more plane splice mats extending past the first longitudinal edge and placing the other core body segment with plane splice mats affixed thereto immediately adjacent a previous core body segment on the underlying surface such that the newly placed core body segment rests with a second longitudinal edge over the one or more plane splice mats of the previous core body segment and with the one or more plane splice mats of the other core body segment lying on the underlying surface. The method further includes, when only a second end core body segment remains, placing the second end core body segment immediately adjacent the previous core body segment on the underlying surface such that a longitudinal edge opposite the side cap grid mat of the second end core body segment is immediately adjacent the previous core body segment and securing a plurality of the plurality of plane splice mats along substantially entire joints between adjacent body segments with approximately half of the one or more plane splice mats extending to each side of its respective joint, whereby the core body segments are secured into a unitary construct.

According to some embodiments, the method further includes inverting the unitary construct and securing a second unsecured half of each plane splice mat to its underlying plane grid mat. According to some embodiments, plane splice mats are secured to plane grid mats by clips. According to some embodiments, the method further includes steps of inserting one or more pieces of rebar between the slab of insulating material and one of the parallel plane grid mats and securing the rebar to the parallel plane grid mat. According to some embodiments, rebar is placed and secured on both sides of the slab of insulating material.

According to some embodiments, the method further includes inserting an embedded item into at least one of the core body segments to facilitate a structural connection to the tilt-up construction panel either during construction or in service. According to some embodiments, inserting the embedded item includes steps of removing a segment of a plane grid mat, creating a void in a portion of the slab of heat-insulating material underlying the absent portion of the plane grid mat to form a concrete-receiving cavity, and securing the embedded item to one or more segments of rebar extending between and secured to the plane grid mat on opposite sides of the absent portion of the plane grid mat. According to some embodiments, the embedded item is an item such as a pick point, an insert for lifting and setting the tilt-up construction panel, an insert adapted for connection of temporary bracing to temporarily secure the tilt-up construction panel in place until roof and floor connections are made, a beam pocket, a support angle, or a plate for attachment of a structural component.

According to some embodiments, the method further includes using the unitary construct to build a tilt-up panel, including steps of building a form defining the tilt-up construction panel, including outer edges thereof and any openings therein and pouring a layer of concrete into the form that has a thickness that is greater than a distance between one of the parallel plane grid mats and the slab of heat-insulating material. The method also includes steps of laying the unitary construct into the concrete in the form before the concrete sets and pressing the unitary construct into the concrete in the form before the concrete sets until the slab of heat-insulating material rests on the concrete in the form, whereby a lower of the parallel plane grid mats is surrounded by concrete. The method further includes steps of pouring additional concrete over the unitary construct in the form, whereby concrete surrounds one or more edges of the unitary construct and completely covers an upper of the parallel plane grid mats a desired thickness, finishing an upper surface of the concrete in the form, and allowing the concrete to cure.

According to some embodiments, the step of pouring additional concrete over the tilt-up construction core body in the form is performed before the concrete in the form on which the slab of heat-insulating material rests cures. According to some other embodiments, the step of pouring additional concrete over the tilt-up construction core body in the form is performed after the concrete in the form on which the slab of heat-insulating material rests cures or partially cures.

According to some embodiments, the method further includes, after the concrete has cured, attaching a lifting device or machine to a lifting attachment point embedded in the tilt-up construction panel to lift the tilt-up construction panel into a vertical position. According to some embodiments, the layer of concrete in the form into which the unitary construct is inserted has a thickness of at least approximately twice the distance between one of the parallel plane grid mats and the slab of heat-insulating material, and wherein the concrete that completely covers the upper of the parallel plane grid mats has a thickness at least approximately twice the distance between one of the parallel plane grid mats and the slab of heat-insulating material.

According to certain embodiments of the invention, a tilt-up construction panel core body is adapted to be set in concrete in a tilt-up construction panel form and have concrete poured over the core body thereafter to form a tilt-up construction panel. The tilt-up construction panel core body includes a plurality of core body segments. Each core body segment includes a welded grid body. The welded grid body includes two parallel plane grid mats of longitudinal and transverse wires crossing one another and welded together at the points of cross, the plane grid mats spaced apart from each other by a gap, straight spacer wires cut to length and welded at each end to one wire of a respective one of the grid mats, and a slab of heat-insulating material disposed within the gap between the parallel plane grid mats. The two parallel plane grid mats each have a width that is greater than a width of the slab of heat-insulating material, and the two parallel plane grid mats are positioned relative to the slab of heat-insulating material so as to extend beyond opposite longitudinal edges of the slab of heat-insulating material to form splicing extensions adapted to be affixed bridging the plane grid mats of adjacent core body segments to link the adjacent core body segments into a unitary construct.

According to certain embodiments of the invention, a precast construction panel core body is adapted to be set in concrete in a precast construction panel form and have concrete poured over the core body thereafter to form a precast construction panel. The precast construction panel core body includes a plurality of core body segments. Each core body segment includes a welded grid body. The welded grid body includes two parallel plane grid mats of longitudinal and transverse wires crossing one another and welded together at the points of cross, the plane grid mats spaced apart from each other by a gap, straight spacer wires cut to length and welded at each end to one wire of a respective one of the grid mats, and a slab of heat-insulating material disposed within the gap between the parallel plane grid mats. The precast construction panel core body also includes a plurality of plane splice mats of longitudinal and transverse wires crossing one another and welded together at the points of cross, the plane splice mats being adapted to be affixed bridging the plane grid mats of adjacent core body segments to link the adjacent core body segments into a unitary construct.

According to some embodiments, each core body segment further includes two end cap grid mats each formed of a first plane grid mat of longitudinal and transverse wires, the first plane grid mat being formed into a U shape and affixed to the two parallel plane grid mats so as to encompass one of two opposite transverse ends of the slab of heat-insulating material within grid mat wires. According to some embodiments, each of two of the plurality of core body segments includes a side cap grid mat formed of a second plane grid mat of longitudinal and transverse wires, the second plane grid mat being formed into a U shape and affixed to the two parallel plane grid mats so as to encompass one longitudinal end of the slab of heat-insulating material within grid mat wires.

According to some embodiments, the precast construction panel core body further includes a plurality of rebar segments inserted between the parallel plane grid mats proximate to and affixed to one or the other of the parallel plane grid mats. According to some embodiments, the straight spacer wires extend between the parallel plane grid mats at an oblique angle.

According to some embodiments, one or more of the core body segments includes an embedded item to facilitate a structural connection to the precast construction panel either during construction or in service. In some embodiments, the embedded item is located at a location on the core body segment where a portion of one of the plane grid mats is absent and a void is present in a portion of the slab of heat-insulating material underlying the absent portion of the plane grid mat to form a concrete-receiving cavity. The embedded item is secured to one or more segments of rebar extending between and secured to the plane grid mat on opposite sides of the absent portion of the plane grid mat. According to some embodiments, the embedded item is an item such as a pick point, an insert for lifting and setting the precast construction panel, an insert adapted for connection of temporary bracing to temporarily secure the precast construction panel in place until roof and floor connections are made, a beam pocket, a support angle, or a plate for attachment of a structural component.

According to some embodiments, a precast construction panel includes the precast construction panel core body as previously described and a layer of concrete completely surrounding the parallel plane grid mats of the precast construction panel core body. According to some embodiments, a precast construction panel includes the precast construction panel core body as previously described and one or more layers of concrete surrounding the parallel plane grid mats of the precast construction panel core body, while leaving one or more ends of the precast construction panel core body free of concrete to provide insulation extending to an edge of the precast construction panel. According to some embodiments, a precast construction panel includes the precast construction panel core body as previously described and one or more layers of concrete surrounding the parallel plane grid mats of the precast construction panel core body, while leaving two or more ends of the precast construction panel core body free of concrete to provide insulation extending to two or more edges of the precast construction panel. According to some embodiments, the layer of concrete includes concrete between the parallel plane grid mats and the slab of insulation and concrete beyond the parallel plane grid mats.

According to some embodiments, a method of using the precast construction panel core body as previously described to form a precast construction panel includes steps of building a form defining the precast construction panel, including outer edges thereof and any openings therein and assembling the plurality of core body segments and the plurality of plane splice mats into the precast construction core body. The method also includes steps of pouring a layer of concrete into the form that has a thickness that is greater than a distance between one of the parallel plane grid mats and the slab of heat-insulating material, laying the precast construction core body into the concrete in the form before the concrete sets, and pressing the precast construction core body into the concrete in the form before the concrete sets until the slab of heat-insulating material rests on the concrete in the form, whereby a lower of the parallel plane grid mats is surrounded by concrete. The method further includes steps of pouring additional concrete over the precast construction core body in the form, whereby concrete surrounds one or more edges of the precast construction core body and completely covers an upper of the parallel plane grid mats a desired thickness, finishing an upper surface of the concrete in the form, and allowing the concrete to cure.

According to some embodiments, the step of pouring additional concrete over the precast construction core body in the form is performed before the concrete in the form on which the slab of heat-insulating material rests cures. According to some other embodiments, the step of pouring additional concrete over the precast construction core body in the form is performed after the concrete in the form on which the slab of heat-insulating material rests cures or partially cures.

According to some embodiments, the method further includes, after the concrete has cured, attaching a lifting device or machine to a lifting attachment point embedded in the precast construction panel to lift the precast construction panel into a vertical position. According to some embodiments, the layer of concrete in the form into which the precast construction panel core body is inserted has a thickness of at least approximately twice the distance between one of the parallel plane grid mats and the slab of heat-insulating material, and wherein the concrete that completely covers the upper of the parallel plane grid mats has a thickness at least approximately twice the distance between one of the parallel plane grid mats and the slab of heat-insulating material.

According to additional embodiments of the invention, a precast construction panel is provided. The precast construction panel includes a core body. The core body includes a plurality of core body segments, each core body segment including a welded grid body. The welded grid body includes two parallel plane grid mats of longitudinal and transverse wires crossing one another and welded together at the points of cross, the plane grid mats spaced apart from each other by a gap, and straight spacer wires cut to length and welded at each end to one wire of a respective one of the grid mats. The core body segment also includes a slab of heat-insulating material disposed within the gap between the parallel plane grid mats, with a space between the slab of heat-insulating material and each of the two parallel plane grid mats, and two end cap grid mats each including a first plane grid mat of longitudinal and transverse wires, the first plane grid mat being formed into a U shape and affixed to the two parallel plane grid mats so as to encompass one of two opposite transverse ends of the slab of heat-insulating material within grid mat wires. The core body also includes a plurality of plane splice mats of longitudinal and transverse wires crossing one another and welded together at the points of cross, the plane splice mats being adapted to be affixed bridging the plane grid mats of adjacent core body segments to link the adjacent core body segments into a unitary construct. In some embodiments, each of two of the plurality of core body segments includes a side cap grid mat having a second plane grid mat of longitudinal and transverse wires, the second plane grid mat being formed into a U shape and affixed to the two parallel plane grid mats so as to encompass one longitudinal end of the slab of heat-insulating material within grid mat wires. The precast construction panel also includes a cured concrete shell surrounding the core body and encompassing the parallel plane grid mats of all of the core body segments.

According to some embodiments, a precast construction panel includes the precast construction panel core body as previously described and one or more layers of concrete surrounding the parallel plane grid mats of the precast construction panel core body, while leaving one or more ends of the precast construction panel core body free of concrete to provide insulation extending to an edge of the precast construction panel. According to some embodiments, a precast construction panel includes the precast construction panel core body as previously described and one or more layers of concrete surrounding the parallel plane grid mats of the precast construction panel core body, while leaving two or more ends of the precast construction panel core body free of concrete to provide insulation extending to two or more edges of the precast construction panel.

According to some embodiments, the cured concrete shell has a thickness of at least approximately twice a distance between one of the parallel plane grid mats and the slab of heat-insulating material. According to some embodiments, the straight spacer wires extend between the parallel plane grid mats at an oblique angle. According to some embodiments, the precast construction panel further includes a plurality of rebar segments inserted between the parallel plane grid mats proximate to and affixed to one or the other of the parallel plane grid mats.

According to some embodiments, one or more of the core body segments includes an embedded item to facilitate a structural connection to the precast construction panel either during construction or in service. According to some embodiments, the embedded item is located at a location on the core body segment where a portion of one of the plane grid mats is absent and a void is present in a portion of the slab of heat-insulating material underlying the absent portion of the plane grid mat to form a concrete-receiving cavity. The embedded item is secured to one or more segments of rebar extending between and secured to the plane grid mat on opposite sides of the absent portion of the plane grid mat. According to some embodiments, the embedded item is an item such as a pick point, an insert for lifting and setting the precast construction panel, an insert adapted for connection of temporary bracing to temporarily secure the precast construction panel in place until roof and floor connections are made, a beam pocket, a support angle, or a plate for attachment of a structural component.

According to further embodiments of the invention, a precast construction panel kit is provided. The precast construction panel kit is adapted to be assembled into a precast construction panel core body that is adapted to be set in concrete in a precast construction panel form and have concrete poured over the core body thereafter to form a precast construction panel. The kit includes a plurality of core body segments, each core body segment including a welded grid body. The welded grid body includes two parallel plane grid mats of longitudinal and transverse wires crossing one another and welded together at the points of cross, the plane grid mats spaced apart from each other by a gap, and straight spacer wires cut to length and welded at each end to one wire of a respective one of the grid mats. The core body segment also includes a slab of heat-insulating material disposed within the gap between the parallel plane grid mats, with a space between the slab of heat-insulating material and each of the two parallel plane grid mats, and two end cap grid mats each including a first plane grid mat of longitudinal and transverse wires, the first plane grid mat being formed into a U shape and affixed to the two parallel plane grid mats so as to encompass one of two opposite transverse ends of the slab of heat-insulating material within grid mat wires. The precast construction panel kit also includes a plurality of plane splice mats of longitudinal and transverse wires crossing one another and welded together at the points of cross, the plane splice mats being adapted to be affixed bridging the plane grid mats of adjacent core body segments to link the adjacent core body segments into a unitary construct. In some embodiments each of two of the plurality of core body segments includes a side cap grid mat including a second plane grid mat of longitudinal and transverse wires, the second plane grid mat being formed into a U shape and affixed to the two parallel plane grid mats so as to encompass one longitudinal end of the slab of heat-insulating material within grid mat wires.

According to some embodiments, a precast construction panel kit is adapted to have one or more layers of concrete surrounding the parallel plane grid mats of the precast construction panel core body, while leaving one or more ends of the precast construction panel core body free of concrete to provide insulation extending to an edge of the precast construction panel. According to some embodiments, a precast construction panel kit is adapted to have one or more layers of concrete surrounding the parallel plane grid mats of the precast construction panel core body, while leaving two or more ends of the precast construction panel core body free of concrete to provide insulation extending to two or more edges of the precast construction panel.

According to further embodiments of the invention, a method of using a precast construction panel kit to form a precast construction panel core body adapted to be set in concrete in a precast construction panel form and have concrete poured over the core body thereafter to form a precast construction panel is provided. The method includes steps of obtaining a precast construction panel kit, the kit including a plurality of core body segments, each core body segment including a welded grid body. The welded grid body includes two parallel plane grid mats of longitudinal and transverse wires crossing one another and welded together at the points of cross, the plane grid mats spaced apart from each other by a gap, and straight spacer wires cut to length and welded at each end to one wire of a respective one of the grid mats. The core body segments also each include a slab of heat-insulating material disposed within the gap between the parallel plane grid mats, with a space between the slab of heat-insulating material and each of the two parallel plane grid mats, and two end cap grid mats each including a first plane grid mat of longitudinal and transverse wires, the first plane grid mat being formed into a U shape and affixed to the two parallel plane grid mats so as to encompass one of two opposite transverse ends of the slab of heat-insulating material within grid mat wires. The kit also includes a plurality of plane splice mats of longitudinal and transverse wires crossing one another and welded together at the points of cross, the plane splice mats being adapted to be affixed bridging the plane grid mats of adjacent core body segments to link the adjacent core body segments into a unitary construct. Two end core body segments of the plurality of core body segments each includes a side cap grid mat including a second plane grid mat of longitudinal and transverse wires, the second plane grid mat being formed into a U shape and affixed to the two parallel plane grid mats so as to encompass one longitudinal end of the slab of heat-insulating material within grid mat wires.

According to some embodiments, a precast construction panel kit is adapted to have one or more layers of concrete surrounding the parallel plane grid mats of the precast construction panel core body, while leaving one or more ends of the precast construction panel core body free of concrete to provide insulation extending to an edge of the precast construction panel. According to some embodiments, a precast construction panel kit is adapted to have one or more layers of concrete surrounding the parallel plane grid mats of the precast construction panel core body, while leaving two or more ends of the precast construction panel core body free of concrete to provide insulation extending to two or more edges of the precast construction panel.

The method further includes steps of securing one or more of the plane splice mats along substantially an entire first longitudinal edge of a first parallel plane grid mat of a first of the end core body segments with approximately half the one or more plane splice mats extending past the first longitudinal edge, the first longitudinal edge being an edge opposite the side cap grid mat and placing the first end core body segment on an underlying surface with the one or more plane splice mats lying on the underlying surface. The method also includes repeating steps of securing one or more of the plane splice mats along substantially an entire first longitudinal edge of another core body segment with approximately half the one or more plane splice mats extending past the first longitudinal edge and placing the other core body segment with plane splice mats affixed thereto immediately adjacent a previous core body segment on the underlying surface such that the newly placed core body segment rests with a second longitudinal edge over the one or more plane splice mats of the previous core body segment and with the one or more plane splice mats of the other core body segment lying on the underlying surface. The method further includes, when only a second end core body segment remains, placing the second end core body segment immediately adjacent the previous core body segment on the underlying surface such that a longitudinal edge opposite the side cap grid mat of the second end core body segment is immediately adjacent the previous core body segment and securing a plurality of the plurality of plane splice mats along substantially entire joints between adjacent body segments with approximately half of the one or more plane splice mats extending to each side of its respective joint, whereby the core body segments are secured into a unitary construct.

According to some embodiments, the method further includes inverting the unitary construct and securing a second unsecured half of each plane splice mat to its underlying plane grid mat. According to some embodiments, plane splice mats are secured to plane grid mats by clips. According to some embodiments, the method further includes steps of inserting one or more pieces of rebar between the slab of insulating material and one of the parallel plane grid mats and securing the rebar to the parallel plane grid mat. According to some embodiments, rebar is placed and secured on both sides of the slab of insulating material.

According to some embodiments, the method further includes inserting an embedded item into at least one of the core body segments to facilitate a structural connection to the precast construction panel either during construction or in service. According to some embodiments, inserting the embedded item includes steps of removing a segment of a plane grid mat, creating a void in a portion of the slab of heat-insulating material underlying the absent portion of the plane grid mat to form a concrete-receiving cavity, and securing the embedded item to one or more segments of rebar extending between and secured to the plane grid mat on opposite sides of the absent portion of the plane grid mat. According to some embodiments, the embedded item is an item such as a pick point, an insert for lifting and setting the precast construction panel, an insert adapted for connection of temporary bracing to temporarily secure the precast construction panel in place until roof and floor connections are made, a beam pocket, a support angle, or a plate for attachment of a structural component.

According to some embodiments, the method further includes using the unitary construct to build a precast panel, including steps of building a form defining the precast construction panel, including outer edges thereof and any openings therein and pouring a layer of concrete into the form that has a thickness that is greater than a distance between one of the parallel plane grid mats and the slab of heat-insulating material. The method also includes steps of laying the unitary construct into the concrete in the form before the concrete sets and pressing the unitary construct into the concrete in the form before the concrete sets until the slab of heat-insulating material rests on the concrete in the form, whereby a lower of the parallel plane grid mats is surrounded by concrete. The method further includes steps of pouring additional concrete over the unitary construct in the form, whereby concrete surrounds one or more edges of the unitary construct and completely covers an upper of the parallel plane grid mats a desired thickness, finishing an upper surface of the concrete in the form, and allowing the concrete to cure.

According to some embodiments, the step of pouring additional concrete over the precast construction core body in the form is performed before the concrete in the form on which the slab of heat-insulating material rests cures. According to some other embodiments, the step of pouring additional concrete over the precast construction core body in the form is performed after the concrete in the form on which the slab of heat-insulating material rests cures or partially cures.

According to some embodiments, the method further includes, after the concrete has cured, attaching a lifting device or machine to a lifting attachment point embedded in the precast construction panel to lift the precast construction panel into a vertical position. According to some embodiments, the layer of concrete in the form into which the unitary construct is inserted has a thickness of at least approximately twice the distance between one of the parallel plane grid mats and the slab of heat-insulating material, and wherein the concrete that completely covers the upper of the parallel plane grid mats has a thickness at least approximately twice the distance between one of the parallel plane grid mats and the slab of heat-insulating material.

According to certain embodiments of the invention, a precast construction panel core body is adapted to be set in concrete in a precast construction panel form and have concrete poured over the core body thereafter to form a precast construction panel. The precast construction panel core body includes a plurality of core body segments. Each core body segment includes a welded grid body. The welded grid body includes two parallel plane grid mats of longitudinal and transverse wires crossing one another and welded together at the points of cross, the plane grid mats spaced apart from each other by a gap, straight spacer wires cut to length and welded at each end to one wire of a respective one of the grid mats, and a slab of heat-insulating material disposed within the gap between the parallel plane grid mats. The two parallel plane grid mats each have a width that is greater than a width of the slab of heat-insulating material, and the two parallel plane grid mats are positioned relative to the slab of heat-insulating material so as to extend beyond opposite longitudinal edges of the slab of heat-insulating material to form splicing extensions adapted to be affixed bridging the plane grid mats of adjacent core body segments to link the adjacent core body segments into a unitary construct.

Embodiments of the invention utilize core body segments having welded grid bodies and slabs of heat-insulating material within the welded grid bodies that are manufactured in accordance with the teachings of U.S. Pat. No. 4,500,763 to Schmidt et al and U.S. Pat. No. 6,272,805 to Ritter et al., each of which patents is incorporated by reference herein for all it discloses. Further information about the construction of the welded grid bodies and slabs of heat-insulating material are also disclosed in Appendices A-D that were filed with the Priority Application, which are also incorporated herein by reference, noting that such Appendices A-D reference an alternate method of using the welded grid body/insulating slab constructs in constructing structures with shotcrete, whereas shotcrete is not necessarily used in conjunction with embodiments of the present invention.

Embodiments of the invention are further illustrated with respect to Appendices E-G that were filed with the Priority Application, which are incorporated herein by reference for all they disclose. While the teachings of U.S. Pat. Nos. 4,500,763 and 6,272,805 discuss the use of unitary slabs of heat-insulating material disposed between welded grid bodies, embodiments of the invention are not limited to unitary slabs of heat-insulating material. By way of example, and not limitation, a single, unitary, slab of heat-insulating material is replaced in some embodiments with several layers of heat-insulating material, such as when a single slab of heat-insulating material of desired thickness is not available, and multiple thinner slabs of heat-insulating material are used instead. In one type of embodiment, the thinner slabs of heat-insulating material are formed of differing compositions of heat-insulating material so as to achieve desired insulative or other properties (e.g., sound insulating, strength, etc.). In other embodiments, the slab (or layers) of heat-insulating material are discontinuous, such that multiple slabs of heat-insulating material are contained within one core body segment.

It should also be understood that the thickness of the slab or slabs of insulating material may be varied in accordance with certain embodiments of the invention to achieve desired strength and insulating characteristics, as can be the distances between the welded grid bodies and the slab or slabs of insulating material.

It will be understood that the methods disclosed herein are generally applicable to both tilt-up and precast construction panels. A primary difference between tilt-up and precast construction panels is generally the location at which the concrete of the panels is placed and cured. In tilt-up construction, the concrete of the panels is poured and cured in forms onsite where they are to be used. In contrast, in precast construction, the concrete of the panels is poured and cured in forms offsite (typically at a factory dedicated to precast construction), and then the panels are removed from the forms and shipped to the construction site (e.g. by boat, train, and/or truck). The systems and methods discussed herein greatly reduce the weight of the panels, thereby greatly increasing the feasibility and reducing the cost of creating precast panels offsite and shipping them to the construction site. In some instances, it is easier to control the environmental conditions at which the panels are cured at a dedicated facility, which is one potential advantage of using precast construction in accordance with embodiments of the invention discussed herein.

Regardless of whether a panel is a tilt-up construction panel or a precast construction panel, FIG. 1 illustrates a cutaway view of a finished panel 10, illustrating the general construction of the panel 10. The panel 10 is formed of a core body 12 that is encased in one or more layers 14 of concrete. The core body 12 includes a welded grid body 16. The welded grid body 16 includes a first plane grid mat 18 and a second plane grid mat 20 that are parallel to each other and that are each formed of longitudinal and transverse wires crossing one another and welded together at the points of cross. The first plane grid mat 18 and the second plane grid mat 20 are spaced apart from each other by a gap, and straight spacer wires 22 are cut to length and welded at each end to one wire of a respective one of the plane grid mats 18, 20. In some embodiments, as illustrated in FIG. 1, the straight spacer wires 22 are present extending in alternate directions at an oblique angle between the first plane grid mat 18 and the second plane grid mat 20, thereby increasing a resistance of the core body 12 to shear forces between the first plane grid mat 18 and the second plane grid mat 20. The exact number, angle, and spacing of the straight spacer wires 22 may be varied to achieve desired strength characteristics for the core body 12. A slab 24 of heat-insulating material (e.g., expanded polystyrene (EPS) foam) is disposed within the gap between the first plane grid mat 18 and the second plane grid mat 20 such that the gap is only partially filled by the slab 24 and such that there is a gap between the first plane grid mat 18 and the slab 24 and there is a gap between the second plane grid mat 20 and the slab 24.

The layer 14 or layers 14 of concrete of the panel completely fill the gap between the first plane grid mat 18 and the slab 24 of heat-insulating material. Additionally, the layer 14 or layers 14 of concrete extend continuously away from the slab 24 of heat-insulating material beyond the first plane grid mat 18 such that the first plane grid mat 18 is entirely contained within the layer 14 or layers 14 of concrete. Similarly, the layer 14 or layers 14 of concrete of the panel completely fill the gap between the second plane grid mat 20 and the slab 24 of heat-insulating material. Additionally, the layer 14 or layers 14 of concrete extend continuously away from the slab 24 of heat-insulating material beyond the second plane grid mat 20 such that the second plane grid mat 20 is entirely contained within the layer 14 or layers 14 of concrete. In some embodiments, the layer 14 or layers 14 of concrete also extend around one or more edges of the panel 10 (not shown in FIG. 1) so the core body 12 is partially to entirely encompassed in the layer 14 or layers 14 of concrete.

In some embodiments (not shown in FIG. 1), bars of additional mild reinforcing steel or high-yield reinforcing steel (e.g., rebar) are incorporated with the panel 10 and are tied to one or both of the first plane grid mat 18 and the second plane grid mat 20 so as to be encompassed by the layer 14 or layers 14 of concrete in the finished panel. In some embodiments, some or all of the reinforcing steel is disposed between the first plane grid mat 18 and the slab 24 of heat-insulating material and between the second plane grid mat 20 and the slab 24 of heat-insulating material. In some embodiments, some or all of the reinforcing steel is disposed and tied to the first plane grid mat 18 and the second plane grid mat 20 on sides thereof away from the slab 24 of heat-insulating material. Generally, the total amount of reinforcing steel is significantly reduced over traditional construction methods (in some embodiments reduced by as much as 90%) while still maintaining similar strength characteristics to panels constructed using traditional steel-and-concrete construction methods. The exact placement, number, and size of reinforcing steel elements may be determined using ordinary engineering analyses.

As discussed in U.S. Pat. Nos. 4,500,763 and 6,272,805, the core body 12 of certain embodiments is formed by first creating a welded wire fabric that will be used to serve as the first plane grid mat 18 and the second plane grid mat 20. This may be done using special-purpose machinery that receives multiple rolls of wire feedstock of a desired gauge or diameter and positions and welds longitudinal wires to transverse wires at a desired spacing. By way of example, in certain embodiments, the wire feedstock is 11-gauge (2.305 mm or 0.0907 inch diameter) that is welded together with a center-to-center spacing of approximately two inches (approximately 5.08 cm). As may be appreciated, the wire gauge and spacing may be varied as desired to obtain a different strength characteristic. The welded wire fabric so formed may be of any desired width (e.g., four feet (122 cm), six feet (183 cm), etc.) up to the maximum width of the forming machine, and may have a length of many feet (many meters) (as, for example, the welded wire fabric may be disposed on a roll).

The next stage of formation of the core body 12 occurs using a specialized machine. Two rolls of welded wire fabric are fed into the machine, which straightens the two sheets of welded wire fabric coming from the rolls and positions the sheets in a parallel fashion spaced apart by the gap. The slab 24 of heat-insulating material (whether a unitary slab or formed of multiple sheets of material either or both of end-to-end or side-by-side, depending on the thickness and availability of heat-insulating material) is also inserted into the machine such that the sheets of welded wire fabric and the slab 24 advance together. The machine receives multiple rolls of wire feedstock that it inserts at angles through (a) a space between wires of one of the sheets of welded wire fabric, (b) the slab 24, and (c) a space between wires of the other of the sheets of welded wire fabric to form the straight spacer wires 22, which are cut and welded at each end to the sheets of welded wire fabric, thereby securing the slab 24, the first plane grid mat 18, and the second plane grid mat 20 at their respective positions. By way of example, in certain embodiments, the straight spacer wires 22 are formed from 9-gauge (2.906 mm or 0.1144 inches) wire feedstock. In some embodiments, the straight spacer wires 22 are welded to every other longitudinal wire of the first plane grid mat 18 and the second plane grid mat 20. In some embodiments, the straight spacer wires 22 welded to every other longitudinal wire are spaced on center approximately every other transverse wire of the first plane grid mat 18 and the second plane grid mat 20 (but alternating in angle as shown in FIG. 1). The spacing, angle, and placement of the straight spacer wires 22 as discussed herein and shown in FIG. 1 are illustrative only and are not intended to be limiting.

Figure 2:
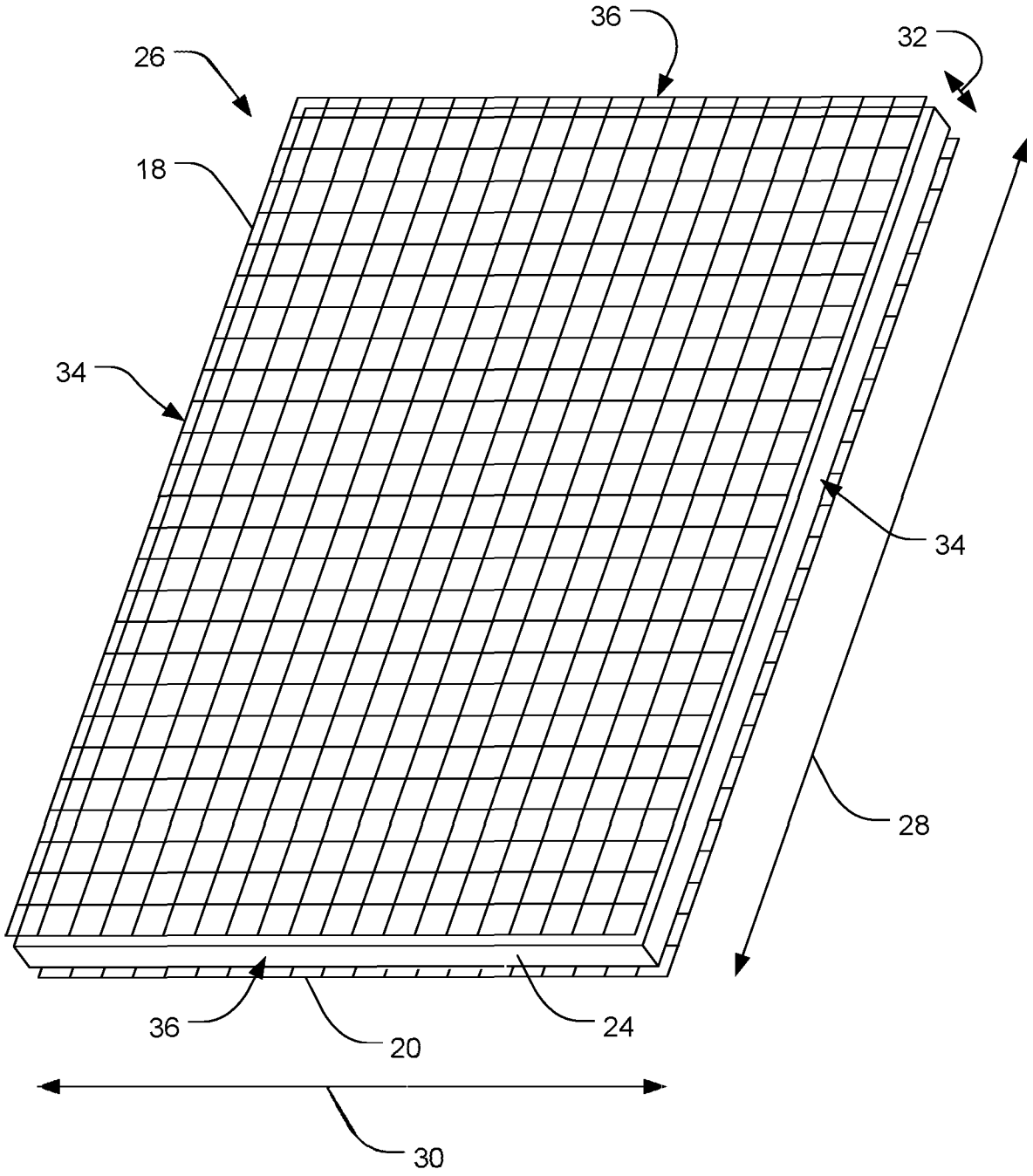
FIG. 2 shows a perspective view of an embodiment of a core wall segment in accordance with embodiments of the invention.

The resulting assembly continues through the machine until a desired length has been achieved, at which a cutter trims the wires of the two sheets of welded wire fabric (and potentially the slab 24), thereby separating a core body segment 26 from the rolls of welded wire fabric, as illustrated in FIG. 2. It should be noted that the embodiments and features illustrated in all the Figures are not necessarily illustrated to scale and that the specific scales shown in the Figures are not intended to be limiting of the scope of the embodiments of the invention. In this embodiment of FIG. 2, the first plane grid mat 18, the second plane grid mat 20, and the slab 24 of heat-insulating material all have a width and length similar to each other and that are generally aligned to have similar edges. In other embodiments (see, e.g., FIGS. 8-11), one or more of the first plane grid mat 18 or the second plane grid mat 20 may be dimensioned so as to be larger than the slab 24 of heat-insulating material such that a portion of the first plane grid mat 18 or the second plane grid mat 20 may serve as a splicing extension for splicing the core body segment 26 to an adjacent core body segment 26.

The core body segment 26 has a length 28, a width 30, and a thickness 32. As may be appreciated, each of the length 28, the width 30, and the thickness 32 may be varied from embodiment to embodiment of the core body segment 26. The longitudinal wires of the first plane grid mat 18 and the second plane grid mat 20 extend along and vary in length with the length 28 of the core body segment 26, and the transverse wires of the first plane grid mat 18 and the second plane grid mat 20 extend along and vary in length with the width 30 of the core body segment 26. The straight spacer wires 22 extend across the thickness 32 of the core body segment 26 in this embodiment at an oblique angle that is generally parallel to the longitudinal wires, and vary in length with the thickness 32 of the core body segment 26.

As may be appreciated, the width 30 of the core body segment 26 may vary from embodiment to embodiment as desired, depending on the capability of machinery to provide and handle varying widths of welded wire fabric. Nevertheless, as will be discussed in more detail, the width 30 of the core body segment 26 does not limit the width of the tilt-up panel, as multiple core body segments 26 may be provided and joined together to form a completed core body 12. The length 28 of the core body segment 26 may also vary as desired from embodiment to embodiment. In some embodiments of the core body segment 26, the length 28 may be smaller than the width 30. As one example of such, the length 28 of the core body segment 26 may be smaller than the width 30 for a core body segment 26 to be used above or below an opening (e.g. a door or window) in the finished panel 10. The length 28 of the longest core body segment 26 used in the core body 12 generally determines the final height of the finished panel 10, and while there may be practical limits to the final height of the finished panel 10, there are essentially no limits to the length 28 of the core body segment 26 other than practicality when handling. If the length 28 of the core body segment 26 is to be longer than a maximum available length of the slab 24 of heat-insulating material, multiple slabs 24 of heat-insulating material are simply fed in serial fashion, one contacting the next, into the machinery that forms the core body segments 26.

The orientation of the longitudinal wires and the transverse wires as described herein may also be used to define edges of the core body segment 26. In the embodiment illustrated in FIG. 2, the core body segment 26 has a pair of longitudinal edges 34 and a pair of transverse edges 36. In this embodiment, the longitudinal edges 34 are longer than the transverse edges 36. In other embodiments, the longitudinal edges 34 are equal in length to or are shorter than the transverse edges 36. In other embodiments, the longitudinal edges 34 are substantially longer than the transverse edges 36. In all these embodiments, the longitudinal edges 34 are defined as longitudinal edges 34 by their running generally parallel to the longitudinal wires of the first plane grid mat 18 and the second plane grid mat 20 (as they originally lay in the welded wire fabric from the making thereof), and the transverse edges 34 are defined as transverse edges 34 by their running generally parallel to the transverse wires of the first plane grid mat 18 and the second plane grid mat 20 (as they originally lay in the welded wire fabric from the making thereof).

Figure 3:
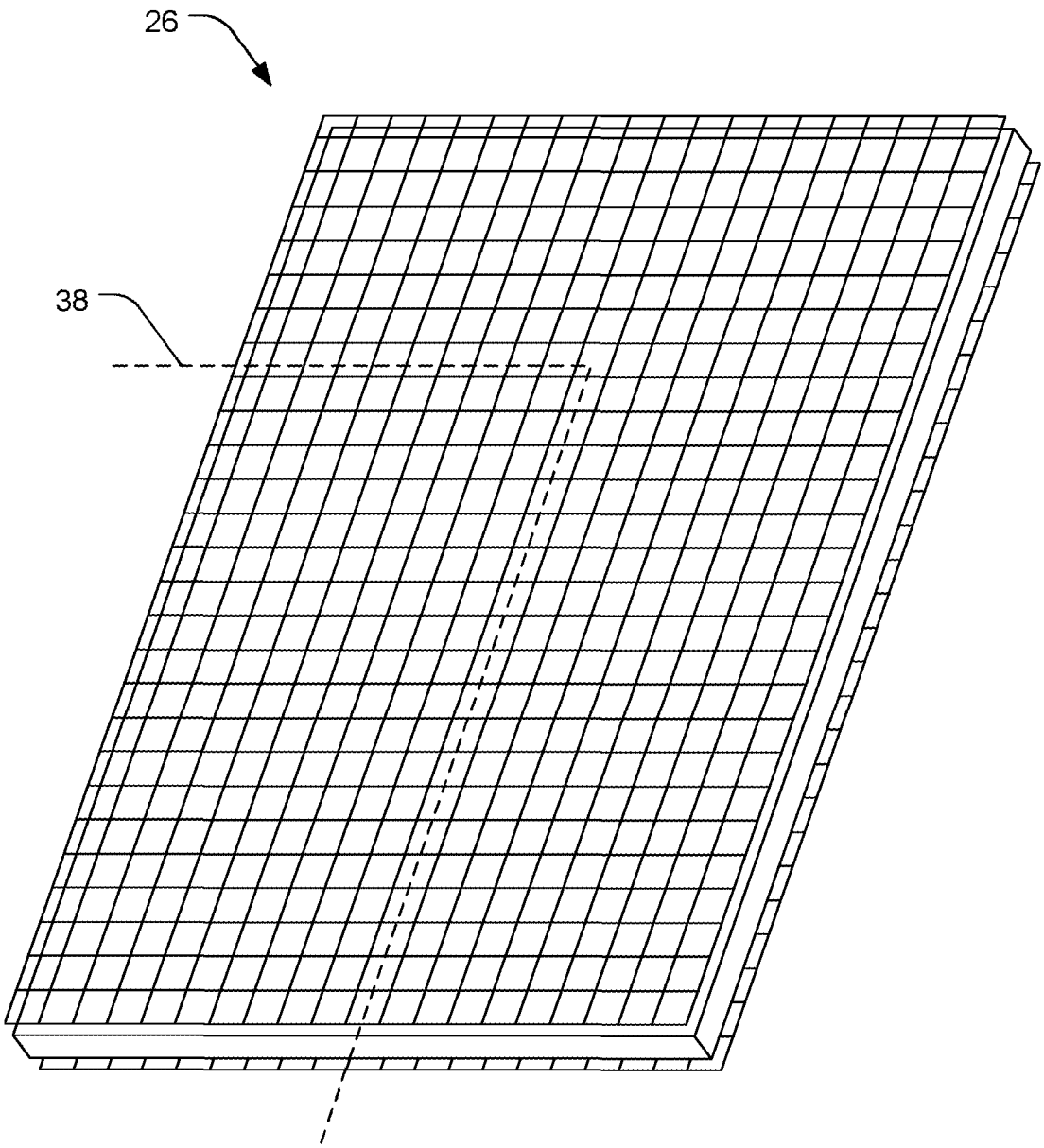
FIG. 3 shows a perspective view of an embodiment of a core wall segment in accordance with embodiments of the invention, illustrating one manner in which the core wall segment may be cut to achieve a desired shape.
Figure 4:
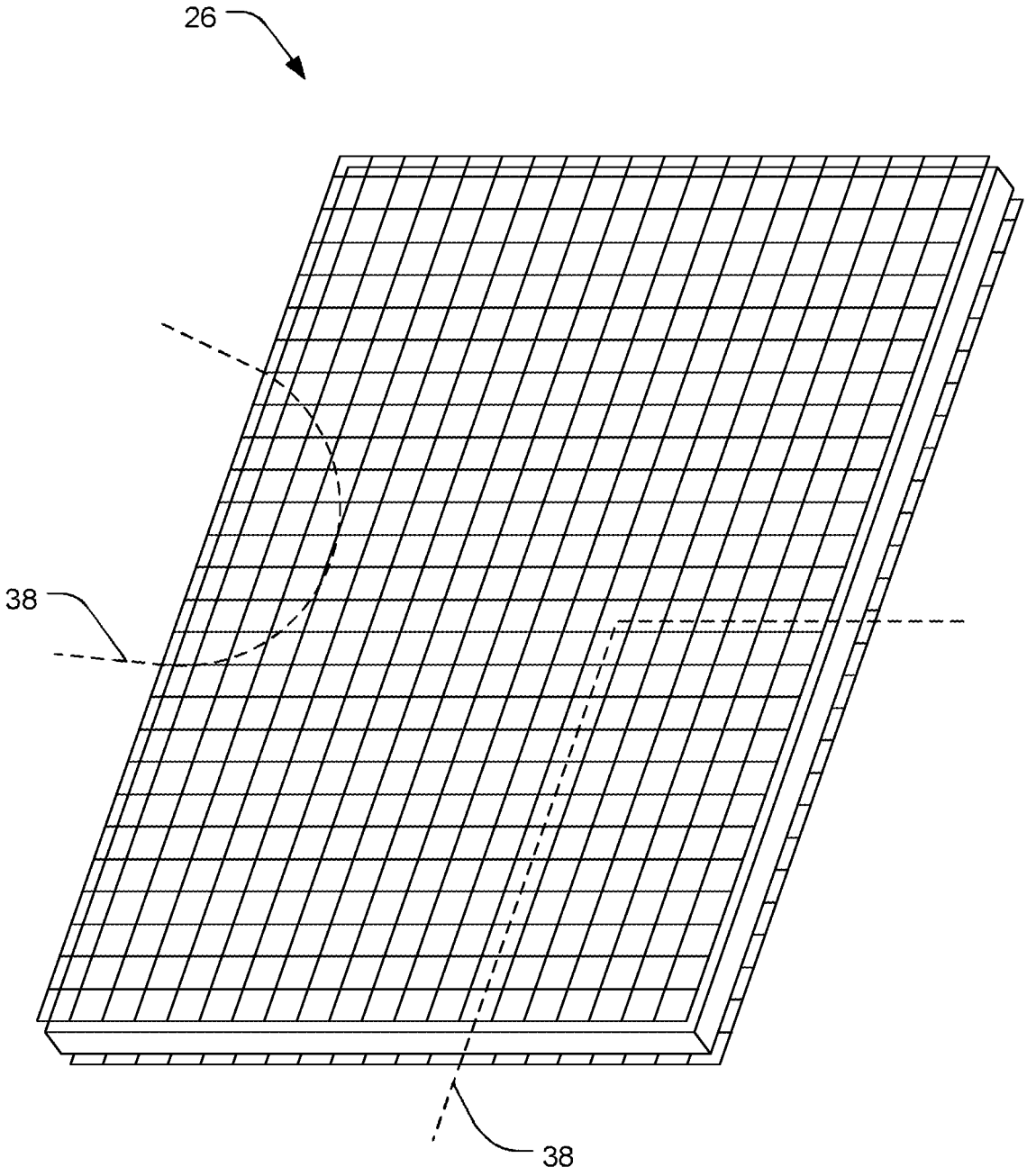
FIG. 4 shows a perspective view of an embodiment of a core wall segment in accordance with embodiments of the invention, illustrating another manner in which the core wall segment may be cut to achieve a desired shape.
Figure 5:
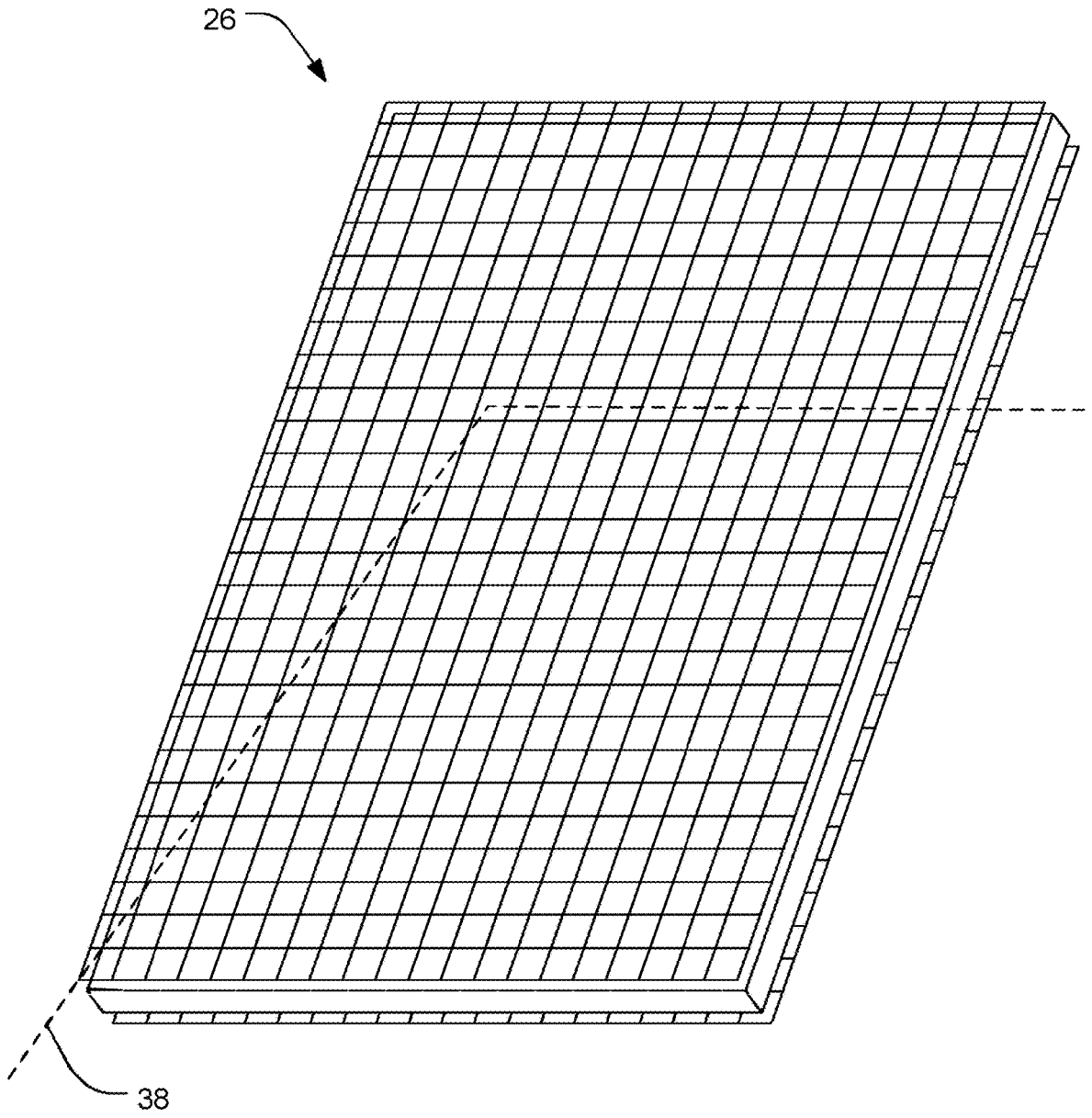
FIG. 5 shows a perspective view of an embodiment of a core wall segment in accordance with embodiments of the invention, illustrating another manner in which the core wall segment may be cut to achieve a desired shape.

While the embodiment of the core body segment 26 shown in FIG. 2 and in the remaining Figures is generally rectangular in shape and has four generally right angles making four corners thereof, embodiments of the invention are not limited to core body segments 26 only of rectangular shape. While core body segments 26 are straightforward to manufacture in rectangular shapes, after reaching the point of manufacture shown in FIG. 2, the core body segment 26 may be shaped into any desirable shape for the finished panel 10 by simply cutting appropriate longitudinal and transverse wires of both the first plane grid mat 18 and the second plane grid mat 20 and an appropriate portion of the slab 24 of heat-insulating material away from the core body segment. FIGS. 3-5 illustrate, for example, various cuts 38 that could be made to a rectangular core body segment to account for a desired final shape of the finished panel 10.

FIG. 3 illustrates a rectangular version of cut 38 that may account for an opening such as a door or window. FIG. 4 illustrates a curved version of cut 38 that may account for a curved window or other architectural feature, as well as a second rectangular version of cut 38 that may account for another opening. FIG. 5 illustrates another version of cut 38 that has an angled segment and a segment that is parallel to the transverse edge 36. FIGS. 3-5 illustrate that the core body segments 26 may be provided in a variety of shapes and with a variety of openings formed therein. At least a portion of the longitudinal edge 34 remains in each example to allow each core body segment 26 to be joined to adjacent core body segments 26 in building the complete core body 12 for the panel 10. The illustrated cuts 38 and shapes of the core body segments 26 are intended to be illustrative and should not be taken as limiting of the possible shapes of core body segments 26.

The thickness 32 of the core body segment 26 may be varied by varying the gap between the first plane grid mat 18 and the second plane grid mat 20. The gap may be varied to accept differing thicknesses of the slab 24 or slabs 24 of heat-insulating material, such as to achieve different heat-insulating R-values for the finished panel 10. Additionally or alternatively, the gap may be varied to modify the gap between the slab 24 of heat-insulating material and the first plane grid mat 18 or the gap between the slab 24 of heat-insulating material and the second plane grid mat 20.

By way of example, in one embodiment, the core body segment 26 incorporates an approximately four-inch (approximately 10.2 cm) slab 24 of heat-insulating material and the first plane grid mat 18 and the second plane grid mat 20 are each spaced approximately one inch away (approximately 2.5 cm away) from the slab 24 of heat-insulating material. In this embodiment, the total thickness of the core body segment is approximately six inches (approximately 15.2 cm). When the panel 10 is finished with the layer 14 or layers 14 of concrete, this panel will have approximately two inches (approximately 5.1 cm) of concrete on each side of the slab 24 of heat-insulating material, fully encompassing the first plane grid mat 18 and the second plane grid mat 20 in concrete. The finished panel 10 then has a thickness of approximately eight inches (approximately 20.3 cm), and the finished panel 10 has an effective R-value of R38 while weighing approximately at least 48% less than a similarly sized traditional concrete-and-steel panel of the same dimensions. The finished panel 10 retains strength characteristics generally equal to or greater than the similarly-sized traditional concrete-and-steel panel of the same dimensions as well. It should be noted that while the discussion herein focuses on the heat-insulating properties of the finished panel when compared with traditional concrete-and-steel panels, another effect of the construction of the finished panels 10 is a concomitant increase in sound insulation as well. Furthermore, the decreased weight of the finished panel 10 provides benefits of decreased panel cracking, decreased footing size requirements, and decreased crane size requirements for lifting and positioning of the finished panel 10.

As another example, the core body segment 26 incorporates an approximately six-inch (approximately 15.2 cm) slab 24 of heat-insulating material. The spacing of the first plane grid mat 18 and the second plane grid mat 20 from the surface of the slab 24 of heat-insulating material remains the same as in the previous example, and the thickness of the layer 14 or layers 14 of concrete also remains the same. The result is a finished panel 10 having a thickness of approximately ten inches (approximately 25.4 cm) with an increased R-value over the eight-inch panel of the previous example. This increased R-value is achieved with only very minimal additional weight to the finished panel 10 and with essentially the same strength for the finished panel 10. When compared to the weight of a similarly-dimensioned traditional concrete-and-steel panel, the weight savings of the finished panel 10 of this example are even more significant, as approximately two inches (approximately 5.1 cm) thickness of concrete and steel are replaced by two inches of heat-insulating material (e.g., EPS foam) of significantly lesser weight.

Other examples and embodiments of the core body segment 26 increase or decrease the thickness of the slab 24 of heat-insulating material, with corresponding increases or decreases in the overall thickness and R-value of the finished panel 10. Such examples and embodiments are embraced as falling within the spirit and scope of the invention as disclosed herein.

In still other embodiments of the core body segment, the gap or distance between the surfaces of the slab 24 of heat-insulating material and the first plane grid mat 18 and the second plane grid mat 20 is varied. In some embodiments, the gap or distance between the surface of the slab 24 of heat-insulating material and the first plane grid mat 18 and the gap or distance between the surface of the slab 24 of heat-insulating material and the second plane grid mat 20 are different from each other (e.g., approximately one inch (approximately 2.5 cm) on one side of the slab 24 of heat-insulating material and approximately three-fourths inch (approximately 1.9 cm) or approximately one-half inch (approximately 1.3 cm) on the other side). The gap or distance between the surfaces of the slab 24 of heat-insulating material and the first plane grid mat 18 and the second plane grid mat 20, as well as the thickness of the layer 14 or layers 14 of concrete disposed on the finished panel 10 may be varied to achieve desired weight and strength characteristics of the finished panel 10.

In one example, the slab 24 of heat-insulating material is approximately four inches (approximately 10.2 cm) thick and the first plane grid mat 18 and the second plane grid mat 20 are spaced approximately three-fourths inch (approximately 1.9 cm) away from the surfaces of the slab 24 of heat-insulating material. In this example, the layer 14 or layers 14 of concrete are each approximately 1.5 inches (approximately 3.8 cm) thick, so the finished panel 10 has a total thickness of approximately seven inches (approximately 17.8 cm). In another example, the slab 24 of heat-insulating material is approximately four inches (approximately 10.2 cm) thick and the first plane grid mat 18 and the second plane grid mat 20 are spaced approximately 1.5 inches (approximately 3.8 cm) away from the surfaces of the slab 24 of heat-insulating material. In this example, the layer 14 or layers 14 of concrete are each approximately three inches (approximately 7.6 cm) thick, so the finished panel 10 has a total thickness of approximately ten inches (approximately 25.4 cm). In yet another example, the slab 24 of heat-insulating material is approximately four inches (approximately 10.2 cm) thick and the first plane grid mat 18 and the second plane grid mat 20 are spaced approximately 1.5 inches (approximately 3.8 cm) away from the surfaces of the slab 24 of heat-insulating material. In this example, the layer 14 or layers 14 of concrete are each approximately two inches (approximately 5.1 cm) thick, so the finished panel 10 has a total thickness of approximately nine inches (approximately 22.9 cm). Note that in this example, the concrete is thicker between the slab 24 of heat insulating material and the first plane grid mat 18 and the second plane grid mat 20, and is thinner outside the first plane grid mat 18 and the second plane grid mat 20. The reverse is also true in some embodiments.

As may be appreciated, the possible variations of thickness of the slab 24 of heat-insulating material, the gaps between the slab 24 of heat-insulating material and first plane grid mat 18 and the second plane grid mat 20, and the thickness of concrete beyond the first plane grid mat 18 and the second plane grid mat 20 are essentially limitless. Achieving desired mechanical and weight characteristics for the finished panel is a matter of straightforward and proper design, modeling, and testing. The specific illustrated embodiments discussed herein are intended not to limit the scope of the invention claimed in the claims, but to illustrate manners in which embodiments of the invention may be varied to suit varying needs.

Figure 6:
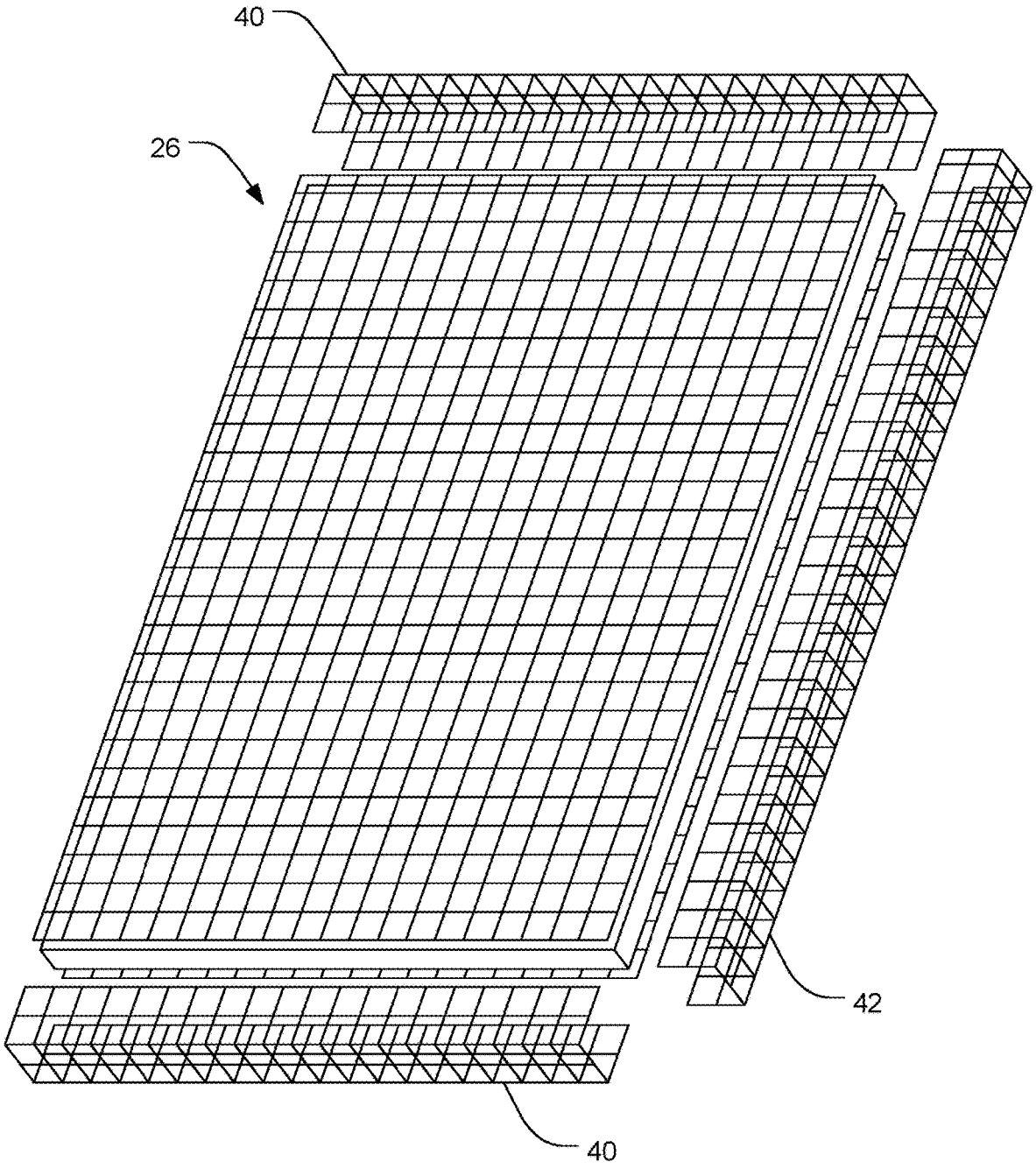
FIG. 6 shows a perspective partially-exploded view of an embodiment of a core wall segment in accordance with embodiments of the invention.
Figure 7:
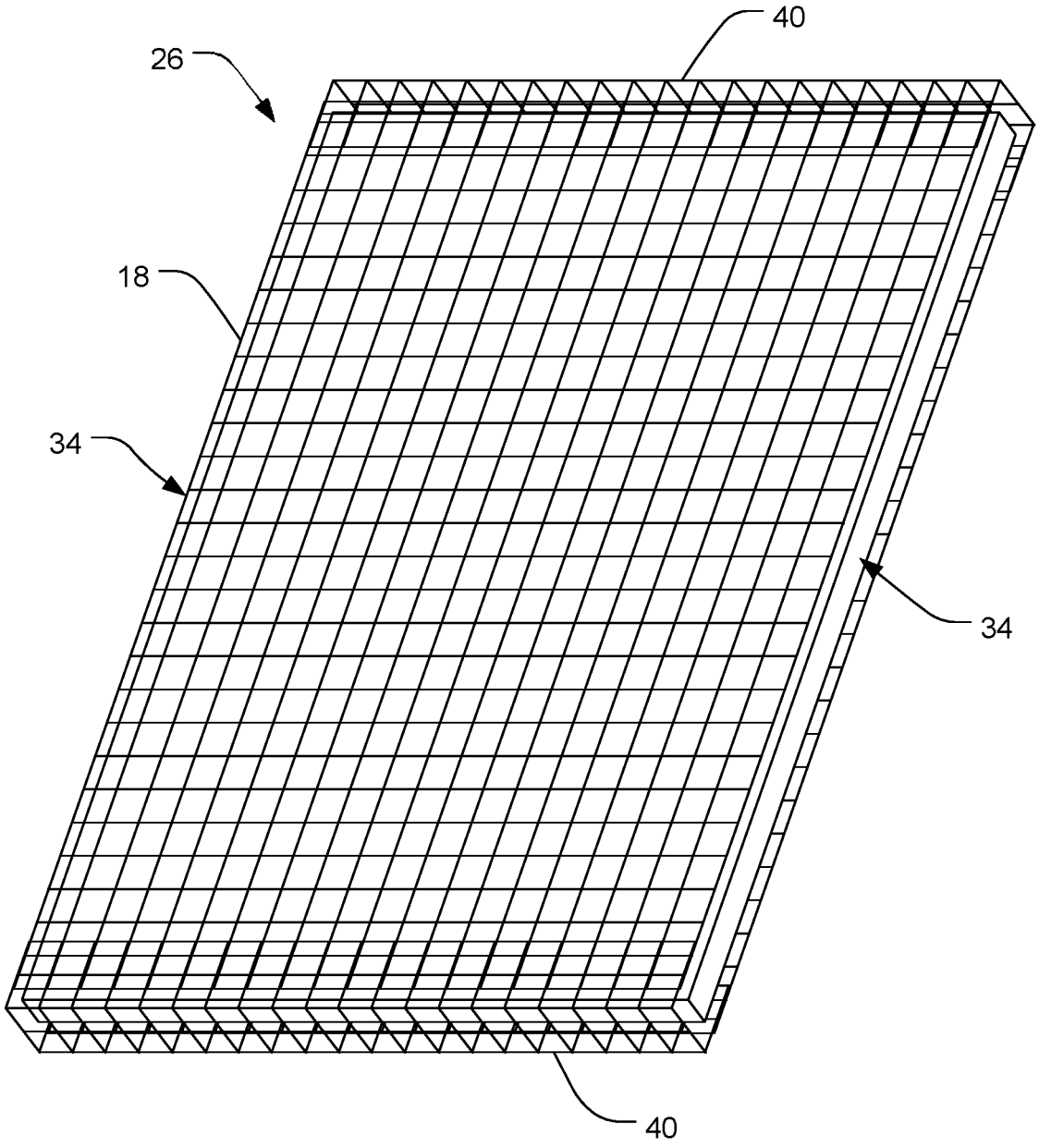
FIG. 7 shows a perspective view of an embodiment of a core wall segment in accordance with embodiments of the invention.
Figure 8:
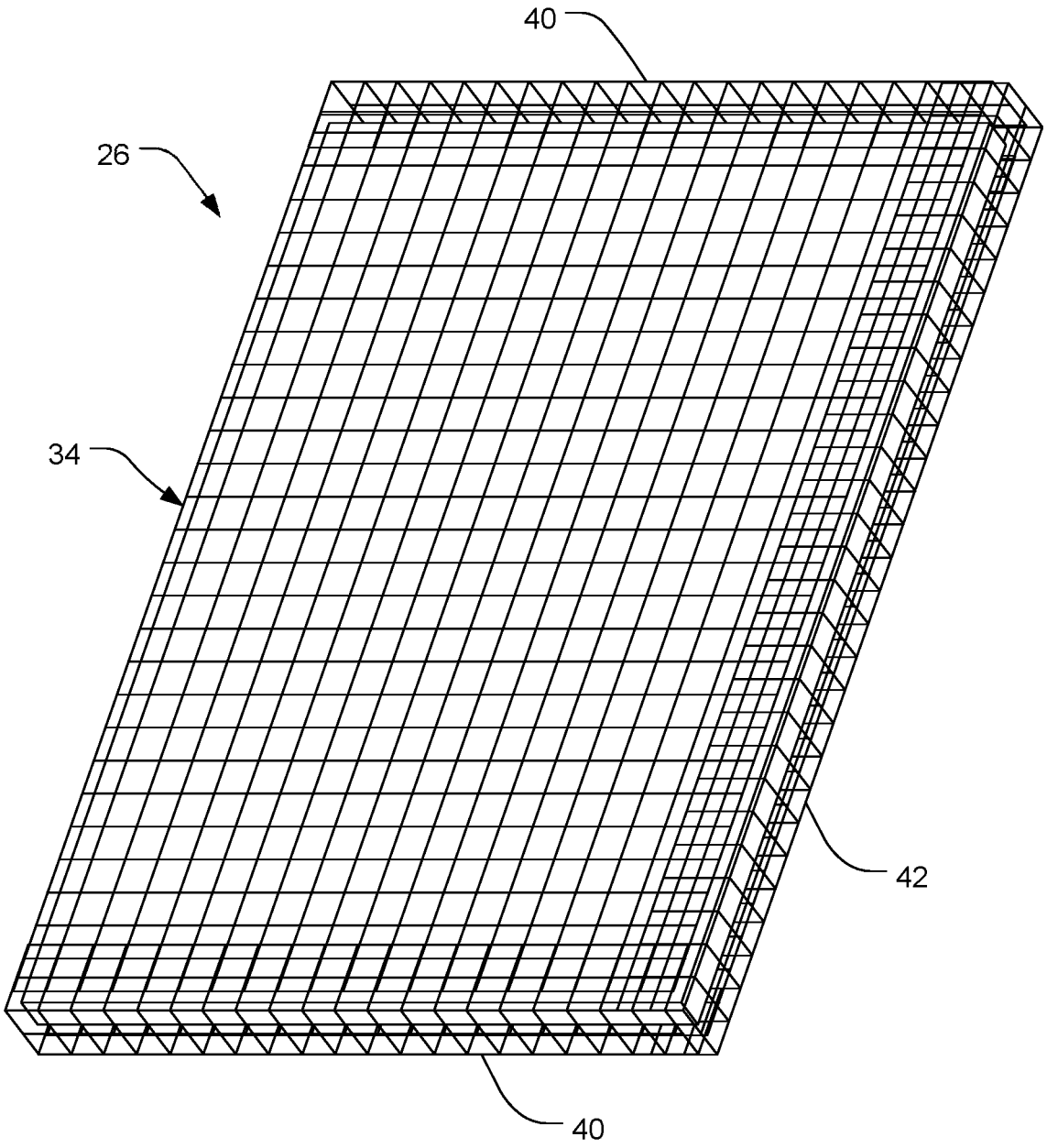
FIG. 8 shows a perspective view of an embodiment of a core wall segment in accordance with embodiments of the invention.

In some embodiments of the invention, the core body segment 26 has one or more end cap grid mats 40 and/or side cap grid mats 42 joined thereto, as illustrated in FIGS. 6-8. FIG. 6 illustrates the formation of the end cap grid mats 40 and the side cap grid mat 42, while FIG. 7 illustrates the core body segment 26 with end cap grid mats 40 joined thereto, and FIG. 8 shows the core body segment 26 with end cap grid mats 40 and one side cap grid mat 42 joined thereto. The end cap grid mats 40 and the side cap grid mats 42 are generally formed of welded wire fabric (e.g., the same welded wire fabric used to form the first plane grid mat 18 and the second plane grid mat 20) that has been cut to size and bent or otherwise formed into a U shape. In the U shape, the bottom of the U is generally sized to be about the same size or slightly larger than the thickness 32 of the core body segment 26. The upstanding legs of the U shape (shown turned on its size in FIG. 6) are sized so as to permit solid affixation of the legs to the first plane grid mat 18 and the second plane grid mat 20 by an appropriate attachment method (e.g., tying, clipping, welding, etc.), and can extend any desired length from the bottom of the U shape.

In some embodiments, a collection or kit of core body segments 26 may be assembled and placed at or transported to a desired site where assembly and formation of the panel 10 is to occur (e.g. at a construction site for a tilt-up panel or at a factory for a precast panel). To ease transportation requirements, the body segments 26 may be transported without being assembled to each other, e.g., as a stack of core body segments 26. The stack of core body segments 26 may be transported in some embodiments in an order of assembly, with a first end core body segment 26 at the bottom of the stack, any number of intermediate core body segments 26 stacked in order on top of the first end core body segment 26, and topped by a second end core body segment 26 at the top of the stack. Assembly of the core body 12 can occur by taking one or more preparation steps (as will be discussed further) with respect to the first core body segment 26, then removing it to a flat surface. Next, one or more preparation steps are taken with respect to a next core body segment 26 that is then removed from the stack, placed next to the first core body segment 26, and attached thereto. The steps are repeated until the entire core body 12 is fully assembled.

To maximize insulation efficiency of the finished panel 10 and the wall it will form a part of, embodiments of the invention seek to maximize coverage of the slabs 24 of heat-insulating material between core body segments 26. Accordingly, core body segments 26 that will be placed adjacent other core body segments are, in some embodiments, provided with end cap grid mats 40, but no side cap grid mats 42, as illustrated in FIG. 7. In this embodiment, the longitudinal edges 34 of the core body segment 26 are not enclosed by the welded wire fabric of any side cap grid mat 42, such that the slabs 24 of heat-insulating material of adjacent core body segments 26 can be placed adjacent each other.

In some embodiments, even one or both of the final core body segments 26 of the core body 12 may be of the type illustrated in FIG. 7. In such an embodiment, the form into which the core body 12 is placed may be sized such that the longitudinal edge 34 or edges 34 at the end or ends of the core body 12 immediately abut or contact the form into which the core body is placed for application of concrete (explained in more detail later), so that little to no concrete is located at the longitudinal edges 34 and so adjacent finished panels 10 can maintain maximum insulation properties between the finished adjacent panels 10. As may be recognized, some finishing step or steps may be used to secure and/or join adjacent panels 10 used in such fashion.

In other embodiments, the end core body segment 26 or end core body segments 26 are provided with the side cap grid mats 42 to provide structure to the concrete that surrounds and finishes the panel 10. Such an embodiment of the core body segment 26 is illustrated in FIG. 8. While the embodiment of FIG. 8 shows only one side cap grid mat 42 with the other longitudinal edge 34 exposed and lacking a side cap grid mat 42, it should be recognized that if all or a portion of the core body segment 26 forms an edge of the finished panel 10, the side cap grid mats 42 may be present on all or portions of both longitudinal edges 34. The end cap grid mats 40 and the side cap grid mats 42 serve to provide structure and support for the layer 14 or layers 14 of concrete to extend around the edges of the panel 10.

In embodiments of the invention, the end cap grid mats 40 and the side cap grid mats 42 are all attached to the first plane grid mat 18 and the second plane grid mat 20 at the factory where the core body segments 26 are made. In such embodiments, the core body segments 26 ship in their stack with the end cap grid mats 40 and the side cap grid mats 42 in place and attached. Optionally, in such embodiments, any desired longitudinal steel reinforcement (e.g., rebar) members may be attached to the core body segments 26 at the factory. In other embodiments of the invention, the core body segments 26 are shipped without end cap grid mats 40 and/or side cap grid mats 42 attached, and the recipients clips or otherwise attached the end cap grid mats 40 and any side cap grid mats 42 to the applicable core body segments 26 when assembling the core body 12.

Figure 12:
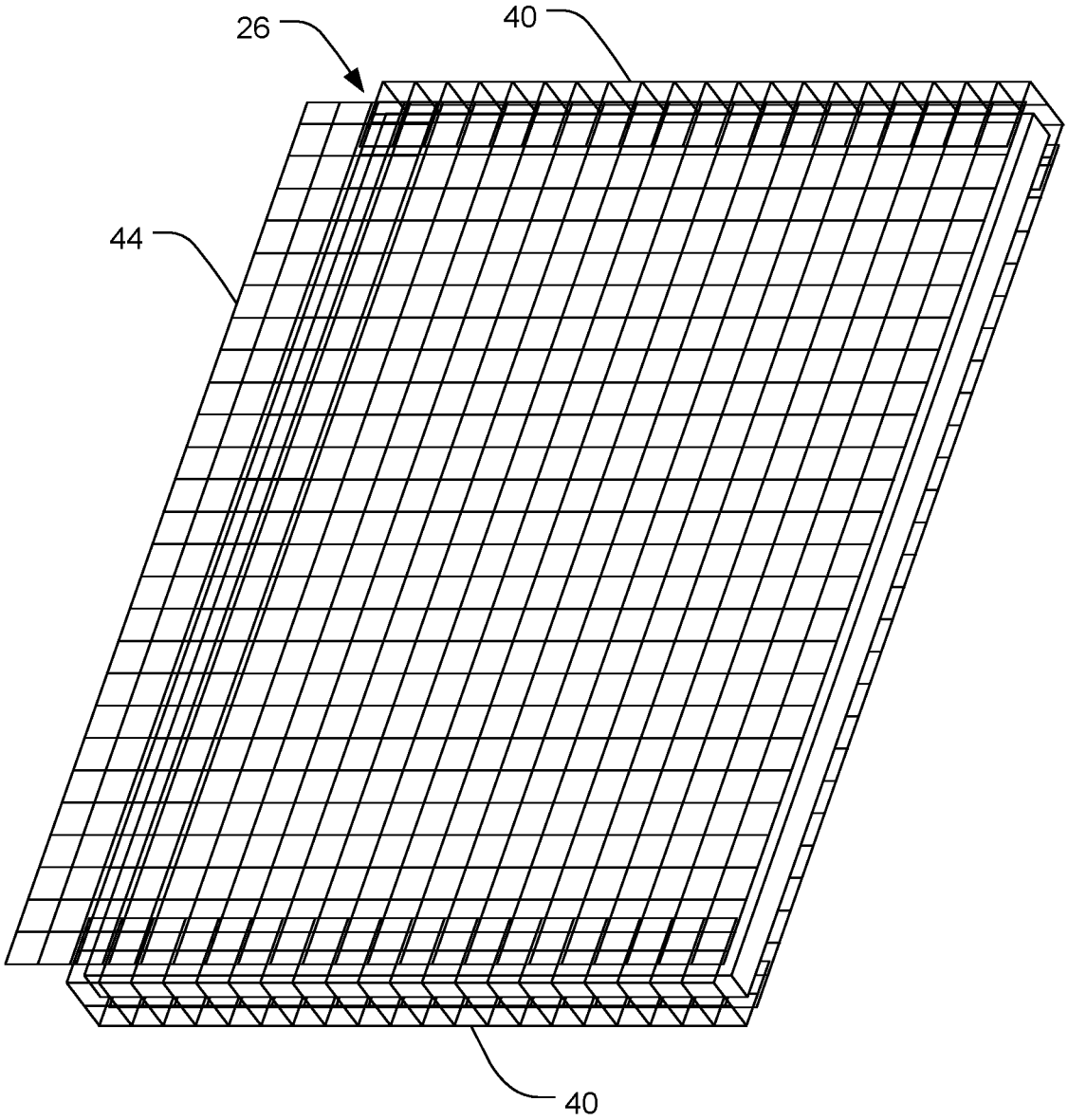
FIG. 12 shows a perspective view of an embodiment of a core wall segment in accordance with embodiments of the invention.
Figure 13:
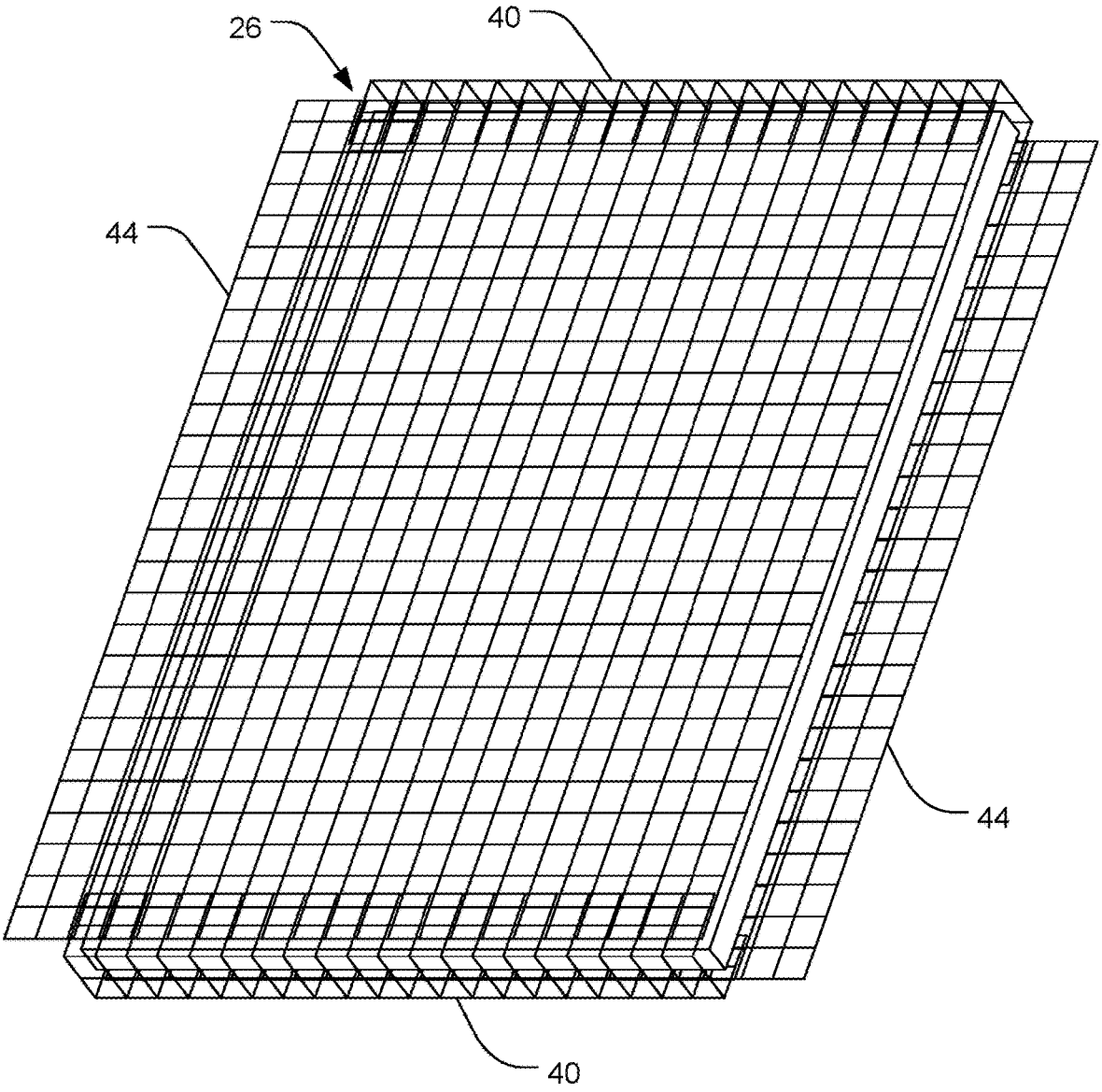
FIG. 13 shows a perspective view of an embodiment of a core wall segment in accordance with embodiments of the invention.
Figure 14:
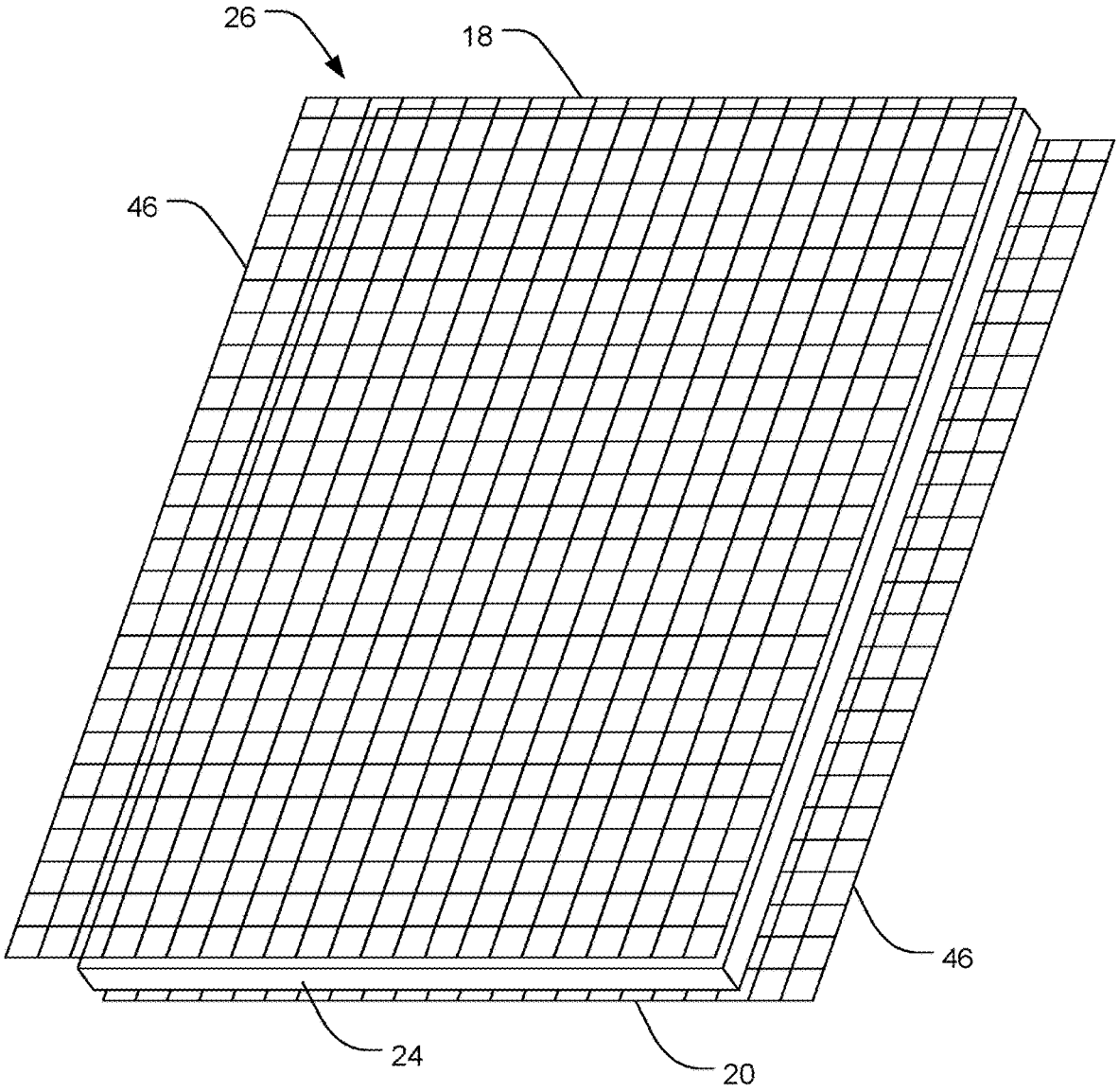
FIG. 14 shows a perspective view of an embodiment of a core wall segment in accordance with embodiments of the invention.
Figure 15:
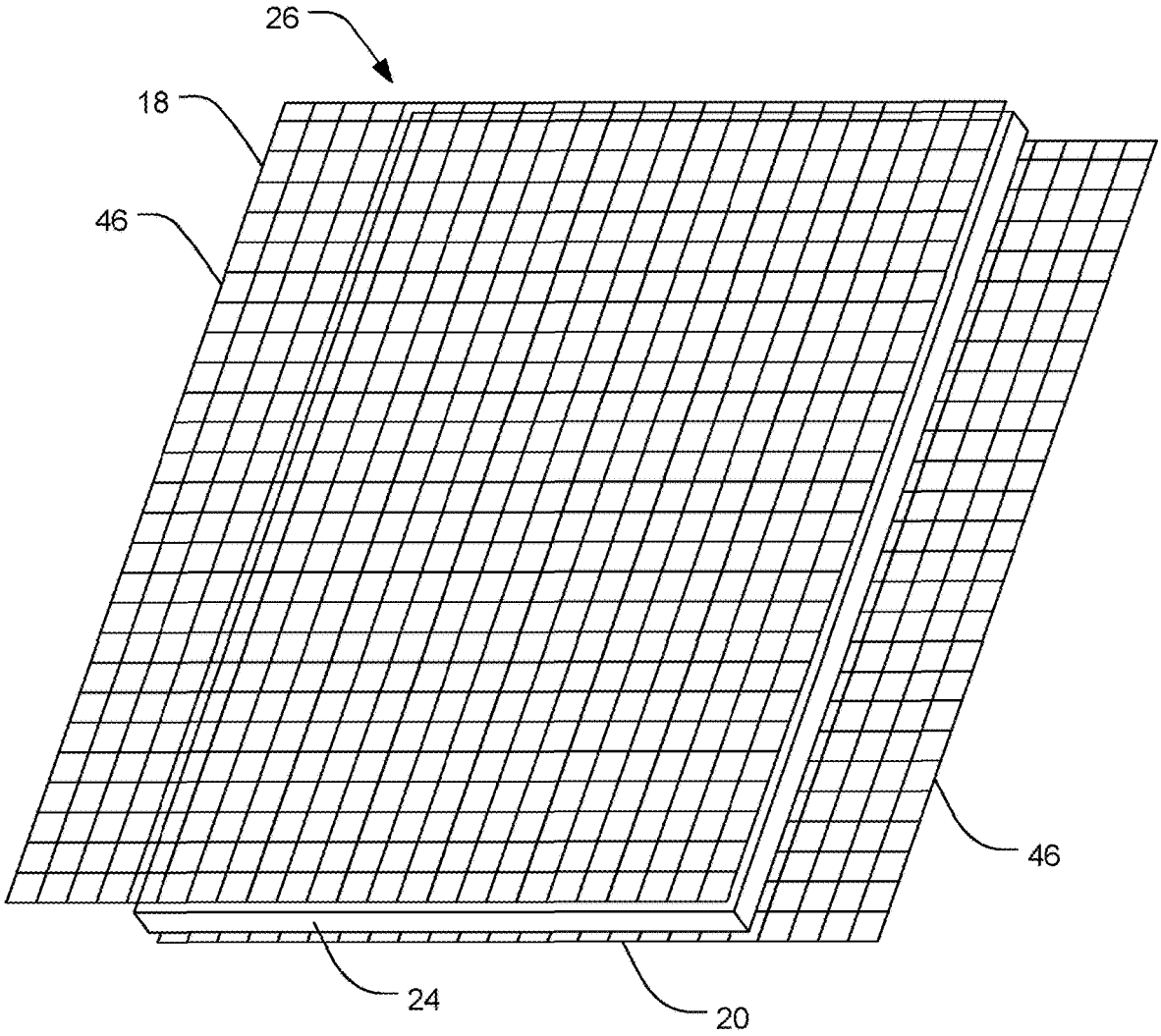
FIG. 15 shows a perspective view of an embodiment of a core wall segment in accordance with embodiments of the invention.

Core body segments 26 are assembled into the core body 12 by affixing adjacent core body segments 26 to each other. In some embodiments, this is achieved through use of plane splice mats 44 as illustrated in FIGS. 9-13. In other embodiments, this is achieved through use of splice extensions 46 of the first plane grid mat 18 and/or the second plane grid mat 20, as illustrated in FIGS. 14-15. In FIGS. 9-13, plane splice mats 44 are illustrated as extending essentially the entire length 28 of the core body segment 26 as a unitary plane splice mat 44. It should be understood, however, that plane splice mats 44 may be provided as multiple segments extending less than the entire length 28 of the core body segment 26. Accordingly, there is no limit on the length or shortness of the plane splice mats 44 unless explicitly stated otherwise.

Figure 9:
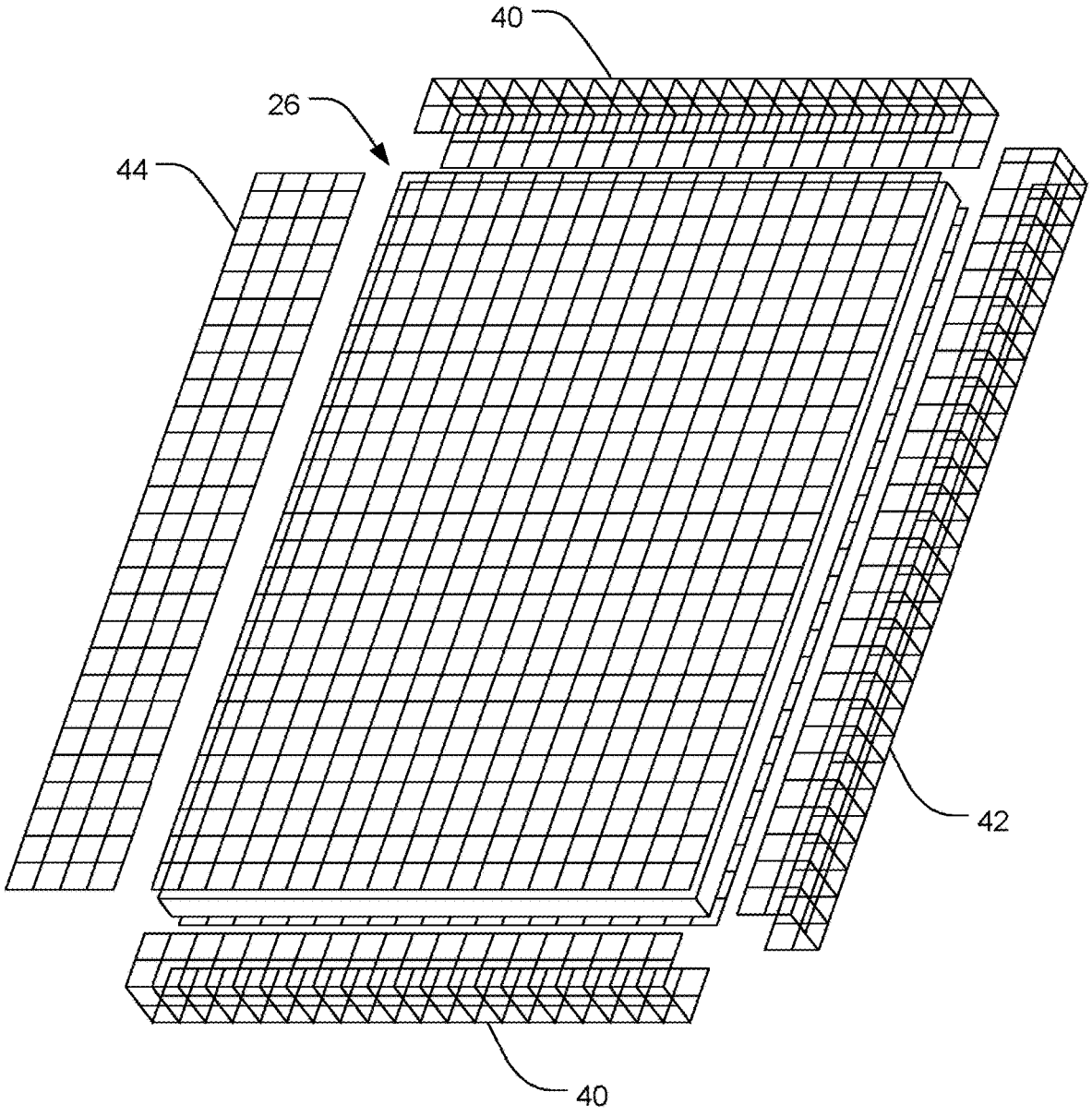
FIG. 9 shows a perspective partially-exploded view of an embodiment of a core wall segment in accordance with embodiments of the invention.
Figure 10:
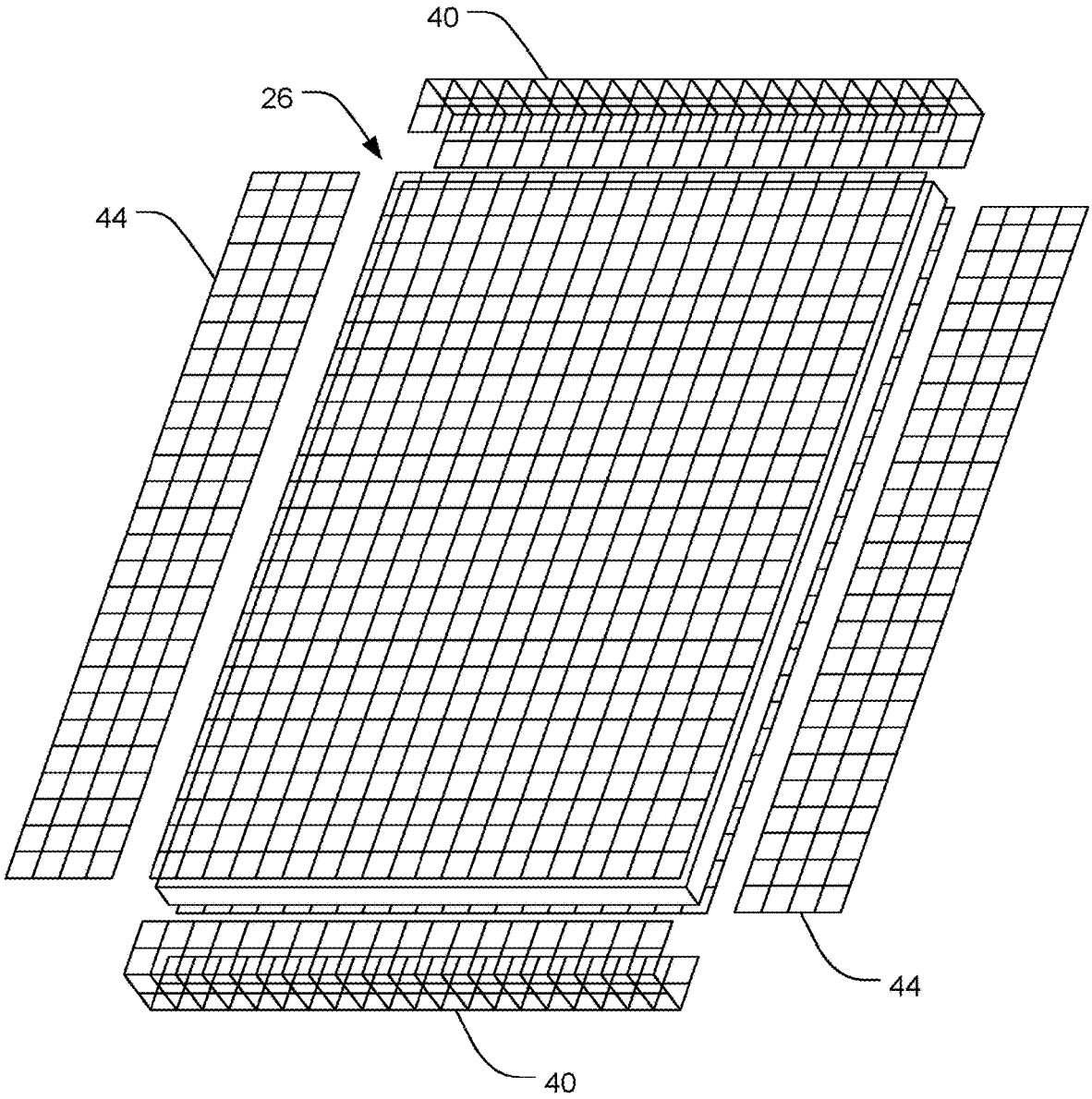
FIG. 10 shows a perspective partially exploded view of an embodiment of a core wall segment in accordance with embodiments of the invention.

As shown in FIG. 9 and FIG. 10, the plane splice mat 44 is effectively a generally planar portion of the welded wire fabric that is adapted to be attached between adjacent core body segments 26 at the respective first plane grid mat 18 or the second plane grid mat 20. The attachment may be performed by any appropriate attachment method, including tying, clipping, welding, or any other applicable attachment. Generally, the plane splice mat 44 is placed so as to have approximately half its width over the first plane grid mat 18 of one core body segment 26 and approximately the other half of its width over the first plane grid mat 18 of the adjacent core body segment 26, or approximately half its width over the second plane grid mat 20 of one core body segment 26 and approximately the other half of its width over the second plane grid mat 20 of the adjacent core body segment 26. This provides a maximum strength of joining of adjacent core body segments 26.

Figure 11:
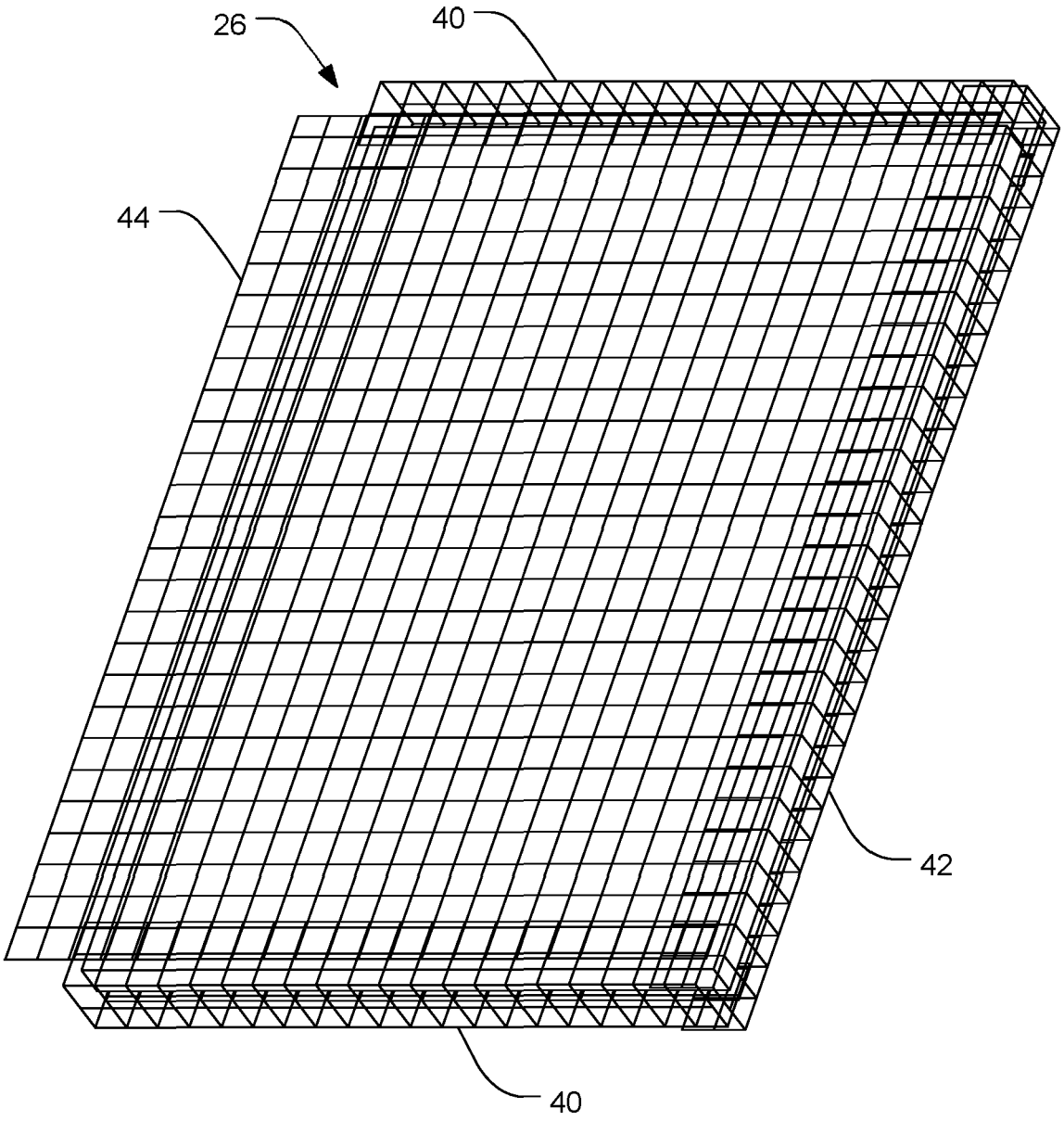
FIG. 11 shows a perspective view of an embodiment of a core wall segment in accordance with embodiments of the invention.

The plane spice mats 44 of some embodiments are attached to the core body segments 26 only at the place of assembly of the core body 12. In such embodiments, the plane splice mat 44 (or mats 44) for one core body segment 26 may be placed and affixed to the first plane grid mat 18 of the first or end core body segment 26 (as shown in FIG. 11), and that core body segment 26 is inverted so that the first plane grid mat 18 and its associated plane splice mat 44 (or mats 44) rest on the flat assembly surface. The plane splice mat 44 (or mats 44) for the next core body segment 26 is placed and affixed to the first plane grid mat 18 of the second core body segment 26 (as shown in FIG. 12), and that core body segment 26 is inverted and placed so that the first plane grid mat 18 and its associated plane splice mat 44 (or mats 44) rests on the flat assembly surface with a portion of the first plane grid mat 18 of the second core body segment 26 resting on the plane splice mat 44 (or mats 44) of the first core body segment. Then another plane splice mat 44 (or mats 44) is placed spanning the joint between the first and second core body segments 44 at the second plane grid mats 20 and is affixed thereto, thereby linking the adjacent core body segments 44. This process is then repeated until all core body segments 44 are linked.

The assembled core body 12 has a significantly reduced weight as opposed to reinforcing steel constructions formed for traditional steel-and-concrete panels. By way of example, the assembled core body 12, even with any included reinforcing steel members, may weigh as little as approximately 1.5 pounds per square foot (approximately 7.3 kg per square meter). Accordingly, the need for specialized heavy lifting equipment to move the assembled core body 12 is greatly reduced or eliminated. Indeed, where steel reinforcement (rebar) assembly for traditional steel-and-concrete panels typically must occur in the forms so that the forms cannot be used during the period of assembly of the steel reinforcement, the core body 12 of embodiments of the invention may generally be assembled on any flat surface and then lifted into the pre-assembled form (even simply by hand-lifting) such that forms are only actively occupied or in use while the concrete is actually curing. In the case of precast panel factories particularly, this means that the usage rates of forms can be greatly increased.

As may be appreciated, the plane splice mats 44 of the first plane grid mat 18 side of the core body 12 and core body segments 26, which are resting on the flat assembly surface, are only attached to one core body segment 26 each. It has been found that it is generally not necessary to make additional attachments to the other core body segments 26; the full attachment of the plane splice mats 44 on a single side of the core body 12 and attachment of half of each of the plane splice mats 44 on the other side of the core body 12 is generally enough for the desired function of the core body 12. Nevertheless, optionally and if desired, the assembled core body 12 can be inverted, lifted, or otherwise moved to provide access to the plane splice mats 44 on the first plane grid mat 18 side of the core body 12 to permit attachment of the plane splice mats 44 to the other core body segments 26.

In other embodiments, the plane splice mats 44 are attached to one or more sides of the core body segments 26 at the time of manufacture of the core body segments 26 to reduce the amount of work necessary at the time of final assembly. A tradeoff of this is that the stack of core body segments 26 becomes slightly larger (wider) for shipping purposes, and it is slightly more likely for the plane splice mats 44 to become bent during shipping. Nevertheless, in such embodiments, the plane splice mats 44 are attached to at least one of the sides of the core body segments 26 (as shown in FIGS. 11 and 12), and may be attached to both sides of the core body segments 26 (as shown in FIGS. 11 and 13, note that end core body segments 26 still only have the plane splice mat 44 or mats 44 on one side) prior to being shipped or transferred from the manufactory to the place where tilt-up panels 10 or precast panels 10 are to be formed. As may be seen in FIG. 13, core body segments 26 with plane splice mats 44 on both sides have the plane splice mats 44 located at opposite longitudinal edges 34 so as to minimize interference with placement of the core body segments 26 during assembly of the core body 12.

Some embodiments of the invention avoid the use of plane splice mats 44 by forming the first plane grid mat 18 and the second plane grid mat 20 to have a transverse width that is greater than the transverse width of the slab 24 of heat-insulating material such that the first plane grid mat 18 and the second plane grid mat 20 may be offset from each other to form splice extensions 46 as shown in FIGS. 14 and 15. As may be appreciated from the differences between FIGS. 14 and 15, the extent of each splice extension 46 may be varied from embodiment to embodiment to provide a desired extent of attachment between core body segments 26. The core body segments 26 shown in FIGS. 14 and 15 are intermediate core body segments 26. End core body segments 26 in such embodiments may have only one or no splice extension 46.

Figure 16:
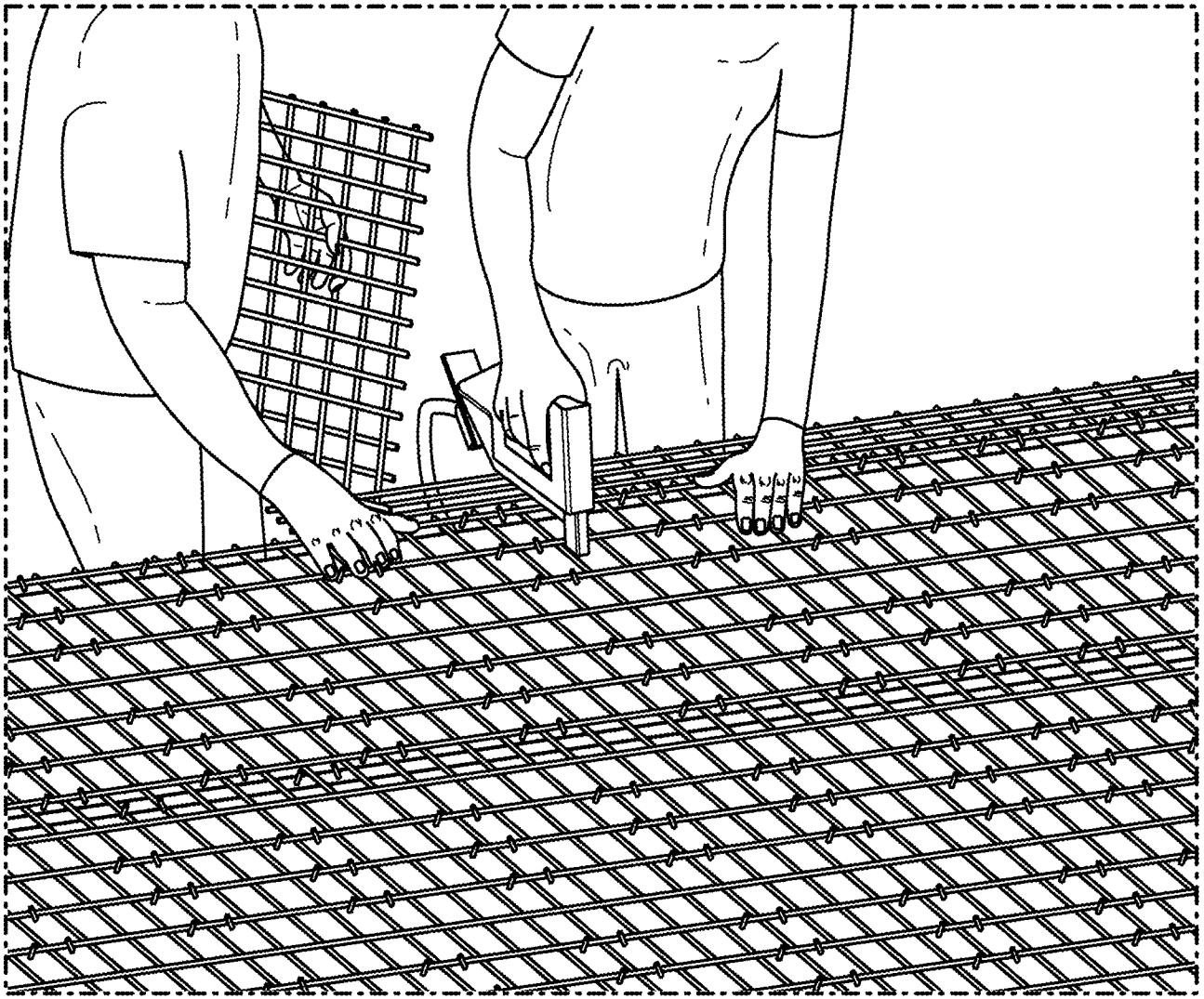
FIG. 16 shows a perspective view of a step of assembling core body segments into a unitary core body in accordance with embodiments of the invention.
Figure 17:
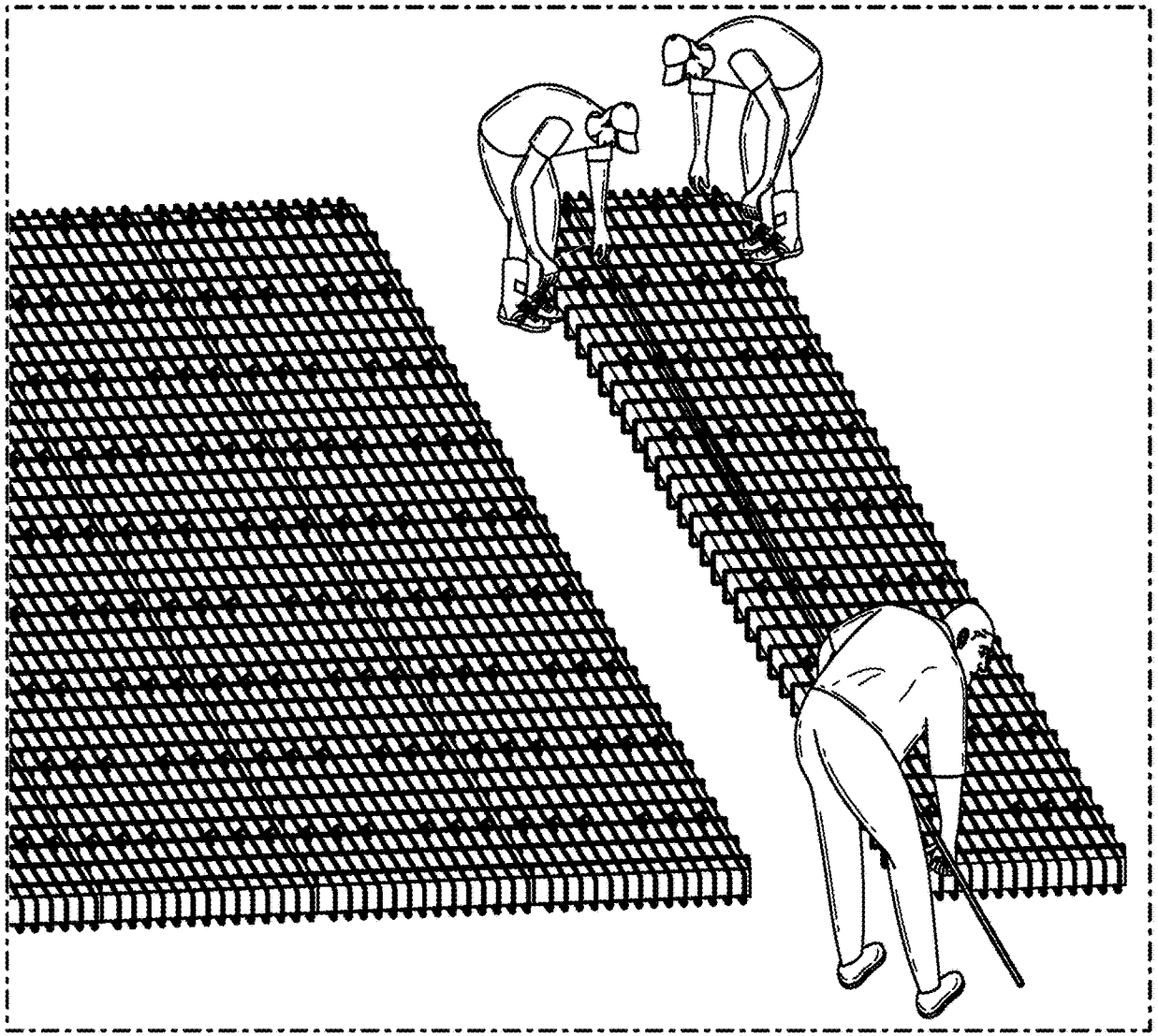
FIG. 17 shows a perspective view of a step of assembling core body segments into a unitary core body in accordance with embodiments of the invention.
Figure 18:
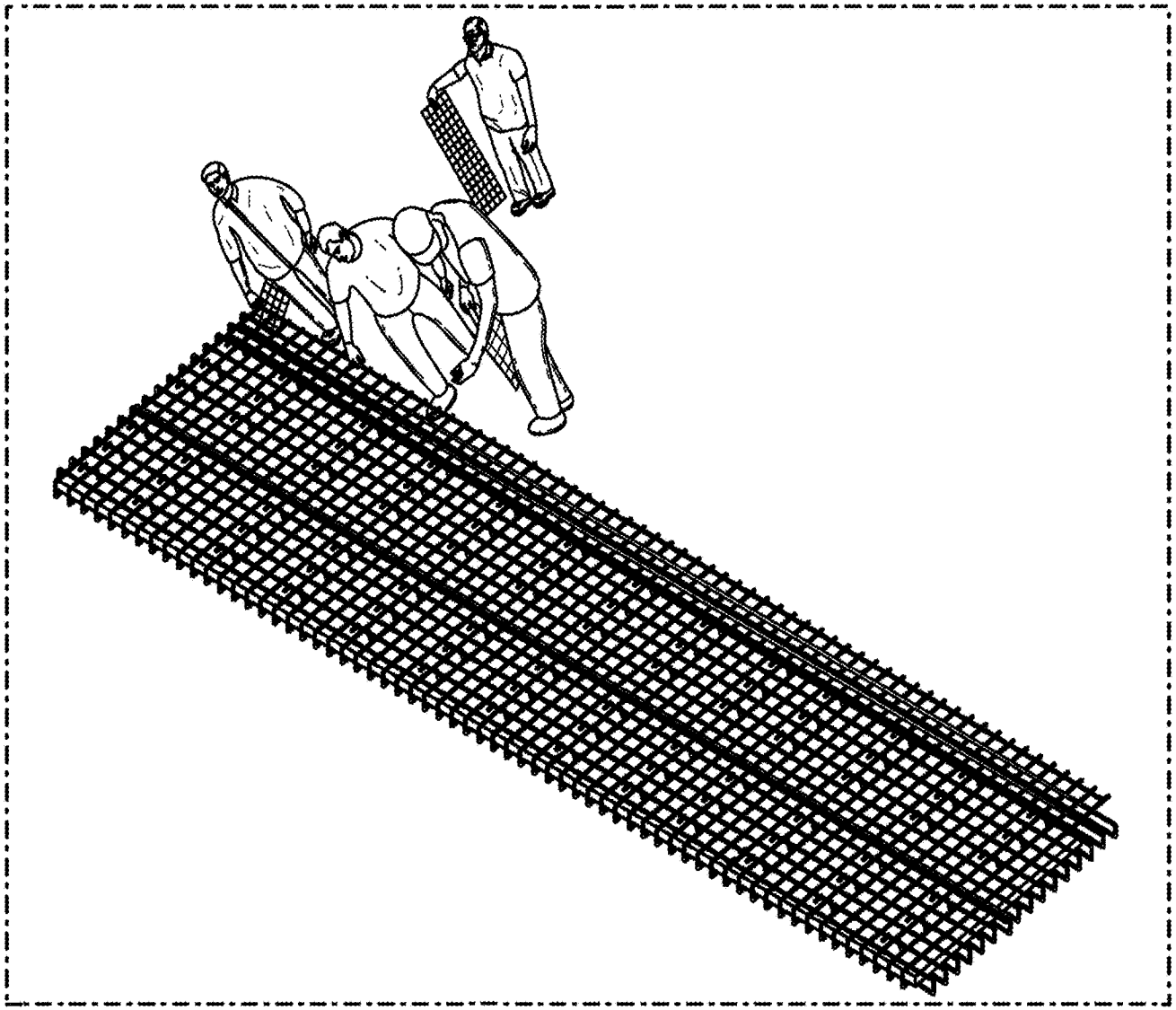
FIG. 18 shows a perspective view of a step of assembling core body segments into a unitary core body in accordance with embodiments of the invention.

FIGS. 16-36 illustrate methods in accordance with embodiments of the invention. In particular, FIG. 16 illustrates how one core body segment 26 has plane splice mats 44 affixed to one edge on one side of it in preparation for bridging core body segments 26 together to make them into a single unitary construct. FIG. 17 illustrates how rebar (e.g., No. 4 rebar) can be placed between the grid mats 18, 20 and the insulating slab 24 and attached to the grid mat 18, 20 (e.g., by tying) to provide additional strength to the core body segment 26. FIG. 18 illustrates how the splice mats 44 and rebar are placed on one side of a core body segment 26 first.

Figure 19:
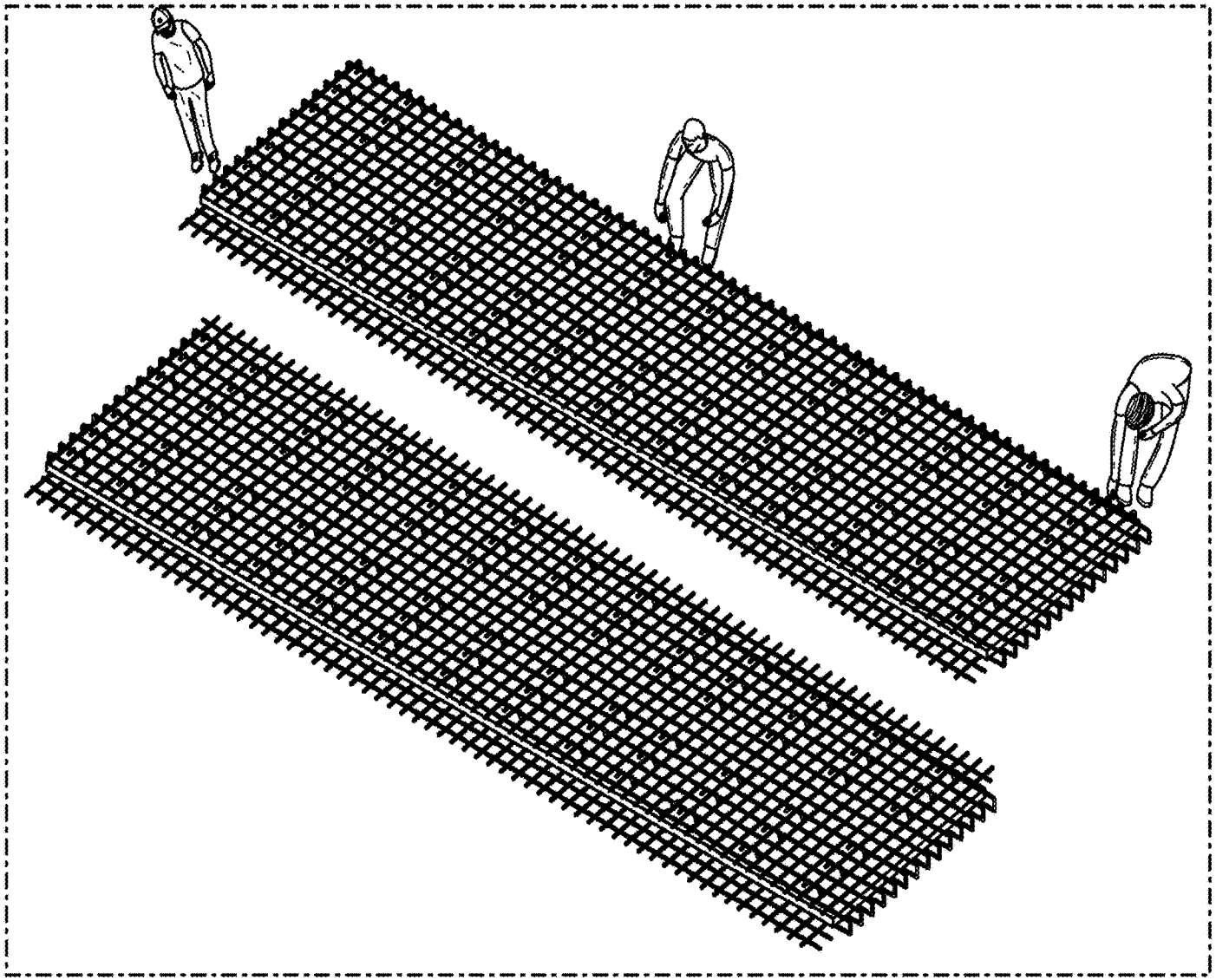
FIG. 19 shows a perspective view of a step of assembling core body segments into a unitary core body in accordance with embodiments of the invention.
Figure 20:
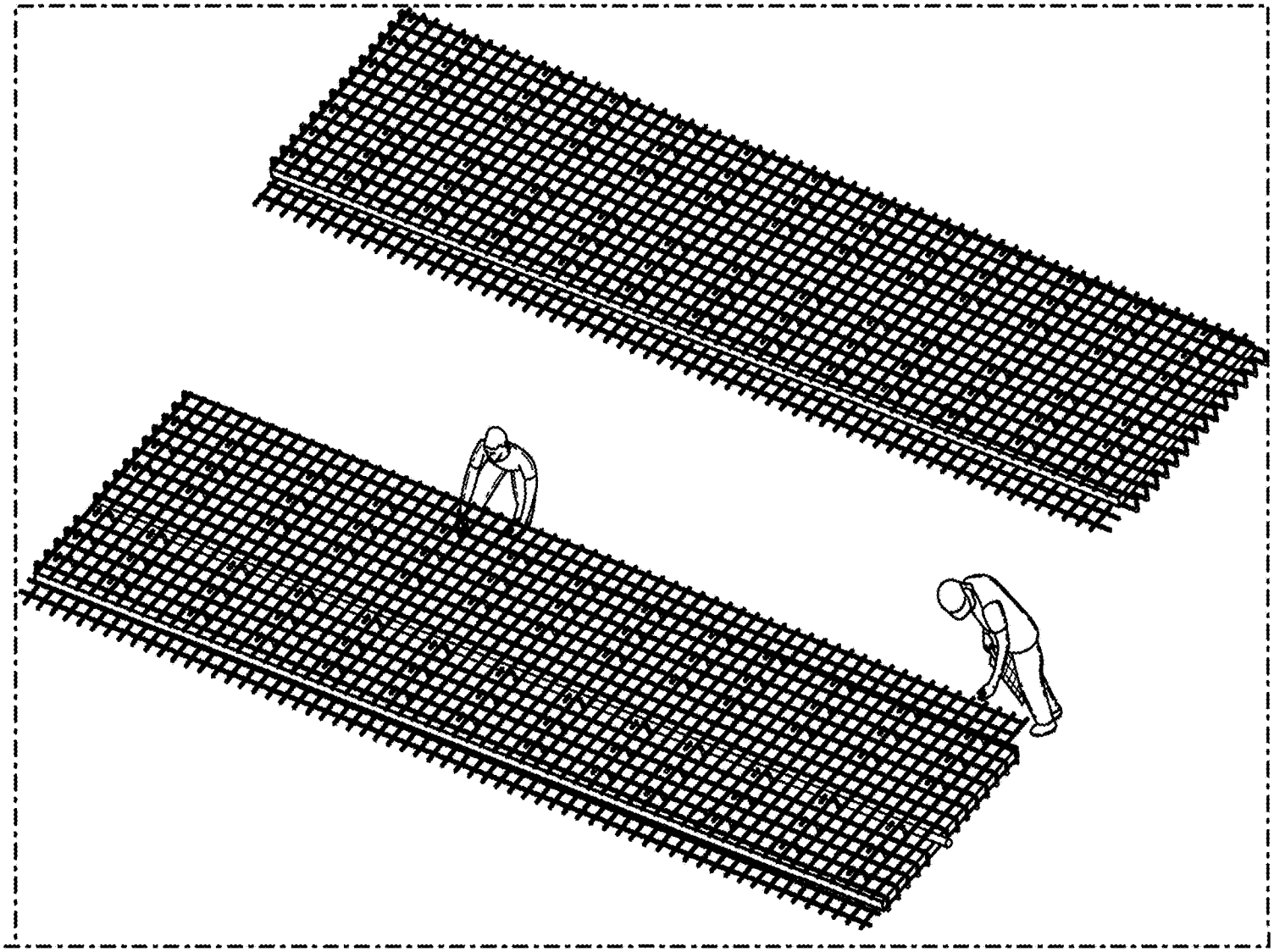
FIG. 20 shows a perspective view of a step of assembling core body segments into a unitary core body in accordance with embodiments of the invention.
Figure 21:
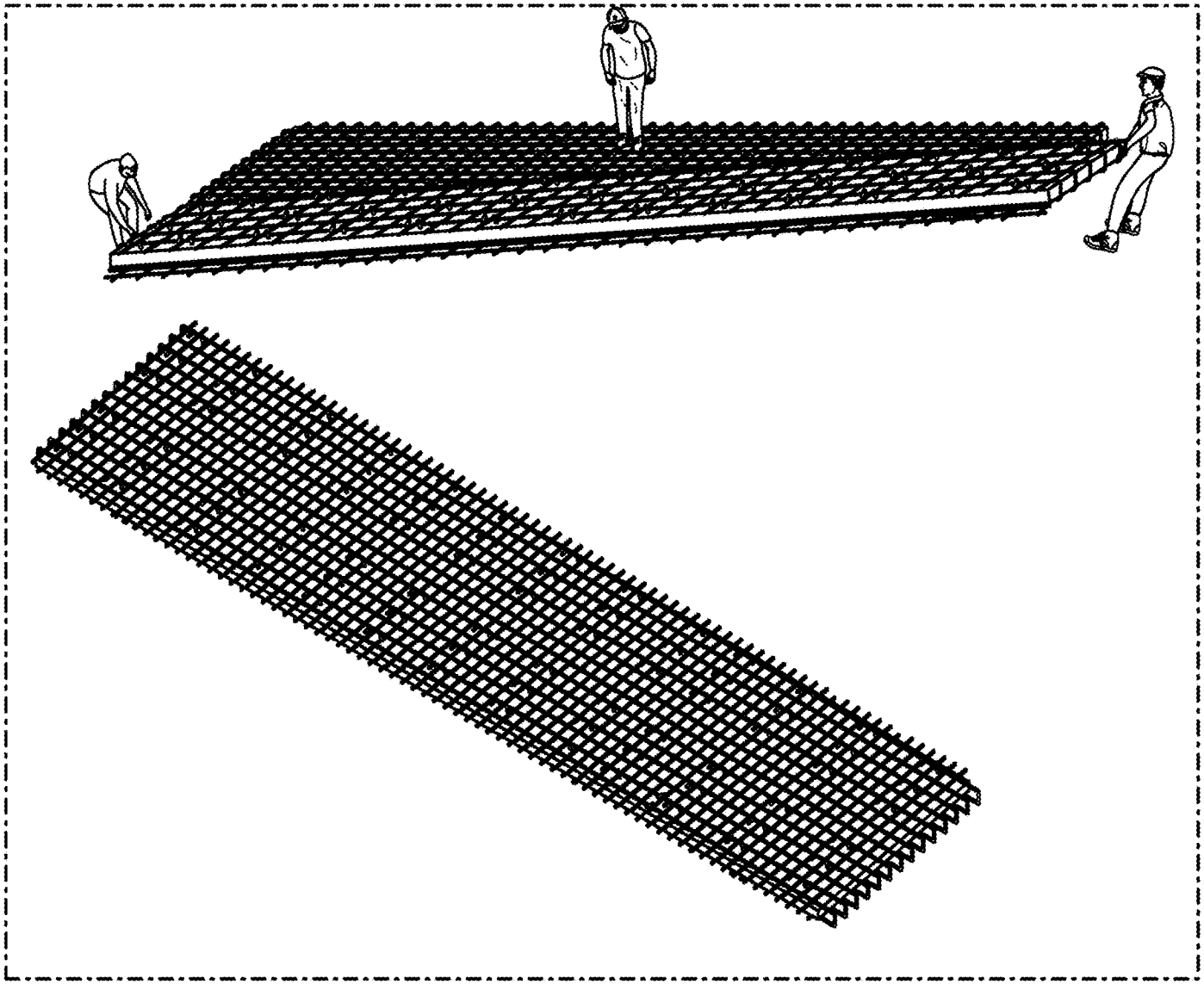
FIG. 21 shows a perspective view of a step of assembling core body segments into a unitary core body in accordance with embodiments of the invention.
Figure 22:
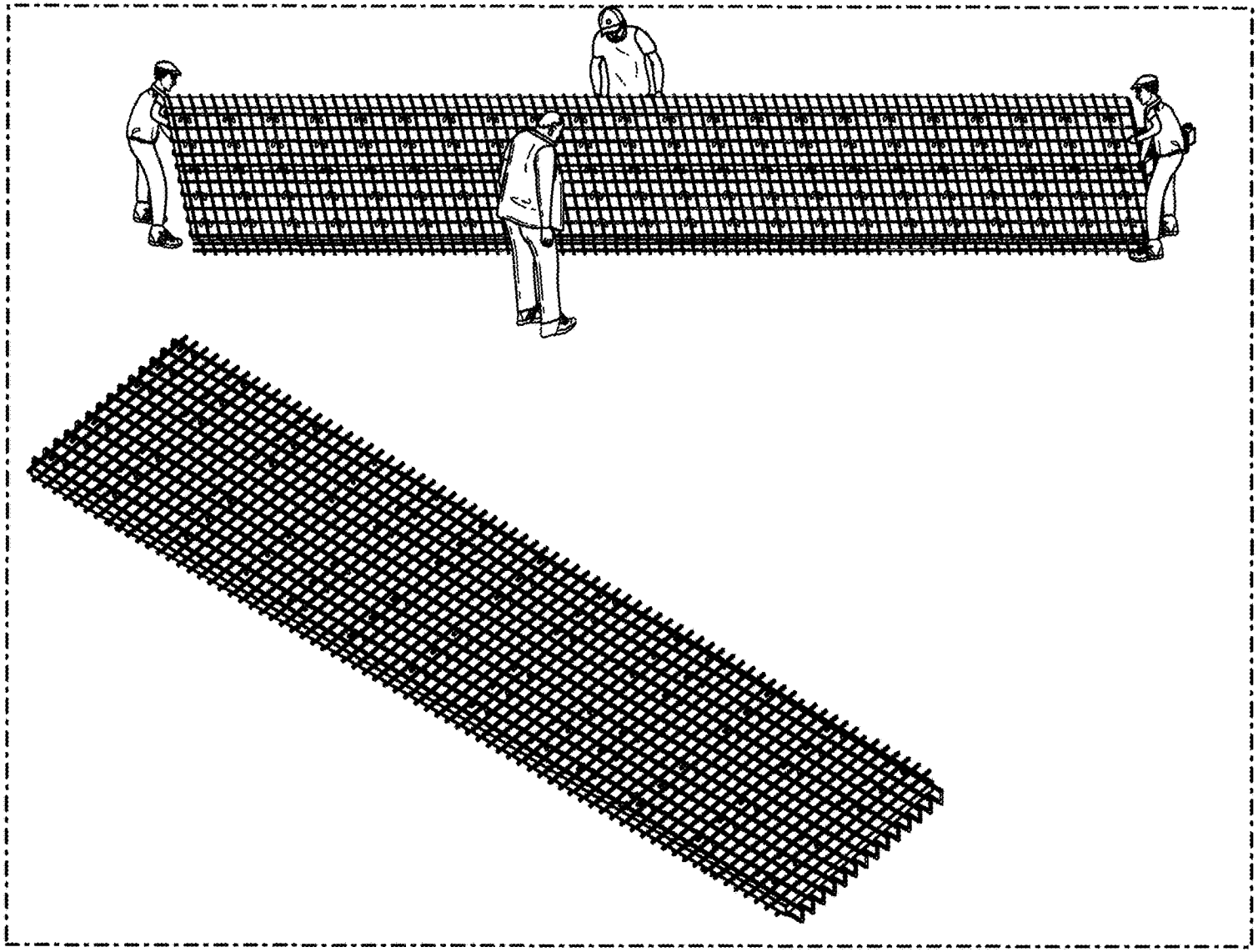
FIG. 22 shows a perspective view of a step of assembling core body segments into a unitary core body in accordance with embodiments of the invention.
Figure 23:
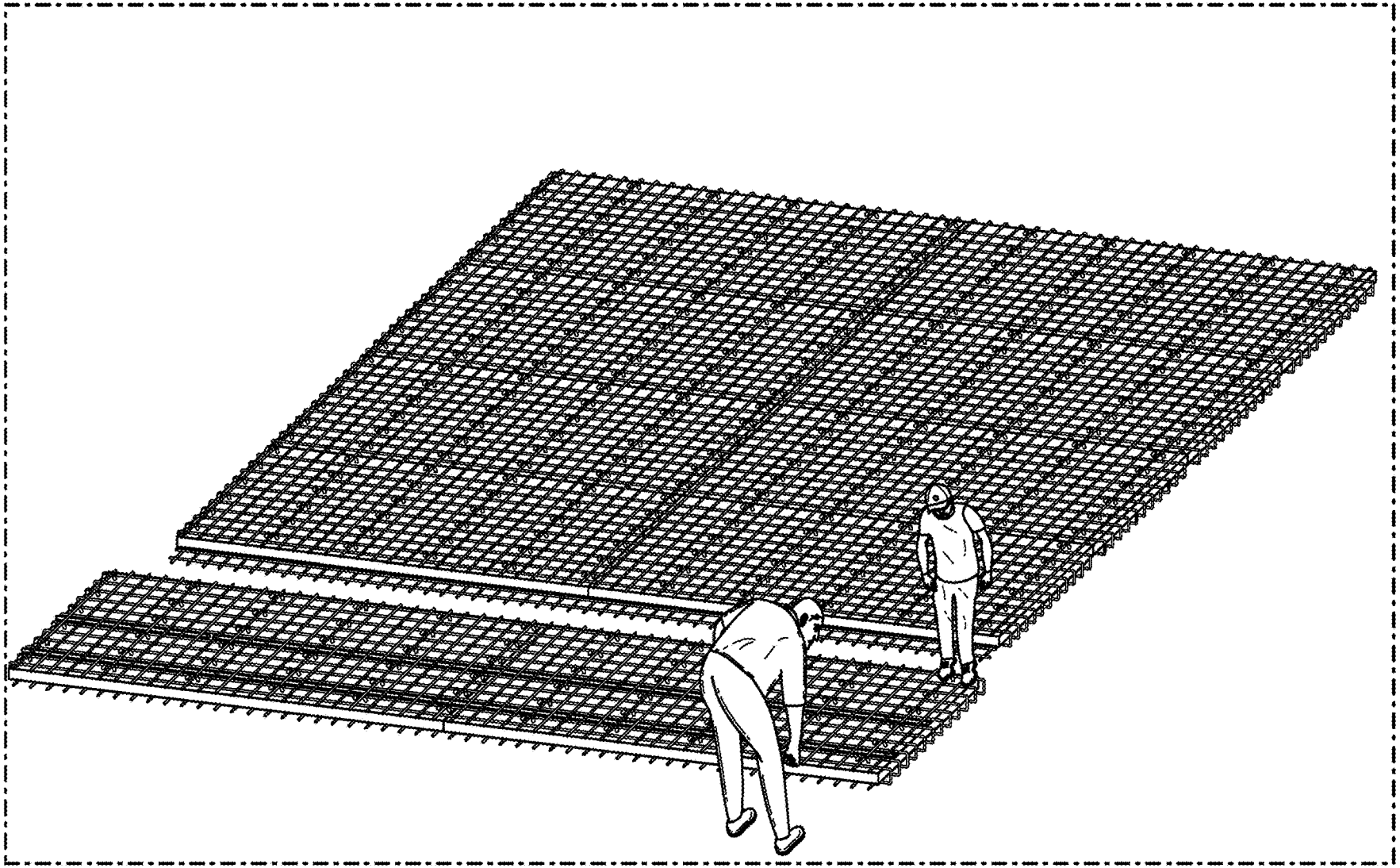
FIG. 23 shows a perspective view of a step of assembling core body segments into a unitary core body in accordance with embodiments of the invention.
Figure 24:
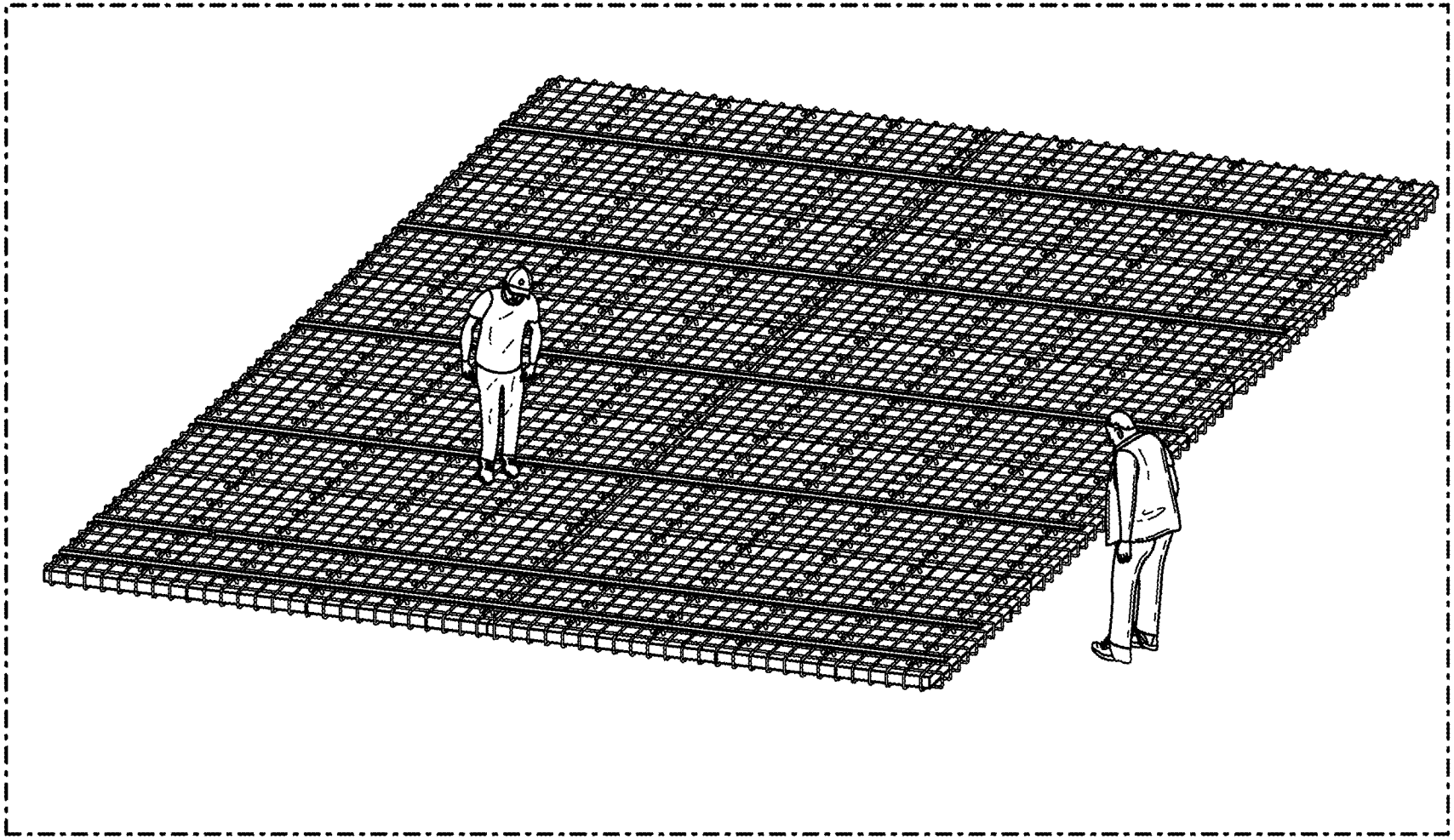
FIG. 24 shows a perspective view of a step of assembling core body segments into a unitary core body in accordance with embodiments of the invention.
Figure 25:
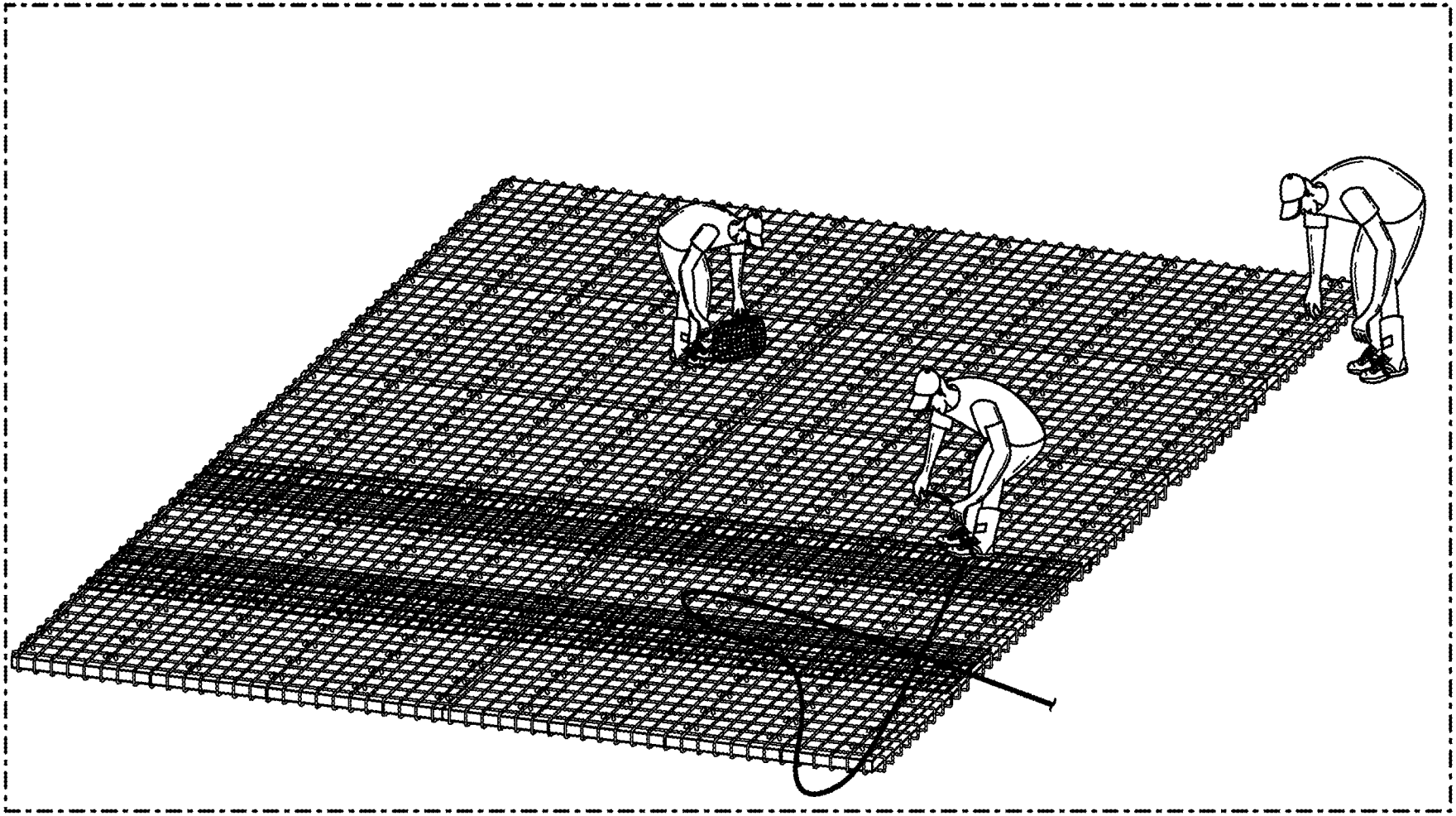
FIG. 25 shows a perspective view of a step of assembling core body segments into a unitary core body in accordance with embodiments of the invention.

FIG. 19 then illustrates how one body segment 26 is flipped over, with a line of plane splice mats 44 half exposed on the ground, and the process is repeated. FIGS. 20-23 show how the process is repeated, with a next core body segment 26 being placed adjacent the first core body segment 26 so the exposed half of the plane splice mats 44 of the first body segment 26 lie under the grid mats 18, 20 of the next core body segment 26, until all core body segments 26 are placed together. FIGS. 24 and 25 show how the process of placing rebar and plane splice mats 44 is repeated, with the plane splice mats 44 being placed over joints between core body segments 26 so as to create a unitary construct.

Figure 26:
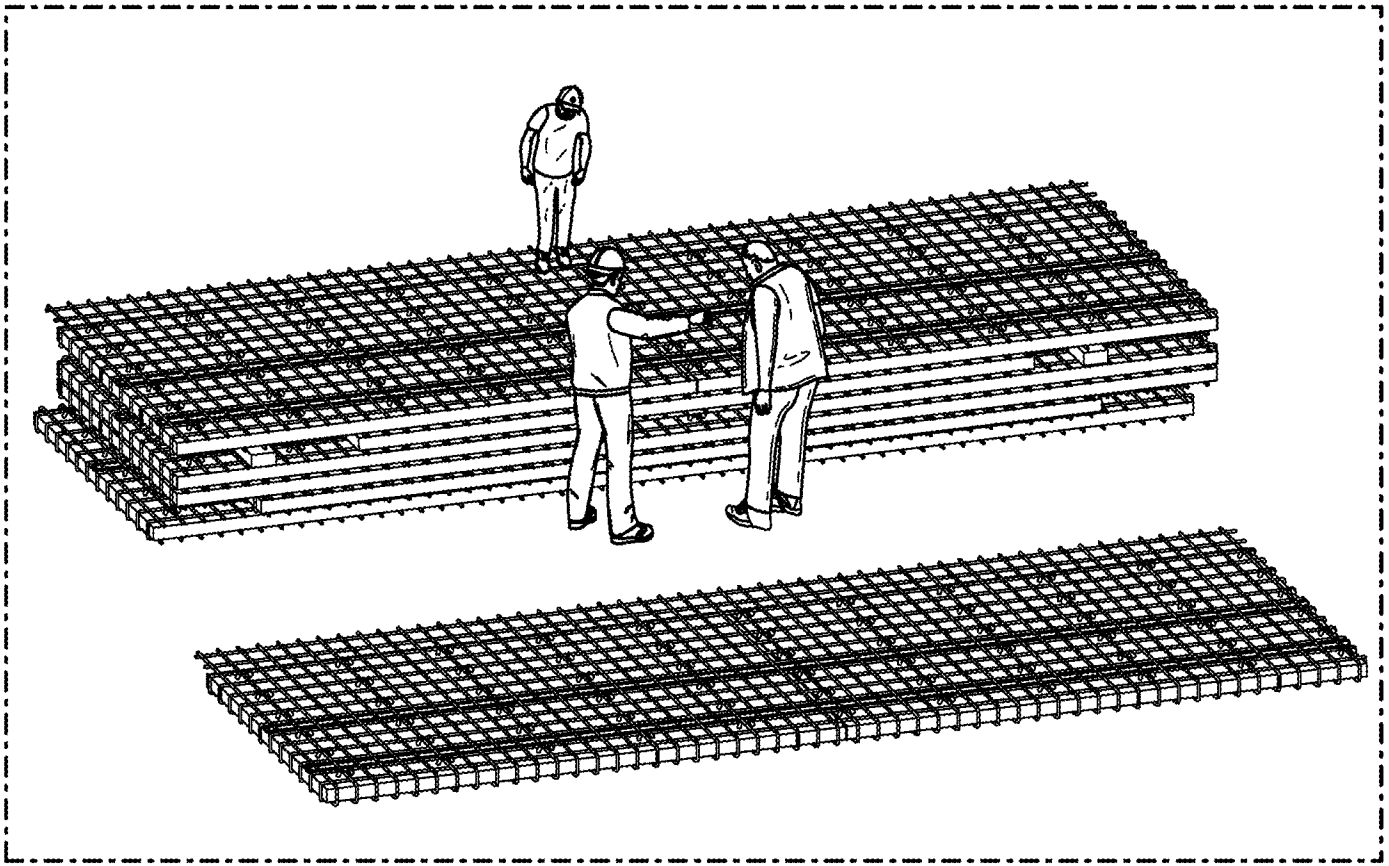
FIG. 26 shows a perspective view of a step of assembling core body segments into a second unitary core body in accordance with embodiments of the invention.
Figure 27:
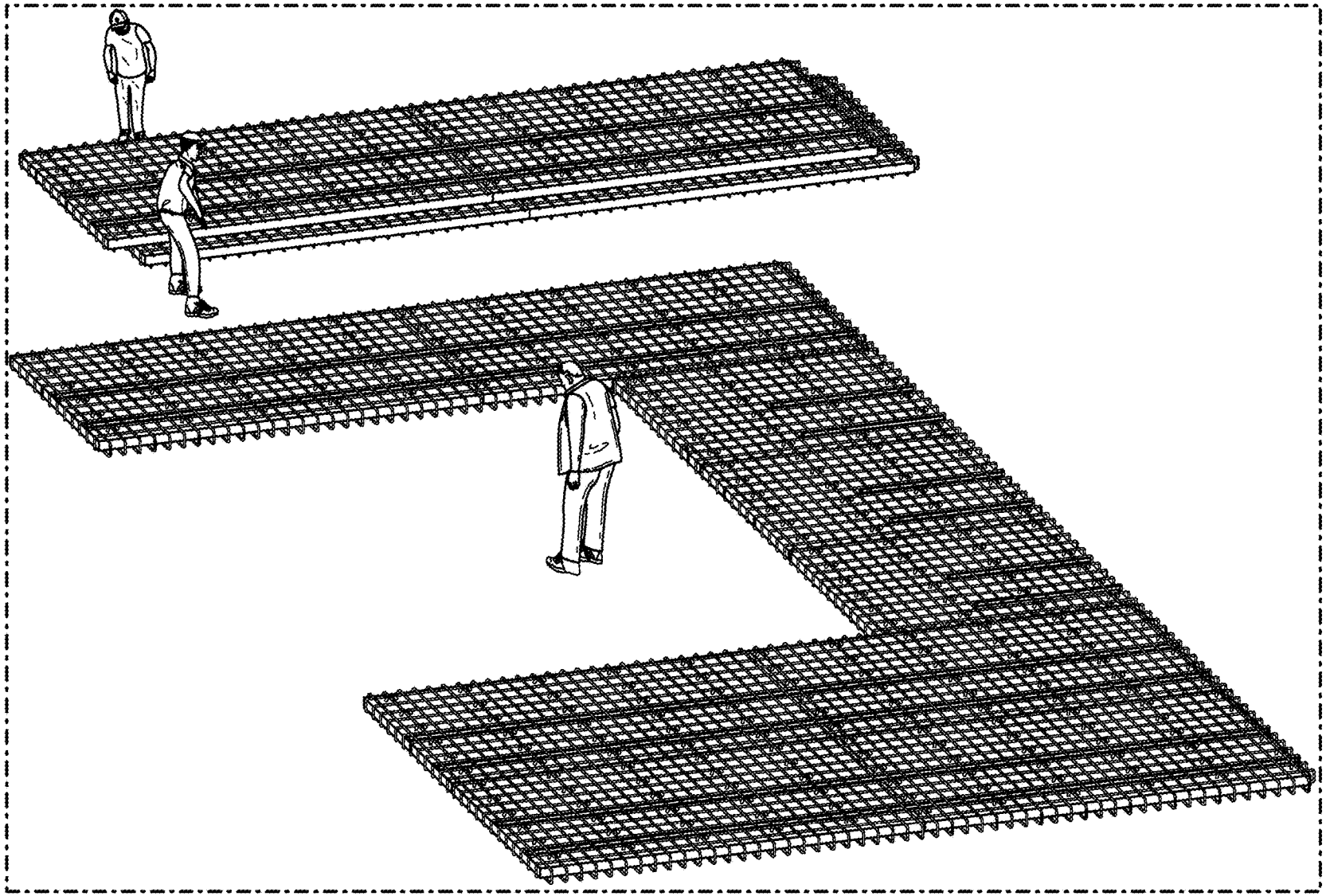
FIG. 27 shows a perspective view of a step of assembling core body segments into the second unitary core body in accordance with embodiments of the invention.
Figure 28:
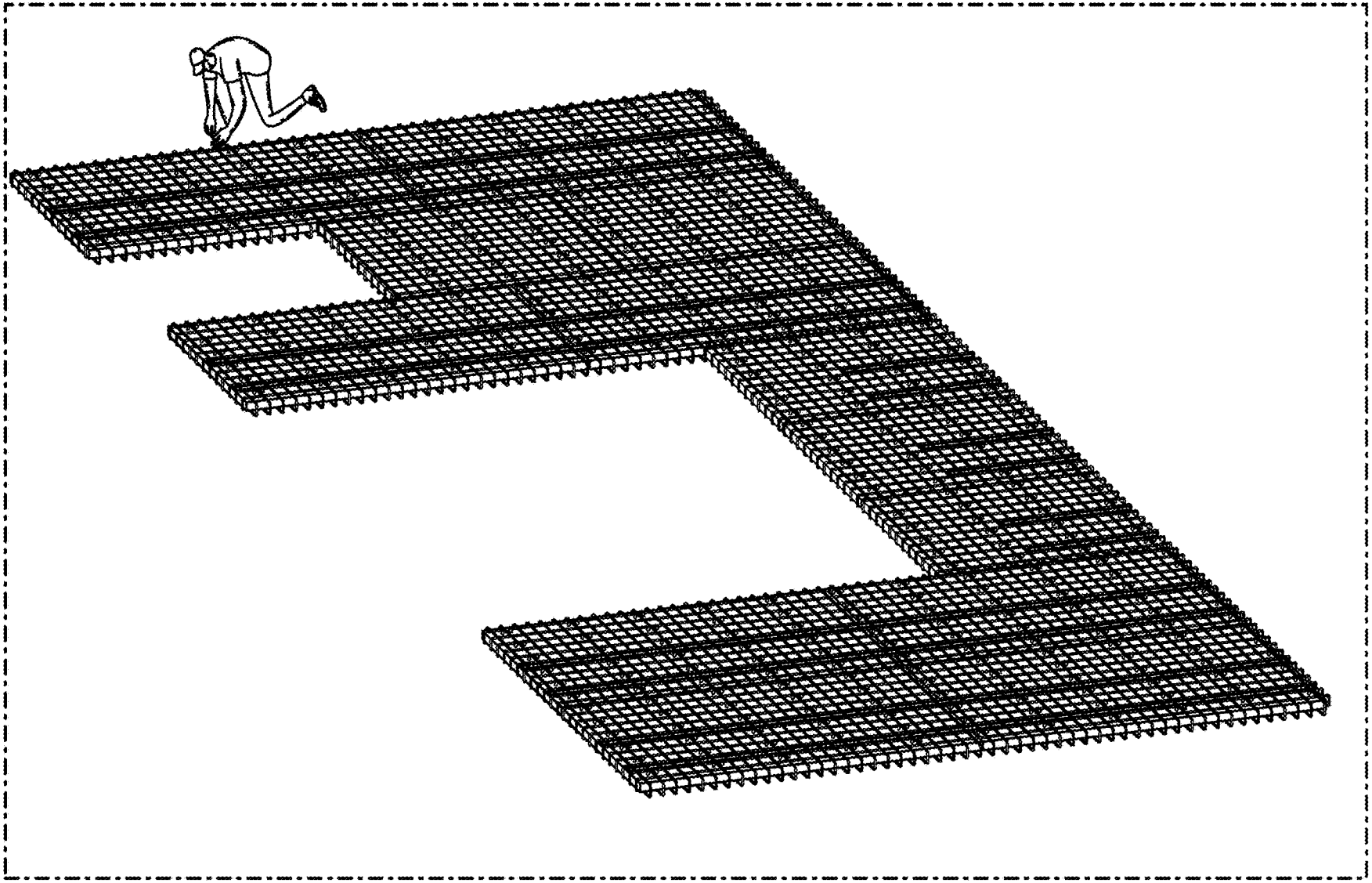
FIG. 28 shows a perspective view of a step of assembling core body segments into the second unitary core body in accordance with embodiments of the invention.

FIGS. 26-28 illustrate the process again with an alternate wall panel 10, this one having openings for doors formed by core body segments 26 of different lengths. Openings can also be formed by cutting out or otherwise removing portions of the grid mats 18, 20 and insulating slab 24. FIG. 26 illustrates that top rebar (and plane splice mats 44) can be placed along the way as core body segments 26 are inverted and placed, thereby keeping additional workers involved and hastening completion of the panel core body 12. FIG. 27 illustrates that rebar can be placed above the lentils to increase strength in those locations. FIG. 28 illustrates a completed panel core body 12 as a unitary construct.

Figure 29:
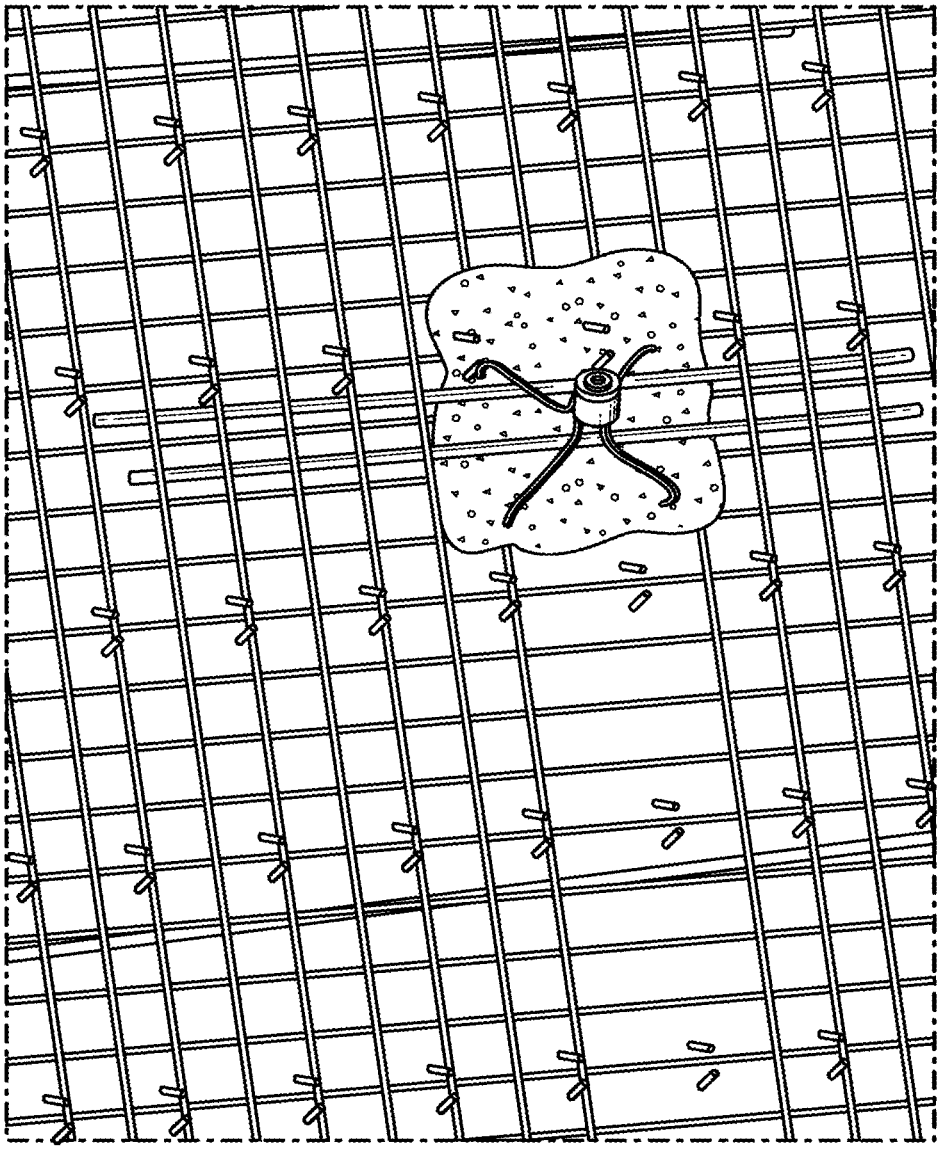
FIG. 29 shows a perspective view of a step of adding a bracing, pick point, or other embedment into a core body in accordance with embodiments of the invention.
Figure 30:
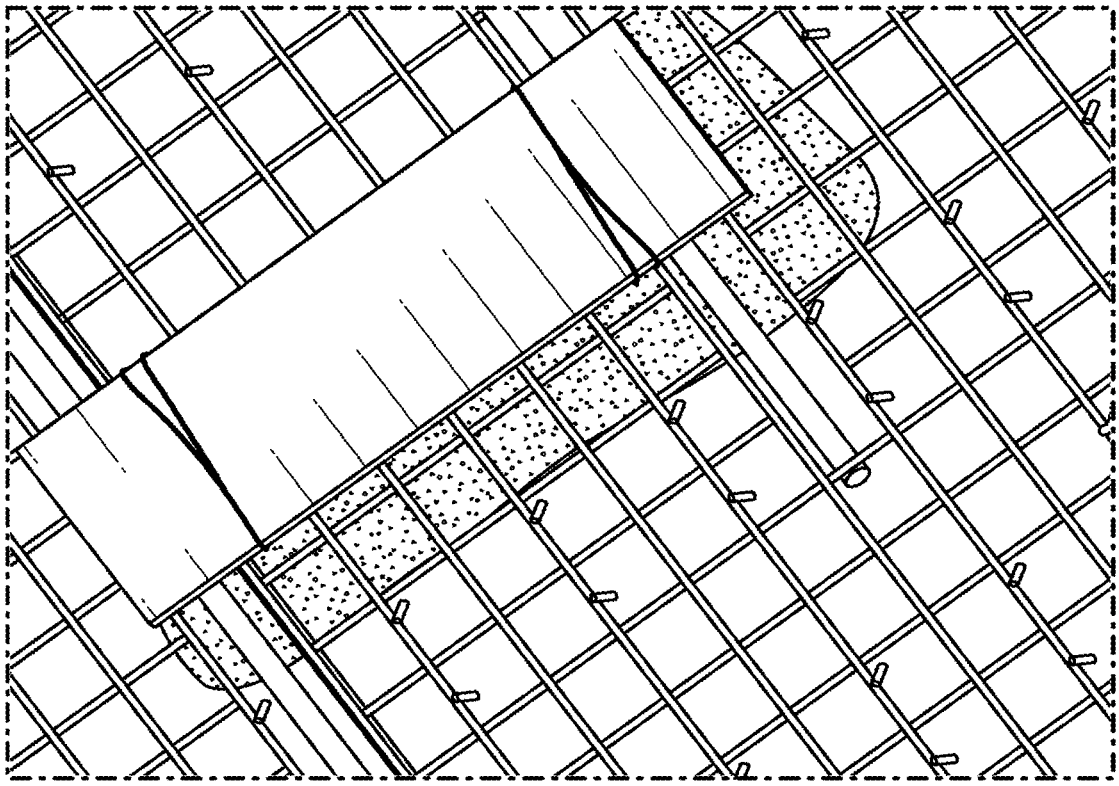
FIG. 30 shows a perspective view of a step of adding a bracing, pick point, or other embedment into a core body in accordance with embodiments of the invention.
Figure 31:
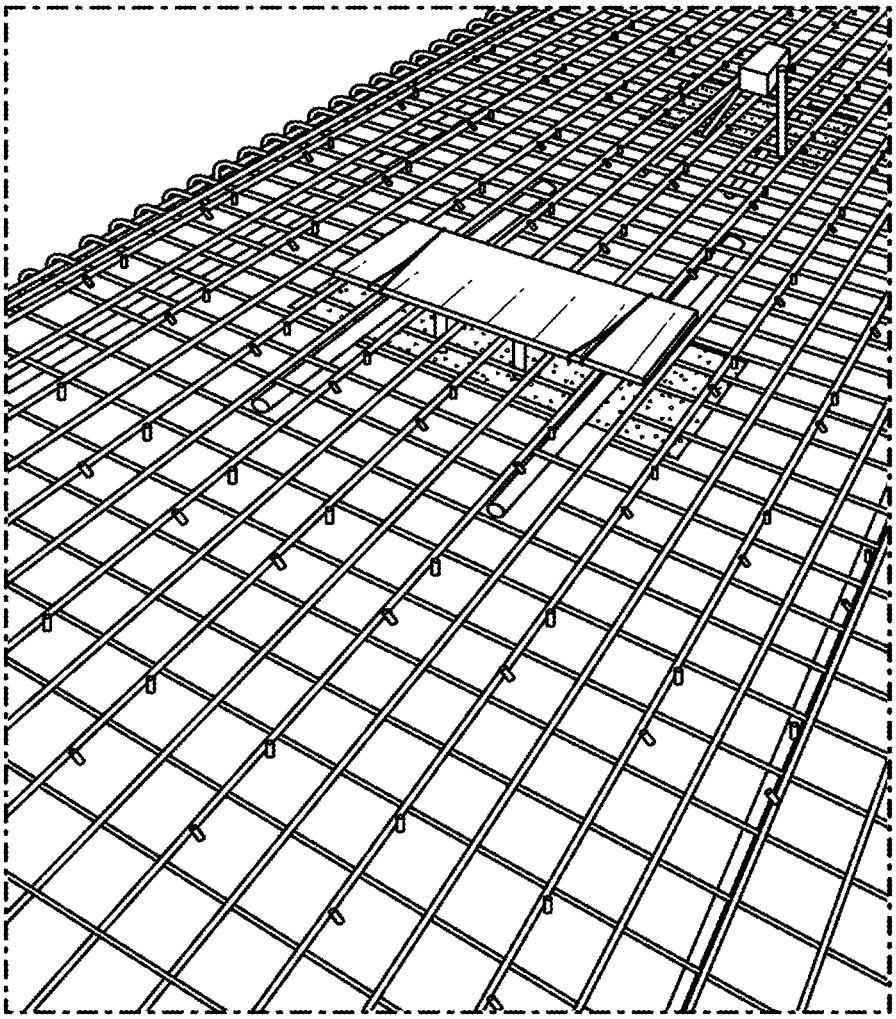
FIG. 31 shows a perspective view of a step of adding a bracing, pick point, or other embedment into a core body in accordance with embodiments of the invention.

FIG. 29-31 illustrate placement and affixation of embedded items such as pick points, bracing points, and the like. To place such items, a portion of the grid mat 18, 20 at the appropriate location is removed. A void is created in the insulating slab 24 to receive the embedded item (and later, securing concrete), such as by burning out some of the insulation. In some embodiments, at least a part of the void is formed through the entire thickness of the slab 24. In other embodiments, the void extends only partially through the thickness of the slab 24. The embedded item can then be secured to the grid mat 18, 20 such as by being secured to rebar extending between and secured to remaining portions of the grid mat 18, 20.

Figure 32:
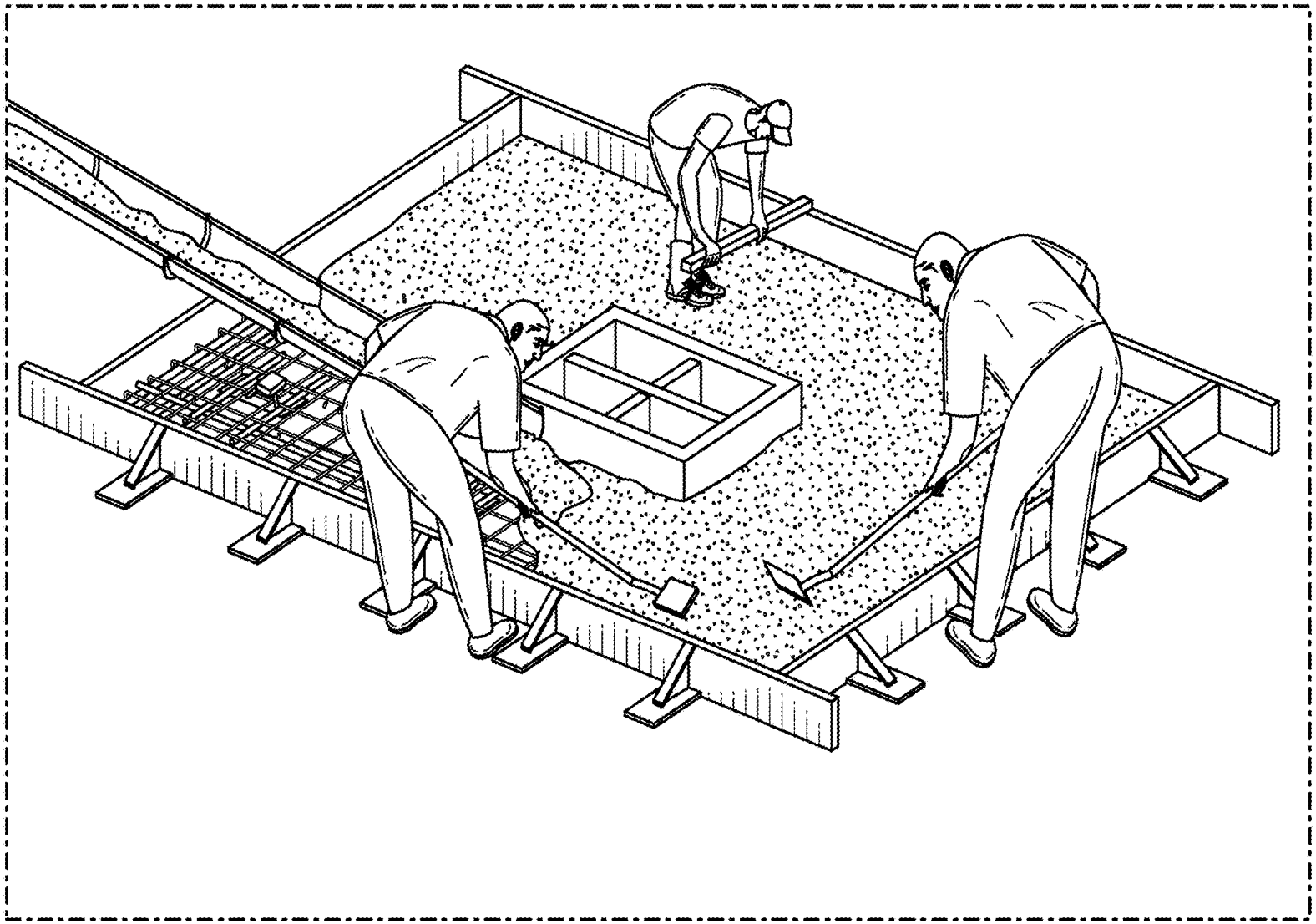
FIG. 32 shows a perspective view of a step for forming a tilt-up or precast panel from concrete and a core body in accordance with embodiments of the invention.

FIGS. 32-36 illustrate construction of an embodiment of a tilt-up or precast construction panel 10 using an embodiment of a tilt-up or precast construction panel core body 12. As illustrated in FIG. 32, a form is created and is filled (in this example) with approximately two inches (approximately 5.1 cm) of concrete (generally, approximately twice the distance between the surface of the slab 24 of heat-insulating material and the first plane grid mat 18 or the second plane grid mat 20, but as discussed previously, the amount may vary in certain embodiments). The amount/thickness and, potentially, formulation (e.g. aggregate size, etc.) of concrete is chosen to provide a desired strength characteristic. In the illustrated embodiment, a distance between the grid mat 18, 20 and one side of the insulating slab 24 is approximately one inch (approximately 2.5 cm), so having approximately two inches (approximately 5.1 cm) of concrete ensures that approximately one inch (approximately 2.5 cm) of concrete is present on either side of the grid mat 18, 20, or that the grid mat 18, 20 is located approximately centrally within the layer 14 of concrete, as determined by engineering requirements (e.g., by an engineer of record).

Figure 33:
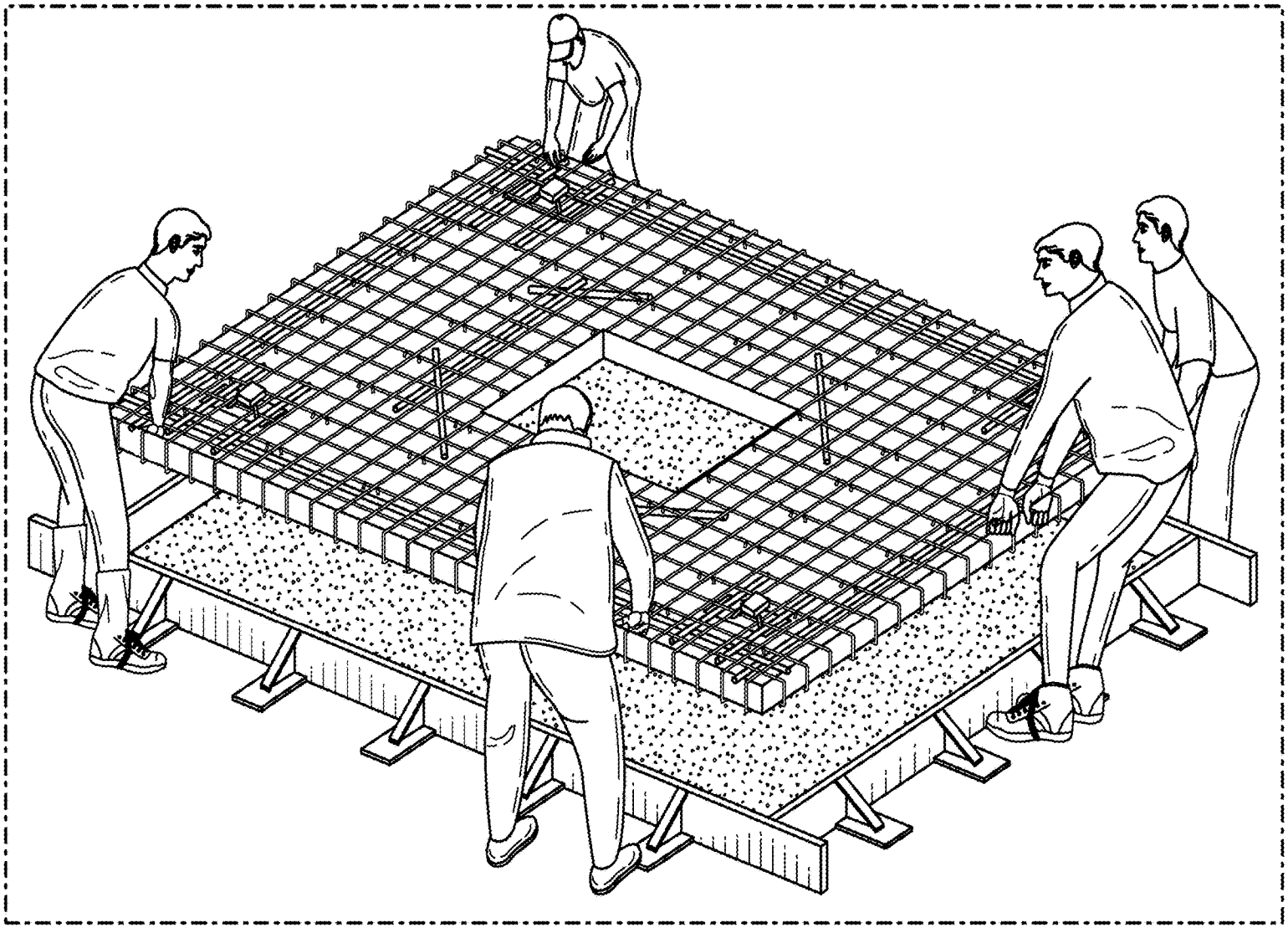
FIG. 33 shows a perspective view of a step for forming a tilt-up or precast panel from concrete and a core body in accordance with embodiments of the invention.
Figure 34:
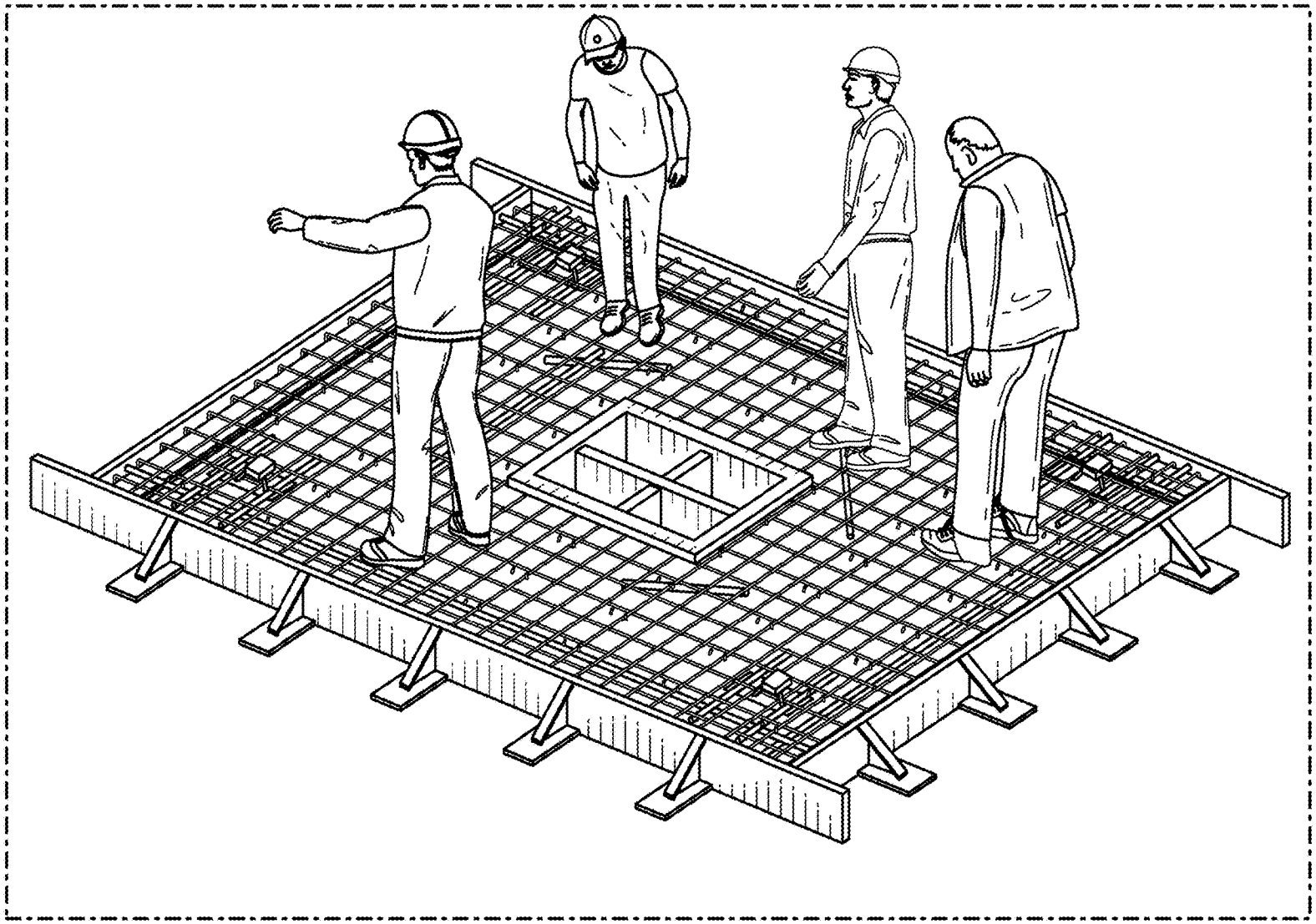
FIG. 34 shows a perspective view of a step for forming a tilt-up or precast panel from concrete and a core body in accordance with embodiments of the invention.

As illustrated in FIG. 33, once the layer 14 of concrete is present in the form (but not yet set), the panel core body 12 is placed in the form over the concrete. Then, as illustrated in FIG. 34, the panel core body is pressed into the concrete (e.g., by use of a vibrating weighted roller or the like or even by walking on the panel core body 12) until the insulating slab 24 rests on or floats on the underlying concrete (whereby the lower grid mat 18, 20 is located approximately centrally within the layer 14 of concrete. It may be noted that separate spacing elements are not required to maintain the grid mat 18, 20 a desired level above the bottom of the form, as the insulating slab 24 prevents the panel core body 12 from sinking too far into the concrete.

Figure 35:
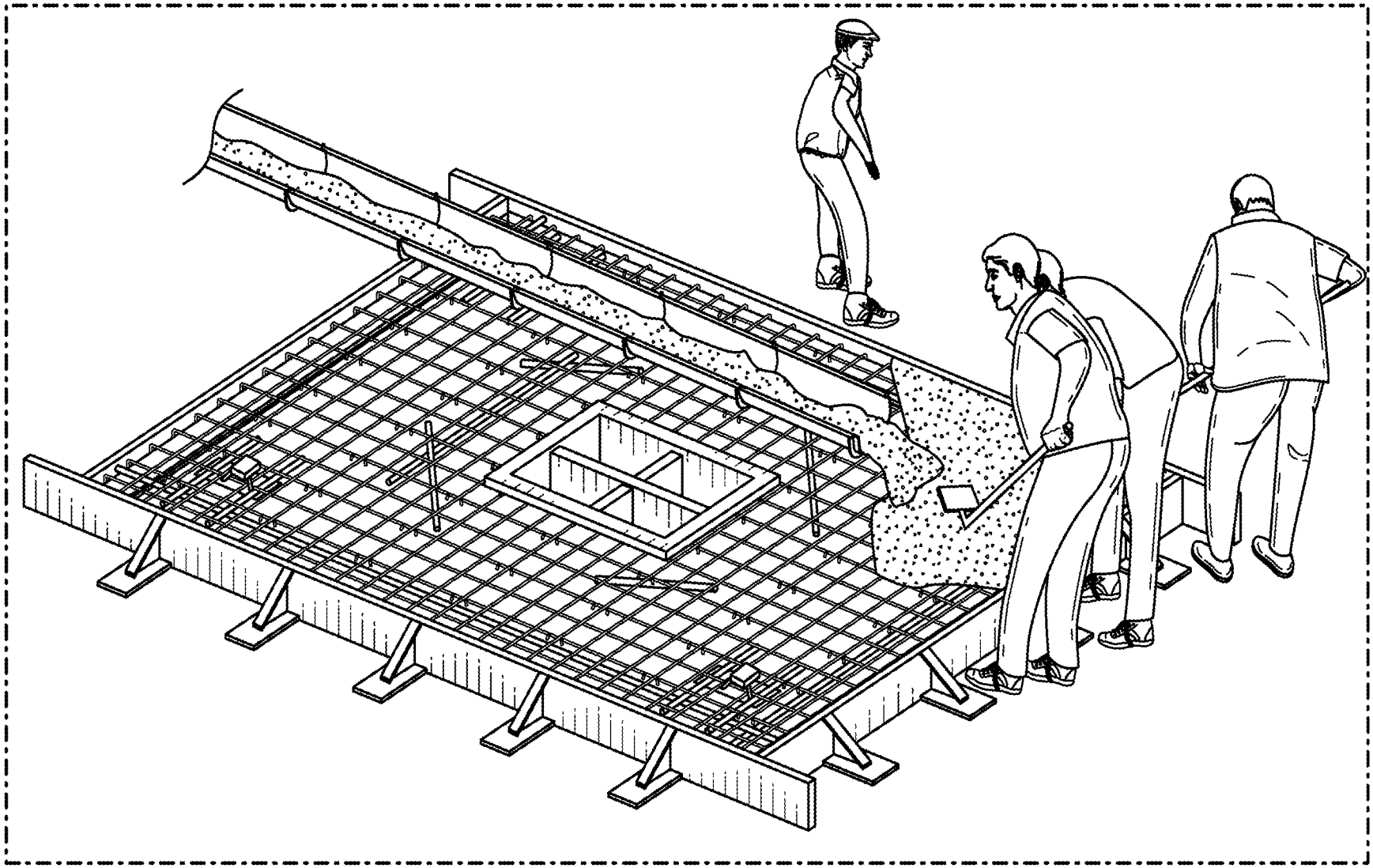
FIG. 35 shows a perspective view of a step for forming a tilt-up or precast panel from concrete and a core body in accordance with embodiments of the invention.
Figure 36:
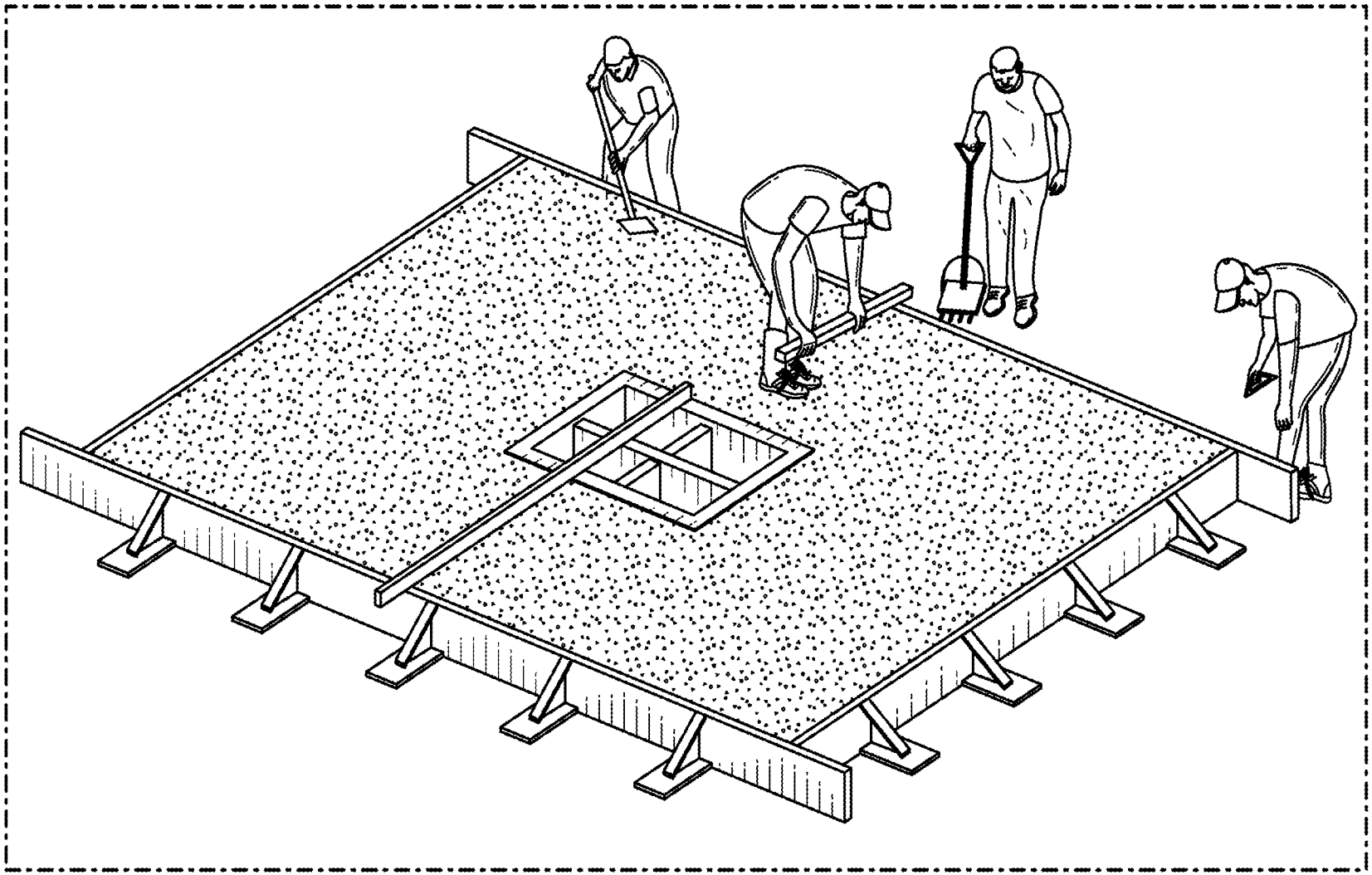
FIG. 36 shows a perspective view of a step for forming a tilt-up or precast panel from concrete and a core body in accordance with embodiments of the invention.

As illustrated in FIG. 35, the next step of the process is placing more concrete on top of the panel core body 12 (also along one or more of the sides thereof, if desired) until a layer 14 of appropriate thickness (e.g. also approximately two inches (approximately 5.1 cm) in this embodiment) is formed. As illustrated in FIG. 36, the concrete is leveled and finished in accordance with traditional concrete pouring and finishing methods. The panel 10 is allowed to cure, and then the tilt-up or precast panel 10 can be handled in accordance with traditional methods.

Of note, however, the panel 10 so formed is significantly lighter than panels of traditional construction while retaining necessary strength. Because of this fact, either lighter-duty construction and/or transportation equipment can be used to tilt up and place such panels 10, or similar-duty construction and/or transportation equipment can be used with tilt-up and precast panels 10 of greatly increased size, allowing for reduction in the number of panels 10 used in construction (thereby reducing labor costs, reducing costs associated with properly joining adjacent panels 10, and the like), increasing the number or size of panels 10 that can be shipped in a single shipment, etc. Accordingly, there are many benefits acquired through use of embodiments of the present invention.

While certain embodiments of the invention have been disclosed herein, alternate embodiments of the invention are embraced as falling within the scope of the teachings of this application. In one alternate type of embodiment, the core panel body 12 is formed in multiple inter-operating parts. In one version of this type of embodiment, a first part includes the first parallel plane grid mat 18 with spacer wires and the slab 24 of heat-insulating material, and a second part includes the other parallel plane grid mat 20 and potentially other spacer wires. The two parts of the core panel body 12 are assembled together either before placing them in the form with the first layer 14 of concrete, or the first part of the core panel body 12 is placed in the concrete in the form, then the second part of the core panel body 12 is placed over the first part. During the placement procedure, the spacer wires pierce the slab 24 of heat-insulating material of the other part, and the spacer wires may be tied or welded onsite (e.g., within the form or before being placed in the form) as desired to achieve a desired strength.

In an alternate embodiment type, a first part of the core panel body 12 having the first parallel plane grid mat 18 and spacer wires is placed in the form on wire stools so as to be spaced above an underlying surface. The first layer 14 of concrete is then poured, after which the slab 24 of heat-insulating material is placed over the first part of the core panel body 12 and pressed downward (e.g., by use of a vibrating weighted roller or the like or even by being walked upon) until the spacer wires fully pierce the slab 24 of heat-insulating material, then the second part having the second parallel plane grid mat 20 is placed over the slab 24 with appropriate spacers and secured to the spacer wires by tying or welding, whereupon the panel 10 may be completed according to the methods discussed previously. In another alternate embodiment, the second part of the core panel body 12 is pre-assembled to the slab 24 of heat-insulating material before placement.

In all of the alternate embodiments, the slab 24 of heat-insulating material may be formed as multiple layers of heat-insulating material and/or as multiple segments of heat-insulating material.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

We claim:

1. A method of forming a tilt-up construction panel, the method comprising:

pouring a layer of concrete into a form;

placing a first tilt-up construction panel core body into the form before the layer of concrete sets;

placing a second tilt-up construction panel core body into the form before the layer of concrete sets, wherein each of the first tilt-up construction panel core body and the second tilt-up construction panel core body comprises:

a first grid mat;

a second grid mat, wherein each of the first grid mat and the second grid mat comprise longitudinal and transverse wires that cross each other and that are coupled together at cross points, and wherein the first grid mat and the second grid mat are spaced apart from each other by a gap;

straight spacer wires that each have a first end portion that is coupled to the first grid mat and a second end portion that is coupled to the second grid mat; and a heat-insulating material disposed within the gap between the first grid mat and the second grid mat;

coupling the first tilt-up construction panel core body to the second tilt-up construction panel core body; and pouring additional concrete over the first tilt-up construction panel core body and the second tilt-up construction panel core body in the form such that at least one of the layer of concrete and the additional concrete surrounds one or more edges of at least one of the first tilt-up construction panel core body and the second tilt-up construction panel core body, and such that the second grid mat of the at least one of the first tilt-up construction panel core body and the second tilt-up construction panel core body is disposed in the additional concrete.

2. The method of claim 1, wherein the straight spacer wires comprise a metal material, wherein the straight spacer wires extend between the first grid mat and the second grid mat at an oblique angle, and wherein at least one of the first grid mat and the second grid mat comprises a metal material.

3. The method of claim 1, wherein the heat-insulating material comprises a first edge and a second edge, with the first edge being disposed opposite to the second edge, wherein a portion of the first grid mat extends past the first edge of the heat-insulating material, and wherein a portion of the second grid mat extends past the second edge of the heat-insulating material.

4. The method of claim 1, wherein the tilt-up construction panel further comprises a first end cap grid mat that is coupled to the first grid mat of the at least one of the first tilt-up construction panel core body and the second tilt-up construction panel core body.

5. The method of claim 1, wherein at least some of the longitudinal and transverse wires cross each other at substantially a right angle.

6. The method of claim 1, wherein a width of the heat-insulating material is less than a width of the gap.

7. The method of claim 1, wherein the placing of the second tilt-up construction panel core body into the form comprises placing the second tilt-up construction panel core body adjacent to the first tilt-up construction panel core body such that an edge of the first tilt-up construction panel core body is approximately parallel to a corresponding edge of the second tilt-up construction panel core body.

8. The method of claim 1, further comprising coupling the second tilt-up construction panel core body to the first tilt-up construction panel core body by coupling a splice mesh to the first tilt-up construction panel core body and to the second tilt-up construction panel core body, and wherein the first tilt-up construction panel core body and the second tilt-up construction panel core body are coupled together before being placed into the form and before the layer of concrete sets.

9. The method of claim 8, wherein the splice mesh comprises additional longitudinal and transverse wires that cross each other and are coupled together at points where they cross.

10. The method of claim 1, further comprising inserting rebar between the first grid mat and the second grid mat.

11. The method of claim 1, further comprising leaving one or more ends of at least one of the first tilt-up construction panel core body and the second tilt-up construction panel core body free of concrete, such that the heat-insulating material is disposed at an edge of the at least one of the first tilt-up construction panel core body and the second tilt-up construction panel core body.

12. The method of claim 1, wherein the layer of concrete has a thickness that is greater than a distance between the heat-insulating material and the first grid mat of the at least one of the first tilt-up construction panel core body and the second tilt-up construction panel core body.

13. A method of forming a tilt-up construction panel, the method comprising:

pouring a layer of concrete into a form;

placing a first tilt-up construction panel core body into the form before the layer of concrete sets, wherein the first tilt-up construction panel core body comprises:

a first grid mat;

a second grid mat spaced apart from the first grid mat by a gap;

a spacer having a first end portion that is coupled to the first grid mat and a second end portion that is coupled to the second grid mat; and a heat-insulating material disposed within the gap between the first grid mat and the second grid mat;

using a splice mesh to couple the first tilt-up construction panel core body to a second tilt-up construction panel core body; and pouring additional concrete over the first tilt-up construction panel core body and the second tilt-up construction panel core body in the form such that at least one of the layer of concrete and the additional concrete surrounds one or more edges of the first tilt-up construction panel core body and the second tilt-up construction panel core and such that the second grid mat of the first tilt-up construction panel core body is disposed in the additional concrete.

14. The method of claim 13, wherein each of the first grid mat of the first tilt-up construction panel core, the second grid mat, and the splice mesh comprises longitudinal and transverse wires that cross each other and that are coupled together at cross points.

15. The method of claim 13, wherein the spacer comprises a wire.

16. The method of claim 13, wherein a length between the first end portion and the second end portion of the spacer is greater than a width of the gap.

17. The method of claim 13, further comprising embedding a lifting attachment point in the tilt-up construction panel.

18. The method of claim 17, further comprising attaching a lifting device to the lifting attachment point to lift the tilt-up construction panel into a vertical position.

19. A method of forming a tilt-up construction panel, the method comprising:

pouring a first layer of concrete into a form;

placing a first tilt-up construction panel core body into the form before the first layer of concrete sets, wherein the first tilt-up construction panel core body comprises:

a first grid mat;

a second grid mat, wherein each of the first grid mat and the second grid mat comprise longitudinal and transverse wires that cross each other and that are coupled together at cross points, and wherein the first grid mat is spaced apart from the second grid mat by a gap;

spacer wires that each have a first end portion that is coupled to the first grid mat and a second end portion that is coupled to the second grid mat; and a heat-insulating material disposed within the gap between the first grid mat and the second grid mat;

placing a second tilt-up construction panel core body into the form before the first layer of concrete sets;

coupling the second tilt-up construction panel core body to the first tilt-up construction panel core body; and pouring a second layer of concrete over the first tilt-up construction panel core body and the second tilt-up construction panel core body in the form such that the second grid mat is disposed in the second layer of concrete, and wherein after the first layer of concrete and the second layer of concrete each set, the first tilt-up construction panel core body, the second tilt-up construction panel core body, the first layer of concrete, and the second layer of concrete form a unitary whole in the form of the tilt-up construction panel.

20. The method of claim 19, further comprising removing the tilt-up construction panel from the form and lifting the tilt-up construction panel into a vertical position.

* * * * *